US011540041B2

(12) United States Patent
Kuipers

(10) Patent No.: US 11,540,041 B2
(45) Date of Patent: Dec. 27, 2022

(54) COMMUNICATION DEVICE COMPRISING AN ACOUSTICAL SEAL AND A VENT OPENING

(71) Applicant: Sonion Nederland B.V., Hoofddorp (NL)

(72) Inventor: Erwin Kuipers, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 16/648,360

(22) PCT Filed: Jul. 13, 2018

(86) PCT No.: PCT/EP2018/069105
§ 371 (c)(1),
(2) Date: Mar. 18, 2020

(87) PCT Pub. No.: WO2019/052715
PCT Pub. Date: Mar. 21, 2019

(65) Prior Publication Data

US 2020/0288251 A1 Sep. 10, 2020

(30) Foreign Application Priority Data

Sep. 18, 2017 (GB) ..... 1714956

(51) Int. Cl.
*H04R 1/10* (2006.01)
*H04R 25/00* (2006.01)

(52) U.S. Cl.
CPC ..... *H04R 1/1041* (2013.01); *H04R 25/456* (2013.01); *H04R 25/603* (2019.05);
(Continued)

(58) Field of Classification Search
None
See application file for complete search history.

(56) References Cited

U.S. PATENT DOCUMENTS 4,533,890 A * 8/1985 Patel ..... F01L 9/20 335/234
5,809,157 A * 9/1998 Grumazescu ..... H04R 9/063 310/13

(Continued)

FOREIGN PATENT DOCUMENTS

CN 102595270 A 7/2012
EP 2164277 A2 3/2010

(Continued)

OTHER PUBLICATIONS

International Search Report for Application No. PCT/EP2018/069105, dated Oct. 15, 2018 (3 pages).

(Continued)

*Primary Examiner* — Walter F Briney, III
(74) *Attorney, Agent, or Firm* — Nixon Peabody LLP

(57) ABSTRACT

A communication device configured for use in a user's ear canal including a sealing mechanism configured to acoustically seal a section of the ear canal and a sound conduit in acoustic communication with a sound source. The sound conduit has a first and second opening, a conduit housing, and a vent opening. To provide a reliable adjustment for the venting of sound waves between a sealed section of the ear canal and an ambient environment outside the sealed section, an acoustic valve having a valve member is moveably coupled with the conduit housing, which moveable coupling is configured to provide a relative motion of the valve member and the conduit housing, such that by such relative motion the acoustic valve provides for opening the vent opening, closing the vent opening, and/or adjusting a size of the vent opening. The communication device further includes an electrical actuator to activate the relative motion.

17 Claims, 20 Drawing Sheets

(52) U.S. Cl.
CPC ..... *H04R 25/65* (2013.01); *H04R 25/652* (2013.01); *H04R 2460/11* (2013.01)

(56) References Cited

U.S. PATENT DOCUMENTS 6,373,675 B1 * 4/2002 Yamazaki ..... H01H 33/6662 200/237
6,788,796 B1 9/2004 Miles
6,831,577 B1 12/2004 Furst
6,853,290 B2 2/2005 Jorgensen
6,859,542 B2 2/2005 Johannsen
6,888,408 B2 5/2005 Furst
6,914,992 B1 7/2005 van Halteren
6,919,519 B2 7/2005 Ravnkilde
6,930,259 B1 8/2005 Jorgensen
6,943,308 B2 9/2005 Ravnkilde
6,974,921 B2 12/2005 Jorgensen
7,008,271 B2 3/2006 Jorgensen
7,012,200 B2 3/2006 Moller
7,062,058 B2 6/2006 Steeman
7,062,063 B2 6/2006 Hansen
7,072,482 B2 7/2006 Van Doorn
7,088,839 B2 8/2006 Geschiere
7,110,560 B2 9/2006 Stenberg
7,136,496 B2 11/2006 van Halteren
7,142,682 B2 11/2006 Mullenbom
7,181,035 B2 2/2007 van Halteren
7,190,803 B2 3/2007 van Halteren
7,206,428 B2 4/2007 Geschiere
7,221,767 B2 5/2007 Mullenborn
7,221,769 B1 5/2007 Jorgensen
7,227,968 B2 6/2007 van Halteren
7,239,714 B2 7/2007 de Blok
7,245,734 B2 7/2007 Niederdraenk
7,254,248 B2 8/2007 Johannsen
7,286,680 B2 10/2007 Steeman
7,292,700 B1 11/2007 Engbert
7,292,876 B2 11/2007 Bosh
7,336,794 B2 2/2008 Furst
7,376,240 B2 5/2008 Hansen
7,403,630 B2 7/2008 Jorgensen
7,415,121 B2 8/2008 Mögelin
7,425,196 B2 9/2008 Jorgensen
7,460,681 B2 12/2008 Geschiere
7,466,835 B2 12/2008 Stenberg
7,492,919 B2 2/2009 Engbert
7,548,626 B2 6/2009 Stenberg
7,657,048 B2 2/2010 van Halteren
7,684,575 B2 3/2010 van Halteren
7,706,561 B2 4/2010 Wilmink
7,715,583 B2 5/2010 Van Halteren
7,728,237 B2 6/2010 Pedersen
7,809,151 B2 10/2010 Van Halteren
7,822,218 B2 10/2010 Van Halteren
7,899,203 B2 3/2011 Van Halteren
7,912,240 B2 3/2011 Madaffari
7,946,890 B1 5/2011 Bondo
7,953,241 B2 5/2011 Jorgensen
7,961,899 B2 6/2011 Van Halteren
7,970,161 B2 6/2011 van Halteren
8,098,854 B2 1/2012 van Halteren
8,101,876 B2 1/2012 Andreasen
8,103,039 B2 1/2012 van Halteren
8,160,290 B2 4/2012 Jorgensen
8,170,249 B2 5/2012 Halteren
8,189,804 B2 5/2012 Hruza
8,189,820 B2 5/2012 Wang
8,223,996 B2 7/2012 Beekman
8,233,652 B2 7/2012 Jorgensen
8,259,963 B2 9/2012 Stenberg
8,259,976 B2 9/2012 van Halteren
8,259,977 B2 9/2012 Jorgensen
8,280,082 B2 10/2012 van Halteren
8,284,966 B2 10/2012 Wilk
8,313,336 B2 11/2012 Bondo
8,315,422 B2 11/2012 van Halteren
8,331,595 B2 12/2012 van Halteren
8,369,552 B2 2/2013 Engbert
8,379,899 B2 2/2013 van Halteren
8,509,468 B2 8/2013 van Halteren
8,526,651 B2 9/2013 Lafort
8,526,652 B2 9/2013 Ambrose
8,885,866 B2 11/2014 Sakaguchi et al.
2010/0166245 A1 * 7/2010 Takigawa ..... H04R 1/1041 381/380
2011/0182453 A1 7/2011 van Hal
2011/0189880 A1 8/2011 Bondo
2011/0299708 A1 12/2011 Bondo
2011/0299712 A1 12/2011 Bondo
2011/0311069 A1 12/2011 Ambrose
2012/0014548 A1 1/2012 van Halteren
2012/0027245 A1 2/2012 van Halteren
2012/0140966 A1 6/2012 Mocking
2012/0155683 A1 6/2012 van Halteren
2012/0155694 A1 6/2012 Reeuwijk
2012/0255805 A1 10/2012 van Halteren
2012/0308062 A1 12/2012 Djalilian et al.
2013/0028451 A1 1/2013 de Roo
2013/0136284 A1 5/2013 van Hal
2013/0142370 A1 6/2013 Engbert
2013/0163799 A1 6/2013 Van Halteren
2013/0195295 A1 8/2013 van Halteren
2017/0251292 A1 8/2017 Wiederholtz

FOREIGN PATENT DOCUMENTS

EP 2202996 A2 6/2010
WO 2015101505 A1 7/2015

OTHER PUBLICATIONS

Written Opinion of International Searching Authority for Application No. PCT/EP2018/069105, dated Oct. 15, 2018 (8 pages).

* cited by examiner

COMMUNICATION DEVICE COMPRISING AN ACOUSTICAL SEAL AND A VENT OPENING

CROSS-REFERENCE TO RELATED APPLICATIONS

This application is a U.S. National Stage of International Application No. PCT/EP2018/069105, filed Jul. 13, 2018, which claims the benefit of United Kingdom Patent Application No. 1714956.8, filed Sep. 18, 2017, both of which are incorporated herein by reference in their entireties.

TECHNICAL FIELD

This disclosure generally relates to a communication device configured for use in a user's ear canal, and more specifically to a venting of sound waves from an acoustically sealed section provided by the communication device in the ear canal, according to the preamble of claim 1.

BACKGROUND OF INVENTION

Communication devices may be used to improve the hearing capability or communication capability of a user, for instance by compensating a hearing loss of a hearing-impaired user, in which case the communication device is commonly referred to as a hearing instrument such as a hearing aid, or hearing prosthesis. A communication device may also be used to produce a sound in a user's ear canal. For example, sound may be communicated by a wire or wirelessly to a communication device, which may reproduce the sound in the user's ear canal. For example, earbuds, earphones and/or the like may be used to generate sound in a person's ear canal.

A hearing device (HD), such as a hearing instrument, may use a microphone to pick up/receive sound. Circuitry in the hearing instrument can process signals from the microphone, and provides the processed sound signal into the ear canal of the user via a miniature loudspeaker, commonly referred to as a sound reproduction device or a receiver. Hearing devices may also receive sound signals from alternative input sources, such as an induction coil and/or a wireless transmitter, for example via a mobile phone, wireless streaming, Bluetooth connection and/or the like, and process these sounds signals and deliver them to the user. Furthermore, hearing devices may be employed as hearing protection devices that suppress or at least substantially attenuate loud sounds and noises that could harm or even damage the user's sense of hearing.

Hearing devices that are inserted at least partially into a user's ear canal may form a seal between the communication device and the ear canal. For example, some hearing devices comprise ear-tips or earpads that may seal the ear canal to transmission of ambient sound from outside of the ear, preventing interference of the ambient sounds/noise with the sound communicated into the ear by the hearing device. Similarly, some hearing devices may be configured to block the ear canal and prevent interference of the ambient sounds/noise with the sound communicated into the ear by the hearing device.

However, sealing of the ear canal prevents the user of the hearing device registering ambient sounds, such as someone trying to communicate with the user, and produces occlusion effects, where low frequency body-conducted sound, such as the user's own voice, is trapped in the ear canal by the communication device sealing the ear canal resulting in an undesirable loud perception of low frequencies.

U.S. Pat. No. 8,885,866 describes an earphone comprising an adjustable vent. The vent is independent of a sound output channel of the earphone. The vent is adjusted by relatively moving an ear tip of the earphone with respect to the sound conduit tube. The vents are provided at a central location of the earphone and can be adjusted between an open position and a closed position. The earphone has the disadvantage that the ear tip has to be removed from the ear canal in order to allow a manual adjustment of the ear tip relative to the sound conduit tube, by which an adjustment of the vent shall be achieved. Thus, an adjustment of the vent during usage of the earphone inside an ear canal is not provided for. Another disadvantage is caused by the small cross sectional size of the venting channel separated from the sound output channel including a small inlet diameter and a small outlet diameter. Such a geometry leads to a large acoustic mass and a high impedance inside the venting channel, which only allows a rather inefficient transport of the sound waves toward an ambient environment during the venting.

European patent application publication no. EP 2 164 277 A2 discloses an earphone device comprising an insertion earpad configured to be received inside a user's ear canal. The earpad is connected to a signal-to-sound converter of a sound source via a sound tube. External sound entrances are formed in the sound tube which allow environmental sounds to enter the ear canal in addition to the sounds transmitted from the sound source. An acoustic valve is arranged on an outer surface of the sound tube. The acoustic valve is a leaf valve element consisting of two conductive layers and an electroactive polymer layer. A form of the leaf valve can thus be altered by changing a polarity of a voltage at the conductive layers. The deformation of the leave valve can be exploited to change the leave valve in between a first deformation state, in which the external sound entrances are fully covered, and a second deformation state, in which the external sound entrances are uncovered. A first disadvantage of this earphone device is related to the repeated deformation of the acoustic valve that is required to open and close the external sound entrances. The deformation inevitably leads to material wear affecting the functionality of the acoustic valve, in particular in terms of a degradation of the opening and closing mechanism of the external sound entrances, such that an airtight closure of the external sound entrances can be compromised after continuous usage of the earphone device. In the worst case, such a material wear may even lead to a full disfunction or breakage of the acoustic valve. A second disadvantage of the earphone device is that the acoustic valve can only be used to switch in between an opened and closed state of the external sound entrances, wherein a variation of an opening size of the external sound entrances is not provided. A third disadvantage of the earphone device is that the geometry of the sound tube, including the selected size and position of the external sound entrances and the sound tube output opening, lead to a large acoustic mass and a high acoustic impedance rendering the external sound transmission path quite ineffective.

SUMMARY

It is an object of the present invention to remedy at least one of the above mentioned disadvantages and to provide the initially addressed device with a reliable adjustable venting of sound waves in between a sealed section of the ear canal and an ambient environment outside the sealed section. It is a further object to allow an easy and/or user friendly operability of a venting adjustment, in particular during usage of the device inside an ear canal, in particular by employing an electrically actuated control. It is another object to allow a more efficient venting in between a sealed section of the ear canal and an ambient environment, in particular by lowering an acoustic mass and/or an acoustic impedance in the device. It is yet another object to allow a variable adjustment of an amount by which a venting of sound waves in between a sealed section and an ambient environment is provided for.

At least one of these objects is achieved with a device comprising the features of patent claim 1. Advantageous embodiments of the invention are defined by the dependent claims.

Accordingly, the device according to the invention includes an acoustic valve comprising a valve member moveably coupled with a conduit housing, which moveable coupling is configured to provide a relative motion of the valve member and the conduit housing. The relative motion can comprise at least one of a translational motion of the valve member relative to the conduit housing and a rotational motion of the valve member relative to the conduit housing. In this way, the acoustic valve can be configured to provide at least one of the following: opening a vent opening, closing a vent opening, and adjusting a size of a vent opening. Such a relative motion between the valve member and the conduit housing can contribute to a fail-safe adjustment of the vent opening, wherein the involved constituent parts can be subjected to low mechanical stress. The communication device comprises an electrical actuator configured to activate the relative motion. The electrical actuation can provide an accurate control of the venting adjustment and can further contribute to an ease of use of the venting adjustment. This can permit a good longevity of the venting functionality of the device, in particular without any degradation after a prolonged usage.

The communication device comprises a sealing mechanism configured to acoustically seal a section of the ear canal, in particular upstream of the communication device. The sealed section may be located between the sealing mechanism and the user's ear drum. The sealing mechanism may comprise a contact member configured to contact an ear canal wall. The communication device comprises a sound conduit in acoustic communication with a sound source and configured to provide for transmission of sound waves from the sound source through the sound conduit and into the sealed section of the ear canal. The sound conduit may comprise a first opening configured to provide for entry of sound waves from the sound source into the sound conduit. The sound conduit may comprise a second opening configured to provide for output of sound waves from the sound conduit into the ear canal. The sound conduit may comprise a conduit housing provided between the first opening and the second opening. The vent opening can be provided in the conduit housing. The vent opening can be configured to provide for venting of sound waves through the vent opening, in particular into an ambient environment in the ear canal downstream of the sealing mechanism, in particular outside of the sealed section. The vent opening may lead to an inner surface of the conduit housing.

A venting pathway may be defined as an acoustic pathway in the sound conduit, which pathway sound waves must traverse in order to travel from the sealed section to the ambient environment outside of the sealed section. In some instances, the venting pathway comprises a passage in between the second opening of the sound conduit and the ambient environment of the ear canal. The sound conduit may comprise a sound conduit chamber configured to provide for travelling of sound waves from the first opening to the second opening of the sound conduit. In particular, the sound conduit chamber can be configured to provide for travelling of sound waves from the first opening to the second opening along a central axis of the sound conduit.

The conduit housing may comprise a side wall. The side wall may at least partially delimit a sound conduit chamber in a direction of a central axis of the sound conduit. The side wall of the conduit housing may comprise a directional component, along which the side wall extends, the directional component being oriented in parallel to a central axis of the sound conduit. The side wall of the conduit housing may comprise another directional component, along which the side wall extends, that may not be oriented in parallel to the central axis of the sound conduit. The side wall thus may not extend perpendicular to the central axis of the sound conduit such that the sound conduit chamber is delimited in the direction of the central axis, in particular such that an acoustic pathway in the sound conduit chamber along the central axis is defined. In some instances, the side wall extends in a traverse direction with respect to the central axis, at least over a portion of the side wall, in particular at a slope to the central axis. In some instances, the side wall substantially extends in parallel to the central axis, at least over a portion of the side wall. The vent opening may be formed in the side wall of the conduit housing. The sound conduit chamber may be configured to provide for travelling of sound waves from the first opening to the second opening along the central axis of the sound conduit. The vent opening may lead to the sound conduit chamber.

In some instances, an opening of the sound conduit chamber is provided by the vent opening, in particular supplementary to the first opening and the second opening. The vent opening may form at least part of a passage in between the sound conduit chamber and the ambient environment of the ear canal. The sound conduit chamber may provide at least part of the venting pathway between the sealed region and the ambient environment. The venting pathway may comprise a venting inlet providing an inlet for sound waves into the sound conduit. The venting pathway may comprise a venting outlet providing an outlet for sound waves from the sound conduit. The venting outlet may comprise the vent opening, at least in one relative position of the conduit housing and the valve member during said relative motion. The venting inlet may comprise the second opening of the sound conduit. In this way, at least a part of an acoustic pathway in between the first opening and the second opening can be advantageously used as a venting pathway. In particular, the sound conduit may be configured such that sound waves entering the second opening can leave the sound conduit through the venting outlet. In addition or alternatively, the sound conduit may be configured such that the sound waves entering the first opening can partially traverse the sound conduit to the second opening into the ear canal and can partially leave the sound conduit through the venting outlet. In particular, the venting pathway may comprise the second opening of the sound conduit and the vent opening, at least in one relative position of the conduit housing and the valve member during said relative motion. Such a venting pathway can contribute to a high efficiency of the acoustic venting, in particular by exploiting a rather low impedance and/or acoustic mass provided in between the first opening and the second opening of the sound conduit. In some instances, the venting pathway substantially consists of the second opening of the sound conduit, at least a part of the sound conduit chamber, and the vent opening, at least in one relative position of the conduit housing and the valve member during said relative motion.

The conduit housing may comprise a housing opening provided at an open end of the conduit housing. The housing opening may be configured to provide for an exit of sound waves from the conduit housing, in particular of at least part of the sound waves entering the sound conduit from the first opening and/or the sound waves travelling through the sound conduit chamber to the housing opening. The housing opening may be configured to provide for an exit of sound waves in the direction of a central axis of the sound conduit. The venting pathway may comprise the housing opening. In particular, the venting pathway may extend through at least part of the sound conduit chamber which is at least partially delimited by a side wall of the conduit housing. In this way, the efficiency of the acoustic venting can be further improved, in particular by using a low impedance and/or acoustic mass of the sound conduit chamber or part of the sound conduit chamber within the conduit housing for the section of the venting pathway provided therein. In some instances, the venting inlet is provided by the housing opening, in particular in instances in which the second opening of the sound conduit is provided by the housing opening. In some other instances, the venting inlet is provided by the second opening and the venting pathway further extends through the housing opening, in particular in instances in which the second opening of the sound conduit is not provided by the housing opening. In particular, the venting pathway may comprise at least one of the housing opening and the second opening, and the vent opening, at least in one relative position of the conduit housing and the valve member during said relative motion, wherein the venting pathway may extend through the housing opening. In some instances, the venting pathway comprises the second opening, at least a part of the sound conduit chamber at least partially delimited by a side wall of the conduit housing, and the vent opening, at least in one relative position of the conduit housing and the valve member during said relative motion.

In some instances, the housing opening is provided at the second opening of the sound conduit. In particular, the second opening of the sound conduit may be provided by the housing opening and/or by an open end member linked to the conduit housing. In particular, the open end member may be interconnected with the conduit housing and/or inserted inside the conduit housing. In some instances, the housing opening is provided in between the first opening and the second opening of the sound conduit, in particular in the direction of the central axis of the sound conduit. In particular, the valve member may be arranged such that the valve member extends beyond the housing opening toward the second opening, at least in one relative position of the conduit housing and the valve member during said relative motion. The second opening of the sound conduit may be provided at an open end of the valve member and/or by an open end member linked to the valve member, in particular interconnected with the valve member and/or inserted inside the valve member. Thus, the open end member linked to the conduit housing and/or the valve member may comprise at least part of the second opening of the sound conduit. The open end member may comprise an input opening, in particular at an opposed end of the open end member with respect to the second opening of the sound conduit. The input opening of the open end member may be configured to provide for entry of sound waves, in particular from at least one of the conduit housing and the valve member. For instance, a wax filter may be provided as an open end member, in particular in the conduit housing and/or valve member.

The conduit housing and/or the valve member may comprise a coupling surface at which the moveable coupling is provided. The relative motion can be directed along the coupling surface. In particular, the relative motion may be provided at least one of in parallel to the coupling surface, and in a peripheral direction of the coupling surface, in particular around the coupling surface. In this way, a guidance for said relative motion can be provided by the coupling surface such that a relative displacement in between the valve member and the conduit housing can be facilitated. In some instances, at least one of the conduit housing and the valve member comprises a coupling surface at which the moveable coupling is provided. In some instances, a corresponding coupling surface is provided at the other of the conduit housing and the valve member. In particular, the moveable coupling may be provided by linking, in particular contacting, the coupling surface of the conduit housing with the coupling surface of the valve member. Said relative motion can be directed along the coupling surface. The coupling surface may be provided with small frictional properties. Thus, said relative motion can be provided with an activation by a rather low activation force. In particular, the frictional properties of the coupling surface may be provided to be smaller than frictional properties of the sealing mechanism abutting on an ear canal wall during usage of the device. Thus, said relative motion can be configured to be provided by a lower activation force as compared to a force that would be required to displace the sealing mechanism inside the ear canal. Such a smooth movability on the coupling surface can on the one hand contribute to the reliability of the venting adjustment. On the other hand, the smooth movability on the coupling surface can be advantageously exploited to allow a motion of one of the conduit housing and the valve member, wherein the other of the conduit housing and the valve member can stay in a fixed position inside the ear canal. In this way, an advantageous activation of the venting adjustment during usage of the device inside an ear canal can be provided.

In some instances, the coupling surface is provided at a surface of a side wall of the conduit housing. In particular, the coupling surface may be provided on at least one of an inner surface and an outer surface of the conduit housing. The term inner surface may generally relate to a surface oriented towards a central axis of the sound conduit, in particular a surface facing the central axis of the sound conduit. The term outer surface may generally relate to a surface pointing in an opposed direction with respect to a central axis of the sound conduit, in particular a surface facing away from the central axis of the sound conduit. The valve member may be at least partially disposed at the coupling surface of the conduit housing. In some instances, the coupling surface is provided at a surface of a side wall of the valve member. In particular, the coupling surface may be provided on at least one of an inner surface and an outer surface of the valve member. The conduit housing may be at least partially disposed at the coupling surface of the valve member. Such a sideward arrangement of the coupling surface can be exploited to enable said relative motion in a reliable way, in particular such that an effective venting can be realized by exploiting an advantageous venting pathway in which a vent opening and/or a valve opening is facing an ear canal wall. In some instances, the valve member is disposed at least partially around the coupling surface of the conduit housing, in particular around an inner surface and/or an outer surface of the conduit housing. The valve member may comprise a substrate disposed on the conduit housing, in particular at least partially around the coupling surface of the conduit housing, in particular an inner and/or outer surface of the conduit housing.

A venting distance may be defined as a distance in the sound conduit in direction of the central axis of the sound conduit in between the second opening and a centre of the vent opening. A proximity of the vent opening to the second opening of the sound conduit may be provided by a small value of the venting distance. This can contribute to an increased efficiency of the venting of sound waves by providing a comparatively small value of the acoustic mass in the venting pathway, leading to a comparatively low acoustic impedance. In particular, the venting distance may correspond to not more than fifteen times of a diameter of the second opening and/or an inner diameter of a side wall of the conduit housing, in particular a side wall at least partially delimiting the sound conduit chamber. In some instances, the venting distance corresponds to not more than ten times of a diameter of the second opening and/or an inner diameter of a side wall of the conduit housing, in particular a side wall at least partially delimiting the sound conduit chamber. In some instances, the venting distance corresponds to not more than five times of a diameter of the second opening and/or an inner diameter of a side wall of the conduit housing, in particular a side wall at least partially delimiting the sound conduit chamber. In some instances, the venting distance corresponds to not more than 10 millimetres. In some instances, the venting distance corresponds to not more than 5 millimetres.

In some instances, the vent opening is provided within an axial length of the sealing mechanism. Such an arrangement can also contribute to an increased efficiency of the venting of sound waves, in particular by providing the sealing mechanism and the vent opening at a corresponding axial region, which may be done to provide said proximity of the vent opening to the second opening. The sealing mechanism may comprise a contact surface configured to contact an ear canal wall. The sealing mechanism, in particular the contact surface of the sealing mechanism, may be provided at the second opening and/or close the second opening.

In this way, a proximity of the vent opening to the second opening can be advantageously combined with such a provision of the sealing mechanism, in particular the contact surface of the sealing mechanism, close to the second opening with respect to the axial direction. The axial length of the sealing mechanism may be defined as a total length of the sealing mechanism, in particular the contact surface, in which the sealing mechanism, in particular the contact surface, extends in the direction of the central axis of the sound conduit. The sealing mechanism, in particular the contact surface, may be configured to be deformed inside an ear canal, such that its total length in parallel to central axis may vary when inserted in differently sized ear canals. In some instances, the axial length of sealing mechanism is defined as a total length of the contact surface of the sealing mechanism, in which the contact surface of the sealing mechanism extends in the direction of the central axis of the sound conduit, when the contact surface of the sealing mechanism is in an un-deformed state, in particular when the sealing mechanism may not be inserted into an ear canal and/or no other forces may be applied on the contact surface of the sealing mechanism.

The translational motion of the valve member may include or consist of a motion along a surface of the conduit housing. The translational motion of the conduit housing may include or consist of a motion along a surface of the valve member. The translational motion may include or consist of a longitudinal motion. The translational motion of at least one of the valve member and the conduit housing may include or consist of a motion in parallel to a central axis of the sound conduit. The rotational motion of the valve member may include or consist of a motion along a surface of the conduit housing. The rotational motion of the conduit housing may include or consist of a motion along a surface of the valve member. The rotational motion may include or consist of a circular motion. In particular, the rotational motion of at least one of the valve member and the conduit housing can include or consist of a motion around a central axis of the sound conduit.

The communication device may comprise a device housing configured to be at least partially inserted in the ear canal. The conduit housing may be integrated with the device housing. The conduit housing may be attached to the device housing. In some instances, the sound source is provided inside the device housing. The sound source may be enclosed in the conduit housing. Alternatively or additionally, the sound source may be enclosed in a sound source housing. The sound source housing may adjoin the conduit housing, in particular at an end of the conduit housing. The sound source housing may be integrated with the housing of the communication device. Thus, the conduit housing and/or the sound source housing may form an integral part of the communication device housing. In other instances, the sound source is provided externally from the communication device housing and may communicate sounds into the communication device housing via an acoustic pathway, in particular a sound tube.

In some instances, a microphone and/or an input circuitry is provided inside the housing of the communication device, in particular inside the conduit housing and/or the sound source housing and/or a separate housing.

The communication device may include a part that is disposed outside of the ear canal. For example, the communication device may comprise at least one of a sound source, a microphone, an antenna, and an external circuitry that are disposed at least partially outside the ear canal. The external components may be configured to communicate with the part of the communication device inside the ear canal. For example, the external components may use wired/wireless-communication to communicate with the in-ear portion and/or may communicate sounds via an acoustic pathway, such as a sound tube. In some embodiments, an external portion of the communication device may be positioned behind a user's ear. In particular, the communication device may comprise a receiver-in-canal hearing instrument. A wax filter may be provided in the sound conduit, in particular at the second opening of the sound conduit The sealing mechanism may comprise at least one of a portion of the communication device housing, a flexible member coupled with the communication device housing, a portion of the conduit housing, a flexible member coupled with the conduit housing, a portion of the valve member, and a flexible member coupled with the valve member. In this way, the sealing mechanism can be configured to be precisely fitted inside an ear canal, in particular such that it is firmly seated inside the ear canal. Thus, a comparatively large force may be required, in particular by a manual twisting and/or pulling, to remove the sealing mechanism from the ear canal after its insertion. This aspect may be exploited for an advantageous venting adjustment during usage of the device in an ear canal.

In some instances, the sealing mechanism is provided by the conduit housing and/or rigidly attached to the conduit housing. In some of these instances, the valve member is configured such that said relative motion comprises at least one of a translational motion of the valve member, and a rotational motion of the valve member. In some instances, the sealing mechanism is provided by the valve member and/or rigidly connected to the valve member. In some of these instances, the conduit housing is configured such that said relative motion comprises at least one of a translational motion of the conduit housing; and a rotational motion of the conduit housing. In some instances, the valve member is configured such that in use movement of the valve member in the ear canal provides for said relative motion of the valve member and the conduit housing. In some instances, the conduit housing is configured such that in use movement of the conduit housing in the ear canal provides for said relative motion of the valve member and the conduit housing. In some of these instances, the communication device is configured such that in use movement of the communication device in the ear canal provides for said relative motion of the valve member and the conduit housing. In particular, the conduit housing may be configured such that an in use movement of the communication device provides said translational and/or rotational motion of the conduit housing, in particular relative to the valve member and/or relative to the ear channel.

An electrical activation of said relative motion can be advantageous in order to facilitate a control of the valve member, in particular during an in use activation when the device is inserted in an ear canal. Accordingly, the device comprises an actuator, in particular an electrical actuator. The actuator may be configured to activate said relative motion, in particular in dependence of an electrical signal provided to the actuator. In some instances, the electrical activation of said relative motion may be in particular advantageous when the valve member is configured for said translational and/or rotational motion and/or when the valve member is located far inside the ear canal during an in use manipulation. In some of these instances, a manual handling of the valve member may only account for a relatively inaccurate venting adjustment and may also lead to an undesired displacement of the whole communication device with respect to the ear canal. By an electrical activation of the valve member, those negative side effects can be avoided. In some instances, a manual and/or electrical activation of said relative motion may be advantageous to operate the movement of the conduit housing, in particular during use inside an ear canal. An electrical actuation may offer the advantage of a more accurate control of the venting adjustment and/or an increased ease of use.

The electrical actuator may be configured to activate said relative motion, in particular in dependence of an electrical signal provided to the actuator. In some instances, the actuator is configured to move the valve member, in particular the acoustic valve. The actuator may comprise at least one of a coil assembly and a magnetic system. The actuator may be configured to provide a magnetic field, by which magnetic field a driving force for said relative motion is provided. In this way, an accurate activation of said relative motion can be provided, wherein a reliable functionality and/or a possibility of a convenient positioning of such a magnetic field may be exploited. The actuator may comprise a first driving part fixedly coupled to the conduit housing and a second driving part fixedly coupled to the valve member. The first driving part and the second driving part may be configured to interact via the magnetic field. At least one of the first driving part and second driving part may comprise a conductor configured to be supplied with a current. In some instances, the conductor is positioned in the magnetic field such said a Lorentz force can be generated in the conductor by said current. Said relative motion may thus be actuated by said Lorentz force. In some instances, the conductor is configured to generate at least part of said magnetic field. Said relative motion may thus be actuated by an interaction with said magnetic field. The conductor may be provided by a coil, in particular a solenoid.

At least one of the first driving part and the second driving part may comprise a magnetic member. The magnetic member may be configured to generate a magnetic field and/or comprise a magnetizable material and/or comprise a conductor configured to be supplied with a current such that a Lorentz force can be generated in the conductor. The magnetic member may be configured to provide at least part of said magnetic field providing a driving force for said relative motion and/or at least part of a magnetic field providing a retention force for a retention of the valve member and the conduit housing in a relative position, in particular before and/or after said relative motion. The magnetic member may be configured to generate a magnetic field. In addition or alternatively, the magnetic member may comprise a magnetizable material. The magnetizable material may be defined as a material capable of being magnetized when positioned in a magnetic field. In addition or alternatively, the magnetic member may comprise a conductor configured to be supplied with a current such that a Lorentz force can be generated in the conductor when positioned in a magnetic field. In some instances, the magnetic member of the second driving part is provided at an inner surface of the valve member. In some instances, the magnetic member of the second driving part is provided at an outer surface of the valve member. In some instances, the magnetic member of the first driving part is provided at an inner surface of a side wall of the conduit housing, in particular an inner side wall and/or an outer side wall of the conduit housing. In some instances, the magnetic member of the first driving part is provided at an outer surface of a side wall of the conduit housing, in particular an inner side wall and/or an outer side wall of the conduit housing. The inner surface may be directed toward a central axis of the sound conduit. The outer surface may be oriented in an opposing direction with respect to a central axis of the sound conduit. In some instances, each of the first driving part and second driving part comprises a magnetic member. In some instances, the magnetic member of at least one of the first driving part and second driving part comprises a conductor configured to be supplied with a current. Thus, the conductor can be configured to generate at least part of the magnetic field. The conductor may be provided by a coil, in particular a solenoid. The actuator may be configured to activate said relative motion by providing or changing a current through the conductor. In some instances, the magnetic member of at least one of the first driving part and second driving part comprises a permanent magnet.

In some instances, at least one of the first driving part and second driving part comprises a magnetic member comprising a magnetizable element. The magnetizable element may comprise a magnetizable material. The magnetizable element may be provided by a ferromagnetic element. The magnetic member may comprise the magnetizable element and a conductor configured to generate at least part of said magnetic field, in particular by a current flowing through the conductor. The conductor may be provided by a coil, in particular a solenoid. The magnetizable element may be provided in a range of the conductor, the range selected such that the magnetizable element is configured to be magnetized, in particular by magnetic induction, by a magnetic field provided by the conductor, in particular by a current flowing through the conductor. A magnetic range of the conductor may be defined as a range in which the conductor is capable to magnetize the magnetizable element, in particular by magnetic induction. The magnetizable element may thus be provided within the magnetic range of the conductor. In this way, at least part of said magnetic field may be provided by the magnetizable element. The magnetizable element may be thus configured to generate at least part of said magnetic field independent from the conductor, in particular after a deactivation of a part of the magnetic field provided by the conductor. The magnetizable element may be configured to store at least part of said magnetic field, in particular produced by the conductor in the magnetizable element by magnetic induction from the conductor. The actuator may be configured to deactivate at least part of the magnetic field provided by the conductor, in particular by reducing or disabling a current flowing through the conductor. The magnetizable element may be configured to continue to provide at least part of said magnetic field after said deactivation of at least part of the magnetic field provided by the conductor. Thus, said relative motion and/or a retention of a relative position of the valve member and the conduit housing before and/or after said relative motion may be provided by the magnetic field provided from the magnetizable element, in particular after magnetic induction from the conductor. This can be exploited to minimize the energy consumption of the conductor, which may only be supplied with a current during a limited time interval, such that a desired amount of said magnetic field can be provided by magnetic field induced into the magnetizable element by the conductor.

The magnetic member may comprise a magnetic pole, wherein flux lines of a magnetic field emanate from the magnetic pole. In particular, the magnetic pole may be provided at a pole surface of the magnetic member, such that flux lines of the magnetic field emanate at the pole surface. In some instances, the pole surface is provided by an end surface of a permanent magnet. In some instances, the pole surface is provided by a virtual surface located at an end of a coil. In some instances, the pole surface is provided by a virtual surface at an end of a coil. In some instances, the pole surface is provided by an end surface of a solenoid comprising a conductor coiled around a central axis, in particular by a virtual end surface of the solenoid and/or by an end surface of a core formed of a magnetizable material of the solenoid. The magnetizable core of the solenoid may extend in the direction of the central axis around which the conductor is coiled.

In some instances, the magnetic member of at least one of the first driving part and second driving part comprises a magnetic pole comprising a pole surface configured such that flux lines of said magnetic field can emanate on the pole surface. The magnetic member of the other of said first driving part and second driving part may be provided in a space permeated by said flux lines of said magnetic field. In some instances, the pole surface comprises a curvature around a central axis of the sound conduit. In particular, a rotational motion of the valve member relative to the conduit housing may thus be provided, more particularly around the central axis of the sound conduit. The pole surface may be provided by at least one of an inner and outer surface of the magnetic member. The curvature may be provided in a direction of a circumference of a side wall of the conduit housing. In particular, the magnetic member may extend in a peripheral direction of a side wall of the conduit housing. The curvature may be circular. The magnetic member may be cylindrical. In some instances, the pole surface points in a direction at which the second opening of the sound conduit is provided. In particular, a translational motion of the valve member relative to the conduit housing may thus be provided, more particularly in a direction pointing toward and/or away from the second opening. The direction in which the pole surface points may comprise a directional component of a direction in which a central axis of the sound conduit extends.

In some instances, at least one of the first driving part and second driving part comprises two of said magnetic members. The magnetic members may comprise a magnetic pole, in particular a pole surface, configured such that such that flux lines of said magnetic field can permeate a space in between the magnetic poles, in particular pole surfaces, of the magnetic members. The magnetic member of the other of said first driving part and second driving part may be provided in a space permeated by said flux lines of the magnetic field. In some instances, the magnetic poles, in particular pole surfaces, are pointing in opposite directions, wherein the flux lines are provided such that they permeate a space surrounding the magnetic poles. In some instances, the magnetic poles, in particular pole surfaces, are facing each other, wherein the flux lines are provided such that they permeate a space in between the magnetic poles. In some instances, the magnetic members of at least one of the first driving part and second driving part are spaced from one another at a spacing distance. The magnetic members may be configured to provide for the magnetic interaction with the other of said first driving part and second driving part within the spacing distance. The magnetic member of the other of said first driving part and second driving part may be provided within the spacing distance, in particular such that said relative motion can be provided within the spacing distance.

In some instances, said relative motion comprises a direction of motion pointing in parallel to the spacing distance. In particular, a translational motion of the valve member relative to the conduit housing may be thus provided. In some instances, said relative motion comprises a direction of motion along a pole surface of at least one of the magnetic members spaced from one another at a spacing distance, in particular along a curvature of the pole surface. In particular, a rotational motion of the valve member relative to the conduit housing may be thus provided. In some instances, the magnetic members are arranged such that the spacing distance extends in parallel to a side wall of the conduit housing. In particular, a translational motion of the valve member relative to the conduit housing may thus be provided, more particularly in a direction in which the side wall of the conduit housing extends. The magnetic members may be arranged such that the spacing distance comprises a directional component in the direction of a central axis of the sound conduit. In some instances, the magnetic members are arranged such that the spacing distance extends across a diameter of a side wall of the conduit housing. In particular, a rotational motion of the valve member relative to the conduit housing may thus be provided, more particularly in a direction of a circumference of the side wall. The magnetic members may be arranged such that the spacing distance comprises a directional component perpendicular to a central axis of the sound conduit.

In some instances, at least one of the magnetic members spaced from one another at the spacing distance comprises a conductor, in particular a coil, configured to be supplied with a current, such that the conductor is configured to provide at least part of said magnetic field, in particular by a current flowing through the conductor. In this way, at least part of the magnetic field within the spacing distance may be provided. The actuator may be configured to activate said relative motion by providing or changing a current through the conductor, in particular coil, provided in at least one of the magnetic members of the first driving part and second driving part. In particular, the actuator may be configured to selectively activate a direction of said relative motion by at least one of: providing or increasing a current flowing through one of the conductors of said two magnetic members spaced from one another at the spacing distance; disabling or reducing a current flowing through one of the conductors of the magnetic members spaced from one another at the spacing distance; and changing a direction of the current flowing through at least one of the conductors.

In particular, both of the magnetic members spaced from one another at the spacing distance may comprise such a conductor. At least one of the magnetic members spaced from one another at the spacing distance may comprise a magnetizable element in a magnetic range of the conductor of this magnetic member. In particular, each of the magnetic members spaced from one another at the spacing distance may comprise an associated magnetizable element in a magnetic range of the conductor of the respective magnetic member. The magnetic member of the other of the first driving part and second driving part provided within the spacing distance may comprise a permanent magnet configured to interact with the magnetic field provided within the spacing distance. In this way, an energy consumption of the magnetic member provided within the spacing distance can be avoided. Alternatively or additionally, the magnetic member provided within the spacing distance may be also provided with such a conductor. In some instances, at least one of the magnetic members, in particular both magnetic members, spaced from one another at the spacing distance comprises a permanent magnet configured to generate at least part of said magnetic field, in order to provide at least part of the magnetic field within the spacing distance. Thus, an energy consumption of the magnetic members spaced from one another at the spacing distance can be avoided. The magnetic member of the other of the first driving part and second driving part provided within the spacing distance may comprise a conductor, in particular a coil, configured to be supplied with a current, such that the conductor is configured to generate at least part of said magnetic field, in particular by a current flowing through the conductor. The magnetic member provided within the spacing distance can thus be configured to interact with the magnetic field provided within the spacing distance. The magnetic member provided within the spacing distance may comprise a magnetizable element in a magnetic range of the conductor of the magnetic member provided within the spacing distance.

In some instances, at least one of the magnetic members is configured such that a retention force is provided by said magnetic field. The retention force can be employed such that the valve member and the conduit housing can be retained in a stable position, in particular static position, at a respective end position of said relative motion of the valve member and the conduit housing. Such a stable position may be defined as a relative position in which the valve member and the conduit housing are retained such that the valve member and the conduit housing remain in this position during environmental forces acting on the communication device. The environmental forces may comprise vibrational forces, gravitational forces and/or acceleration forces. Such environmental forces may occur during everyday use of the device by a user, for instance when the user moves fast or drops the device. Thus, a stability for the relative position of the valve member and the conduit housing after said relative motion can be provided, in particular at the respective end position of said relative motion of the valve member and the conduit housing. In particular, a bi-stability in between two different end positions of said relative motion may thus be provided. The end positions of said relative motion may comprise at least one relative position of the valve member and the conduit housing in which the vent opening is at least partially open. The end positions of said relative motion may comprise at least one relative position of the valve member and the conduit housing in which the vent opening is at least partially closed. Thus, a bi-stability in between an alignment position of the vent opening, in particular an open position of the vent opening, and a closed position of the vent opening can be provided. This can increase the reliability and/or safety of the valve adjustment, in particular during every day usage.

The retention force may be at least partially provided from a magnetizable element of the magnetic member, in particular when the current supply of a conductor of the magnetic member is reduced and/or turned off. The magnetizable element may be arranged within a magnetic range of the respective conductor, such that the magnetizable element is configured to be magnetized by a magnetic field generated by the conductor at least when the current supply of the conductor is not reduced and/or turned off, in particular during said relative motion. For instance, the current supply of the conductor of the magnetic member may be reduced and/or turned off after said relative motion, in particular when the valve member and the conduit housing have arrived at a relative end position. Thus, an energy consumption of the device can be reduced. The conductor of the magnetic member may substantially only be supplied with a current during an activation time period in order to actuate said relative motion in between the end positions, in particular such that said magnetic field providing the driving force for said relative motion is at least partially provided by the conductor. After the activation time period, a decrease of the current supply of the conductor may lead to a predominant part of said magnetic field provided by the magnetizable element, in particular such that said magnetic field for said retention force after said relative motion is at least predominantly provided by the magnetizable element.

In some embodiments, the magnetic members spaced from one another at the spacing distance each comprise a conductor configured to be supplied with a current and a magnetizable element within the range of the respective conductor. The retention force may at least partially be provided at each end of the spacing distance from the magnetizable element of the magnetic member at the respective end of the spacing distance, in particular when said current supply of the conductor is reduced and/or turned off. In this way, a bi-stability for said relative motion in between the end positions at each respective end of the spacing distance may be provided. The magnetic members spaced from one another at a spacing distance of at least one of the first driving part and second driving part may thus be configured such that a retention force is provided by said magnetic field at each end of the spacing distance. By the retention force the magnetic member of the other of the first driving part and second driving part provided within the spacing distance can be retained in a stable position at a respective end position of said relative motion.

At least one of the first driving part and second driving part may be provided in the sound conduit, in particular in the conduit housing. In some instances, at least one magnetic member of at least one of the first driving part and second driving part is provided at a larger axial distance from the second opening than an axial distance of the vent opening from the second opening. In particular, at least one of the first driving part and second driving part may be provided at a larger axial distance from the second opening than an axial distance of the vent opening from the second opening. The axial distance may be defined as a distance in the direction of a central axis of the sound conduit. In this way, the actuator may be provided in such a way that a venting pathway through the vent opening can be effectively traversed by the sound waves, in particular such that an obstruction of the traversing sound waves by the actuator can be minimized. At least one of the first driving part and second driving part may be provided at a radial distance from a central axis from the sound conduit. At least one of the first driving part and second driving part may be provided in an actuator housing. The actuator housing may be provided inside the sound conduit, in particular inside the conduit housing. In some instances, the conduit housing comprises an outer side wall and an inner side wall, the outer side wall having a larger distance from a central axis of the sound conduit than the inner side wall. The actuator housing may comprise at least one of a portion of the outer side wall and a portion of the inner side wall. At least one magnetic member of at least one of the first driving part and second driving part may be provided in between the outer side wall and the inner side wall. In particular, at least one of the first driving part and second driving part may be provided in between the outer side wall and the inner side wall. The actuator housing may be provided at a first end of the sound conduit, the first end being opposed to a second end of the sound conduit at which the second opening is provided. The actuator housing may be provided at a larger axial distance from the second opening than an axial distance of the vent opening from the second opening.

In some instances, the valve member is configured such that said relative motion adjusts the vent opening between an alignment position and a closed position. The alignment position may defined as a relative position during said relative movement, in which relative position the valve member is positioned, in particular on the coupling surface of the conduit housing, such that the vent opening is at least partially open. The closed position may be defined as a relative position during said relative movement, in which relative position the valve member is positioned, in particular on the coupling surface of the conduit housing, such that the vent opening is closed. In some instances, the valve member includes a valve opening. The alignment position may defined as a relative position during said relative movement, in which relative position the vent opening and the valve opening are aligned such that the vent opening is at least partially open. The closed position may be defined as a relative position during said relative movement, in which relative position the vent opening and the valve opening are unaligned such that the vent opening is closed.

In some instances, the valve member is configured such that said relative motion variably adjusts the vent opening between the alignment position and the closed position. In particular, the variable adjustment may be provided such that the valve member is configured to move to at least two distinct alignment positions as an end position of said relative motion, wherein different opening sizes of the at least partially opened vent opening are provided in each of the distinct alignment positions. Such a variable adjustment can advantageously account for a selective adjustment of an amount at which the venting of sound waves shall be provided, in particular according to momentary demands of the user. In particular, the variable adjustment may be provided such that the valve member is configured to continuously move in between different alignment positions during said relative motion, wherein different opening sizes of the at least partially opened vent opening are provided in each of the alignment positions. Such a continuous adjustment can advantageously provide for a fading effect during the venting adjustment, by which fading effect the transition between a start position and end position of said relative motion may be perceived in gradual phases, in particular such that the acoustical perception of a user during the transition is more pleasant as compared to an abrupt transition in between the start position and end position of said relative motion.

Said relative motion may comprise a displacement of the complete conduit housing relative to the complete valve member. In some configurations, the relative motion comprises a displacement of at least part of the conduit housing relative to the complete valve member. In some configurations, the relative motion comprises a displacement of the complete conduit housing relative to at least part of the valve member. In some configurations, the relative motion comprises a displacement of the complete conduit housing relative to the complete valve member. The latter configurations can offer the advantage of an optimized energy usage, when the involved parts are completely displaced with respect to one another, in particular such that no other device parts are relatively displaced and additional frictional effects at a remote position can thus be avoided. The valve member may be configured to be preserved in a substantially un-deformed shape during said relative motion. The conduit housing may also be configured to be preserved in a substantially un-deformed shape during said relative motion. In this way, a material wear of the components can be minimized contributing to a longevity and reliability of the venting mechanism. The translational motion of the valve member may comprise a motion with respect to the conduit housing and/or the translational motion of the conduit housing may comprise a motion with respect to the valve member and/or the rotational motion of the valve member may comprise a motion with respect to the conduit housing and/or the rotational motion of the conduit housing may comprise a motion with respect to the valve member.

In some instances, the conduit housing comprises a portion defining at least a part of the sound conduit chamber configured to provide for travelling of sound waves through the sound conduit from the first opening to the second opening. To this end, the conduit housing may comprise a conduit wall, in particular a side wall. The conduit wall may at least partially delimit the sound conduit chamber, in particular in a direction of at least a portion of a pathway of the sound waves propagating through the conduit chamber, in particular in between the first opening and the second opening of the sound conduit. A central axis of the sound conduit may be defined such that the central axis extends through a centre of the sound conduit chamber, in particular in parallel to a propagation direction of the sound waves in the sound conduit chamber. The sound conduit chamber may comprise a portion with a tubular shape, in particular a rotational symmetric shape around the central axis. For instance, the sound conduit chamber may comprise a portion with a cylindrical shape, wherein the central axis may be defined as a central axis of this cylindrical portion. In some instances, the central axis of the sound conduit substantially coincides with a central axis of the conduit housing.

A side wall of the conduit housing may separate, in particular delimit, an inner space of the conduit housing from the exterior of the conduit housing, in particular sound conduit. The side wall may thus separate an inner space of the conduit housing, in particular sound conduit, from a volume of the ear canal, in particular delimited by an ear canal wall, when the device is inserted in the ear canal. In some instances, at least part of the sound conduit chamber is delimited by the side wall such that the sound conduit chamber is provided by said inner space. The side wall may thus define a conduit wall. In particular, the side wall may comprise a substantially tubular component comprising the first opening the second opening and the vent opening. In this way, a sound conduit tube may be formed by the side wall. In some instances, the conduit housing comprises an outer side wall delimiting an inner space of the conduit housing from the exterior. The conduit housing may further comprise an inner side wall provided inside said inner space of the conduit housing. In some instances, at least part of the sound conduit chamber may be delimited by the inner side wall. The inner side wall may thus define a conduit wall. In some instances, at least part of the sound conduit chamber may be delimited by the outer side wall. The outer side wall may thus define a conduit wall. In particular, the first opening of the sound conduit may be provided at a first end of the inner conduit wall and the second opening of the sound conduit may be provided at a second end of at least one of the inner conduit wall and the outer conduit wall. In particular, the side wall may comprise a substantially tubular component. The tubular component may comprise the first opening, the second opening, and the vent opening.

The conduit housing may comprise a side wall between the first opening and the second opening of the sound conduit. The vent opening may be formed in the side wall of the conduit housing. In some instances, the valve member is disposed at least partially around an outer surface of the side wall of the conduit housing, in particular such that said coupling surface is at least partially provided at the outer surface of the side wall. In some embodiments, the valve member is disposed at least partially around an inner surface of the side wall of the conduit housing, in particular such that said coupling surface is at least partially provided at the inner surface of the side wall. In some embodiments, the valve member is disposed at least partially around an inner surface and an outer surface of the side wall of the conduit housing, in particular such that said coupling surface is at least partially provided at the inner surface and at the outer surface of the side wall. In particular, the inner surface and the outer surface of the side wall may be facing each other, wherein the valve member may be disposed in between. In some instances, the valve member is disposed at a side wall of the conduit housing such that the valve member at least partially projects from an end of the side wall of the conduit housing. In particular, the valve member may project from an end of the side wall at which the second opening of the sound conduit is provided, at least in one relative position of said relative motion of the valve member and the sound conduit. In some instances, the valve member is disposed at a side wall of the conduit housing such that the valve member is arranged in between the first opening and the second opening of the sound conduit, at least in one relative position in said relative motion of the valve member and the sound conduit.

The first opening of the sound conduit may be provided at a sound source output configured to provide for exit of sound waves from the sound source. For instance, a sound tube and/or a sound wave generation means of the sound source may be provided at the first opening or in proximity to the first opening. The conduit housing may comprise an end wall. The first opening of the sound conduit may be formed in the end wall. A rear wall of the conduit housing may thus be formed by the end wall. In some instances, the vent opening comprises an opening in the end wall, in particular in the rear wall. In some instances, the first opening of the sound conduit is provided in the end wall of the conduit housing. In some instances, the first opening of the sound conduit is disposed between the end wall of the conduit housing and the second opening of the sound conduit. The sound source output may be provided at the end wall. The sound source output may extend into the conduit housing such that the first opening of the sound conduit is disposed between the end wall and the second opening of the sound conduit. The sound source output may comprise a sound source conduit provided at the end wall and/or extending into to conduit housing. The second opening of the sound conduit may be formed in the end wall. A front wall of the conduit housing may thus be formed by the end wall. In some instances, the vent opening comprises an opening in the end wall, in particular in the front wall. In some instances, the conduit housing comprises two end walls, wherein a rear wall and a front wall is formed by the end walls.

The valve member may comprise a first axial opening, in particular configured to provide for an entry of sound waves into a volume at which the valve member is provided, and a second axial opening, in particular configured to provide for an exit of sound waves from a volume at which the valve member is provided. The first axial opening and/or the second axial opening of the valve member may be oriented in the direction of a central axis of the sound conduit. The first axial opening may be provided at a first open end of the valve member. The second axial opening may be provided at a second open end of the valve member. The first axial opening and the second axial opening may be spaced from one another in the direction of a central axis of the sound conduit. The valve member may be configured to receive the conduit housing or to be received by the conduit housing, in particular at the first axial opening. In some instances, the second axial opening of the valve member is provided at the conduit housing, in particular at a housing opening or in front of a housing opening with respect to the direction of sound waves travelling along the central axis of the sound conduit. The second opening of the sound conduit may thus be defined by the housing opening and/or the second axial opening of the valve member. In some instances, the second axial opening of the valve member is provided at a distance from the conduit housing, in particular behind a housing opening with respect to the direction of sound waves travelling along the central axis of the sound conduit. The second opening of the sound conduit may then be defined by the second valve opening.

The valve member may comprise a side wall, in particular between the first axial opening and the second axial opening. At least a part of the side wall of the valve member may be configured to receive at least a part of the conduit housing or to be received by at least a part of the conduit housing. The valve member may comprise a side wall having at least one of an inner diameter substantially matching an outer diameter of the side wall of the sound conduit, and an outer diameter substantially matching an inner diameter of the side wall of the sound conduit. The term inner diameter may refer to a diameter in between opposing portions of an inner surface. The term outer diameter may refer to a diameter in between opposing portions of an outer surface. In some instances, the inner diameter and/or outer diameter extends through a central axis of the sound conduit. The valve opening may be formed in the side wall of the valve member. The valve member may comprise a vent chamber configured to provide for travelling of sound waves, in particular from the first axial opening to the second axial opening of the valve member. The vent chamber may be delimited by the side wall of the valve member.

At least one vent opening is provided in the conduit housing. In some instances, the vent opening is provided in the conduit housing such that the vent opening faces the central axis of the sound conduit. In some instances, the vent opening is provided in the conduit housing such that the vent opening is oriented in a transverse direction with respect to the central axis of the sound conduit, in particular in parallel to the central axis of the sound conduit. The valve member may be configured such that the valve member can be positioned at least one of in a different axial position with respect to the central axis and in a different circumferential position with respect to the central axis than the vent opening, in particular in a moving position of said relative motion in which the vent opening is at least partially opened. The valve member may comprise a valve surface configured to be relatively moved to the vent opening such that the vent opening is at least partially covered in at least one position of said relative motion by the valve surface. The valve surface may be larger than the vent opening. Further conceivable is a valve surface having the same size than the vent opening or smaller than the vent opening. In some instances, the valve member comprises a valve opening configured to be relatively moved to the vent opening such that the vent opening is at least partially uncovered in at least one position of said relative motion by the valve opening. The valve opening may have at least one of the same size, a larger size, and a smaller size as the vent opening. In some instances, a plurality of vent openings is provided in the conduit housing. The vent openings may be spaced from one another. The valve member may be configured such that the valve member can be positioned in between the vent openings, in particular in a moving position of said relative motion in which the vent openings are at least partially opened. The vent openings may be provided at the same axial position with respect to the central axis in the conduit housing. The vent openings may have a corresponding shape, in order to provide for homogeneous venting properties. Further conceivable are vent openings having a different shape. In some instances, the valve member comprises a plurality of valve openings. In particular, an equal number of valve openings and vent openings may be provided.

The conduit housing may comprise a stop to prevent at least one of the valve member and the conduit housing moving, in particular at an end position of said relative motion. The stop may be provided at a position of the conduit housing at which position an end position of the valve member for said relative motion is provided. In this way, a spatial restriction of said relative motion may be provided by the stop, in particular such that said relative motion may be restricted. In some embodiments, two stops are provided at a respective end position of said relative motion, in particular such that the relative motion may be restricted within two end positions. The stop may comprise a stopping member. The stop may be provided on the coupling surface and/or at an end of the coupling surface of at least one of the conduit housing and the valve member. The stop may be provided as a surface structure on the conduit housing. The stop may be provided as a projection on a surface of the conduit housing. Such a surface projection may comprise a wall, in particular an end wall, protruding from a surface of conduit housing. Such a surface projection may comprise an edge protruding from a surface of conduit housing. In some instances, the stop comprises a damping material. In particular, the surface projection may be coated by a damping material. The damping material can provide a damping of an impact of the valve member at the stop, in particular at the end of said relative motion, in particular at an end position of said relative motion. In this way, the relative motion can be stopped rather gently at the end position of said relative motion. By such a damping provided at the end position, a hard impact of the valve member with respect to the stop provided at the conduit housing can be effectively avoided. Thus, disturbing sound effects at the end of said relative motion which would be caused by such a hard impact can be effectively avoided. In some embodiments, the damping material comprises an elastomer, in particular an elastomeric rubber. For instance, the elastomer may comprise at least one of a silicone elastomer, a polyester elastomer, a fluoroelastomer, a perfluoroelastomer, and a polyurethane elastomer.

The present disclosure further relates to a method for adjusting venting of a communication device configured for use in a communication device user's ear canal. The method may comprise the step of creating a seal between the communication device and an ear canal of a user of the communication device. The method may comprise the step of adjusting alignment of an opening in a sound conduit of the communication device and an opening in a vent valve to adjust venting of acoustic signals through the sound conduit. The communication device may comprise a housing and a sound conduit configured to deliver sound from a sound source disposed in the housing into the ear canal. The communication device may comprise a seal mechanism to seal the communication device with the ear canal. The method may comprise the step of using an acoustic valve to adjust an opening size of a vent opening in the sound conduit and/or to close the vent opening, wherein the vent opening provides for venting of sound waves into or out of the sound conduit. The seal mechanism may be configured to produce an acoustically sealed portion of the ear canal between the communication device and a user's eardrum. The venting of sound waves from the sound conduit may comprise venting sound waves from the sealed portion of the ear canal through the sound conduit to a location in the ear canal downstream of the communication device.

The acoustic valve may be moveably coupled with the sound conduit. The acoustic valve may comprise a valve opening. The step of using an acoustic valve to adjust the opening size of the vent opening may comprise adjusting alignment of the vent opening and the valve opening to adjust the opening between a closed position where the vent opening and the valve opening are completely misaligned and the acoustic valve closes the vent opening and an open position where the vent opening and the valve opening are completely aligned and transmission of sound waves through the vent opening is unimpeded by the acoustic valve. The step of adjusting the opening size of the vent opening in the sound conduit and/or to close the vent opening may comprise moving the housing with respect to the acoustic valve. The step of moving the housing with respect to the acoustic valve may comprise rotating the housing in the user's ear. The step of moving the housing with respect to the acoustic valve may comprise pushing a button on the housing while the communication device is in the user's ear.

In some embodiments, a method of using an insertable in-ear speaker or hearing device is provided, where the method may be controlled by a process or the like. In the method, audio signals may be converted by a receiver into sound waves and delivered into an ear canal of the wearer by the hearing device, while the hearing device sealing the ear canal to prevent interference of ambient sound with the converted sound waves. In the method, a vent, formed through a sound conduit, acoustically connecting the ear canal and the ambient environment hearing device may be adjusted. For purposes of this disclosure, a conduit, for acoustic transmission, may comprise a volume, or a sequence of volumes and tubes or the like. The adjustment may either allow sound to be vented from the ear canal through the hearing device to an ambient environment and/or to restrict/prevent such transmission of sound. The adjustment may be controlled by an active valve. When the valve is open, ambient sounds may enter the ear canal hearing device so that both sound generated by the hearing device and ambient sound can be heard by the wearer (providing the user with a more natural hearing experience) and/or the occlusion effect may be reduced, as sound generated in the ear canal is transmitted to the ambient environment. When the valve is closed, the wearer may be enabled to listen to the sounds generated by the receiver without interference from ambient sounds. In instances where the hearing device includes signal processing to provide the wearer with improved directionality (e.g. beamforming, where the hearing device obtains input from more than one microphone), the benefit of such signal processing and thus hearing performance may be improved due to the absence of direct sound.

In some embodiments, a hearing device configured for use in a user's ear canal is provided. The hearing device may be capable of providing variable venting through the hearing device. The hearing device may include a receiver that generates sounds that are communicated via a sound conduit to a user's eardrum. The hearing device may be configured to form a seal with an ear canal wall and/or to block the ear canal. In this way, a sealed region of the ear canal can be produced upstream of the hearing device, in particular medial to the hearing device. In this sealed region, an output of the receiver may be isolated from ambient sounds generated outside of the ear. The hearing device may include a part that is disposed outside of the ear canal. For example, the hearing device may comprise a receiver, microphone, antenna and/or the like that are disposed at least partially outside of the ear canal. This external circuitry may communicate with the part of the hearing device inside the ear canal. For example, the external circuitry may use wired/wireless-communication to communicate with the in-ear portion and/or may communicate sounds via an acoustic pathway, such as a sound tube.

In some embodiments, the external portion of the hearing device may be positioned behind the user's ear. In accordance with some embodiments, the sound conduit includes a vent opening that may provide for venting of sound waves through the hearing device. For example, ambient sounds may pass through the vent opening into the sealed region and/or sound waves in the sealed region may pass through the vent opening to a section of the ear canal disposed downstream of the hearing device, in particular distal to the hearing device. This may prevent or minimize the occlusion effect. In embodiments of the present disclosure, an acoustic valve is configured to provide for at least one of adjusting a size of the vent opening, closing the vent opening and/or not interfering with the vent opening, such that the vent opening is completely open. In some embodiments, the acoustic valve is moveably coupled with the sound conduit, such that the acoustic valve and/or the sound conduit is capable of movement with respect to the other. In some embodiments, the acoustic valve comprises a valve opening and adjustment of the vent opening is provided by moving the acoustic valve and/or the sound conduit so that the valve opening and the vent opening are aligned and/or misaligned. In some embodiments, the acoustic valve/sound conduit may be moved while the hearing device is in the ear canal. For example, a user may: rotate the hearing device, move the hearing device in a longitudinal direction along the ear canal, push a button to cause the acoustic valve and/or sound conduit to move with respect to one another and/or the like. Where the hearing device is moved in the ear canal, friction may be used to hold the acoustic valve stationary in the ear canal while the sound conduit is moved.

Venting through the hearing device may also be desirable as it can be used to manage the humidity in the sealed region. Humidity, in the sealed region may result in changed properties of the eardrum and/or the ear canal wall. These changes in property may result in a deteriorated hearing experience for the user of the hearing device. As such, in some embodiments of the present disclosure, a hearing device with variable venting is provided to provide for decreasing the humidity in the sealed region formed by the hearing device. In some embodiments, the hearing device may be adjusted in the user's ear to reduce the humidity. The venting arrangement of some embodiments of the present invention, comprising a short and large volume venting pathway, are configured to provide for reducing the adverse hearing effects of humidity in the ear canal. In some instances, frictional properties of the acoustic valve and/or the sound conduit are selected to provide that the acoustic valve and the sound conduit may move with respect to one another so that the venting of the hearing device may be adjusted while the hearing device is deployed in the user's ear canal. For example, the acoustic valve and/or the sound conduit may be manufactured from and/or include a coating of a low friction material, such as Teflon, a low friction plastic and/or the like.

Communication devices include: earbuds; earphones; in-ear headphones; noise protection systems worn on/in the ear that include a speaker; hearing devices, such as hearing instruments, including behind-the-ear hearing aids, in-the-ear hearing aids etc.; and/or the like. Hearing devices comprise communication devices designed to be inserted at least partially into the ear canal. Hearing devices may be configured to form an acoustic seal with an ear wall and/or block the ear canal so that a portion of the ear canal between the seal and the eardrum is acoustically insulated from ambient sound to some extent, i.e., the seal between the hearing device and the ear canal prevents acoustic signals, such as ambient sound, passing into from a portion of the ear canal downstream of/lateral to the hearing device into the sealed portion of the ear canal. Isolation provided by hearing devices may be desirable because it can prevent interference of ambient sounds with the acoustic output of the hearing device. However, because ambient sound may be blocked from the eardrum, it may prevent a user of the hearing device from directly hearing external sounds, in particular ambient sounds. In addition, sealing/blocking of the ear canal may produce an effect called occlusion. Occlusion can be caused by body-conducted acoustic signals that are radiated into the sealed portion of the ear canal between the hearing device and the eardrum. Acoustic signals produced by talking, chewing and/or the like, which may normally be transmitted to the ambient environment by the vent, can lead to a significant sound level in the sealed ear canal portion. Compared to an open ear canal, the occlusion effect may boost low frequency sound pressure in the ear canal by 20 decibels (dB) or more.

With respect to hearing aids, use of an open/leaky hearing aid, where there is not a seal between the hearing aid and the ear canal, can have disadvantages such as: reduced speech intelligibility in noisy environments, reduced benefit of beamforming, susceptibility to feedback and the like. For all types of hearing devices, an open or leaky hearing device may produce insufficient acoustic output at low frequencies when sound is produced by the hearing device into the ear canal. Based on the above, hearing devices may include a vent that allows for transmission of acoustic signals between the ear canal upstream of the hearing device, in particular comprising a region outside of the ear canal, and the ear canal downstream of the hearing device, in particular comprising a region between the hearing device and the eardrum. The term upstream may also be referred to herein as "medial" and the term downstream may also be referred to herein as "lateral". The vent may be small to provide a balance between the effects of completely sealing the ear canal and leaving the ear canal open. In some hearing devices, an ear tip may be used to create the seal between the hearing device and the ear canal, wherein the vent may be provided in the ear tip.

In embodiments of the present disclosure, a hearing device is provided with an adjustable vent. The adjustable vent may be controlled by the user of the hearing device and/or processing circuitry to optimize performance of the hearing device in accordance with different situations. The adjustable vent may provide for control of the amount of direct and/or ambient sound entering the ear canal and/or may control frequency response of the hearing device at low frequencies. For hearing aids, the vent may be adjusted to enhance a signal-to-noise ratio by partially closing the vent, in particular when the hearing aid is operated in a situation where ambient sound comprises a speech signal in background noise, such as when the user is conversing with people at a party, for instance in a restaurant. In addition, closing the adjustable vent may be desirable when listening to music with low-frequent signal content, in order to keep the size of the sound reproduction device and the power consumption to a minimum.

For purposes of the present disclosure, a "valve" may comprise a mechanism for at least one of closing, opening, and adjusting the size of an opening. The valve may be actuated manually and/or by a system including an actuator, in particular a motor and/or a micro-electromechanical system (MEMS) actuator and/or an electro-dynamic actuator having a coil assembly and a magnetic system, such as a balanced armature (BA) system and/or a pneumatic actuator and/or a hydraulic actuator. The actuator may be assisted by an elastic member, such as a spring or the like. The vent may provide an acoustic pathway and/or provide acoustic transmission, whereby sound waves can pass through the vent. In this way, a venting pathway may be provided. For example, the hearing device may be configured to create a seal with the ear canal wall to produce a sealed portion of the ear canal upstream of the hearing device between the hearing device and a user's eardrum. In such an arrangement, the vent may be configured to provide an acoustic pathway for sound waves, in particular between the sealed portion of the ear canal downstream of the hearing device and the unsealed portion of the ear canal upstream of the hearing device. As such, the vent may provide for transmission of sounds from the ambient environment, in particular outside of the ear and/or outside of an electronic device, through the hearing device to the eardrum and/or transmission of sound waves from the sealed region through the hearing device and out of the ear canal.

The seal between the hearing device and the ear canal may be provided by at least one of an ear tip, a dome, a flexible member, and a section of the hearing device. The seal may be simply provided by the hearing device blocking the ear canal to create the sealed portion/region. The term "upstream" is used to refer to a section of the ear canal located between the hearing device and the ear drum, and the term "downstream" is used to refer to a section of the ear canal between the hearing device and the concha, in particular the ear canal opening. Sealing the ear canal may prevent sounds from an ambient environment from passing down the ear canal to the ear drum. However, sealing the ear canal can also create an occlusion effect in the ear canal, whereby the hearing device user may perceive "hollow" or "booming" echo-like sounds. The occlusion effect can be caused by bone-conducted sound vibrations reverberating in a sealed region of the ear canal, so that speaking, chewing, body movement, heart beat and/or the like may create echoes, reverberations and/or the like in the sealed region. Compared to a completely open ear canal, the occlusion effect can boost low frequency sound pressure in the ear canal, which is usually below 500 Hz, by 20 dB or more.

The sealing of the ear canal by the hearing device may be beneficial for preventing interference by ambient sounds and by preventing a loss of low frequency sounds. However, sealing the ear canal may prevent the user from hearing ambient sounds, such as someone communicating with him, and the occlusion effect produced by the sealing may degrade the user's listening experience. A receiver, such as an in-ear speaker, can be included in electronic devices for providing sound to a user's ear. The receiver may be at least partially inserted into the ear canal. Thus, the receiver may direct sound onto the user's ear drum. A receiver may include acoustic drivers, microphones and/or other electronic devices and may be wired or wireless. In-ear speakers include, but are not limited to, earphones, earbuds, hearing aids, hearing instruments, in-ear headphones, in-ear monitors, personal sound amplifiers and headsets. In some embodiments, a receiver/loudspeaker generates sound waves based on signals that are input to the receiver from an external device through a wired or wireless connection.

In some embodiments, the hearing device comprises a sound conduit through which sound waves from the receiver may be transmitted into the ear canal upstream of the hearing device. The sound conduit may provide a chamber through which the sound waves can be transmitted. In some instances, the sound conduit may be tubular, in particular cylindrical. The sound conduit may comprise an input opening, through which sound waves from the receiver may enter the sound conduit chamber, and an output opening, through which sound waves from the sound conduit chamber may enter the ear canal. The openings may be formed in end-walls of the sound conduit. In some embodiments, the first opening may be formed in a housing. The housing may project inside the sound conduit chamber such that the opening is disposed between end walls of the sound conduit. In embodiments of the present disclosure, the sound conduit comprises at least one vent opening. The vent opening may be formed in a wall of the sound conduit extending between the openings of the sound conduit and/or in at least one of the end walls.

In embodiments of the present disclosure, an acoustic vent may provide for at least one of opening the vent opening, closing the vent opening, and adjusting an amount of opening or closing of the vent opening. The acoustic valve may be moveably coupled to the sound conduit, in particular such that relative motion of the sound conduit and the acoustic valve may provide for adjusting opening of the vent opening. For example, the acoustic valve may comprise a substrate. The substrate may comprise a valve opening. A motion of the sound conduit relative to the acoustic valve and/or a motion of the acoustic valve relative to the sound conduit may change an alignment between the valve opening and the vent opening. In this way, an alignment of the valve opening and the vent opening may be used to adjust an amount of opening of the vent opening between a completely open configuration and a completely closed configuration. The acoustic valve may comprise a substrate that at least partially surrounds the sound conduit, in particular an inner and/or outer surface of the sound conduit. The acoustic valve may thus be configured to undergo translation motion with respect to the sound conduit. In some embodiments, the acoustic valve may comprise a substrate that at least partially surrounds the sound conduit and may be configured to undergo a rotational motion and/or a translational motion relative to the sound conduit.

In some embodiments, a user of the hearing device may adjust a degree of opening of the vent opening by moving the acoustic valve on the ear canal. In some embodiments, a user of the hearing device may adjust a degree of opening of the vent opening by rotating the hearing device while it is in the ear canal, such that the sound conduit may rotate with respect to the acoustic valve. In other embodiments, the user may rotate the acoustic valve while the hearing device is in the user's ear canal. In some embodiments, a user may press a button or the like while the hearing device is in the ear and a mechanical and/or electrical system may cause the sound conduit and the acoustic valve to move relative to one another. For example, in a mechanical system, gears or the like may transmit a force applied to the button to a force applied to the acoustic valve. In this way, a motion of the acoustic valve with respect to the sound conduit may be produced.

BRIEF DESCRIPTION OF THE DRAWINGS

Reference will now be made in detail to embodiments, examples of which are illustrated in the accompanying drawings. In the drawings.

DETAILED DESCRIPTION OF THE DRAWINGS

In the following detailed description, numerous specific details are set forth in order to provide a thorough understanding of the subject matter herein. However, it will be apparent to one of ordinary skill in the art that the subject matter may be practiced without these specific details. In other instances, well known methods, procedures, components, and systems have not been described in detail so as not to unnecessarily obscure features of the embodiments. In the following description, it should be understood that features of one embodiment may be used in combination with features from another embodiment where the features of the different embodiment are not incompatible. The ensuing description provides some embodiment(s) of the invention, and is not intended to limit the scope, applicability or configuration of the invention or inventions. Various changes may be made in the function and arrangement of elements without departing from the scope of the invention as set forth herein. Some embodiments may be practiced without all the specific details. In other instances, well-known circuits, processes, algorithms, structures and techniques may be shown without unnecessary detail in order to avoid obscuring the embodiments.

Figure 1:
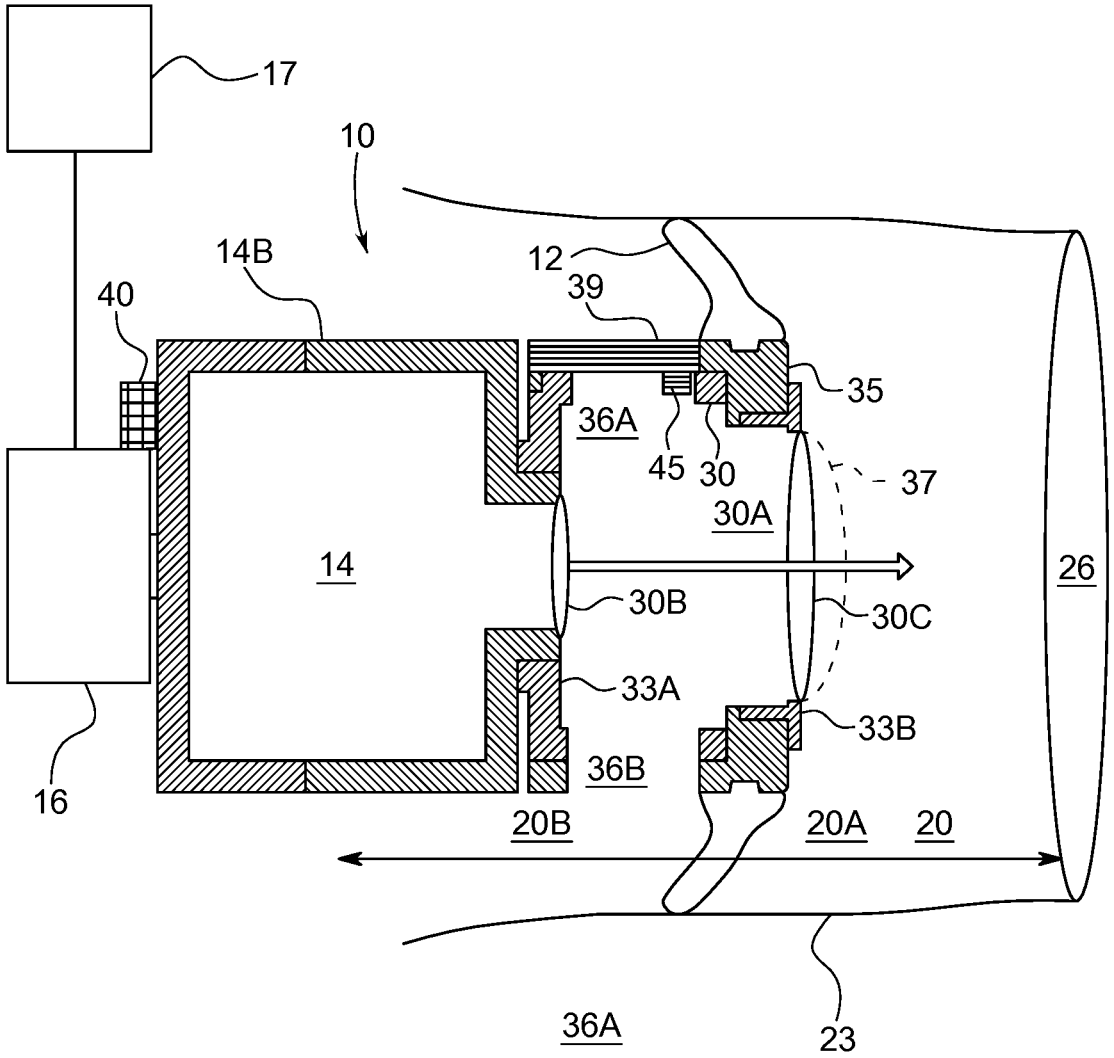
FIG. 1 illustrates a cross-sectional view of a hearing device with an adjustable vent, in accordance with some embodiments of the present disclosure.

FIG. 1 illustrates a cross-sectional view of a hearing device with an adjustable vent, in accordance with some embodiments of the present disclosure. As illustrated in FIG. 1, an hearing device 10 is inserted in an ear canal 20. The ear canal 20 comprises an ear canal wall 23 and extends from an ear opening of the ear (not shown) located downstream of the hearing device 10 to the eardrum 26 located upstream of the hearing device. The hearing device is configured to create a seal with the ear canal wall 23. In some embodiments, the seal may be formed by the hearing device blocking the ear canal 20. In some embodiments, the hearing device may comprise a flexible element 12 that contacts the ear canal wall 23 sealing the ear canal 20. The flexible member 12 may comprise an ear tip, a dome and/or the like. The flexible member 12 may be formed from a flexible material that conforms to the shape of the ear canal 20 when the hearing device is inserted in the ear canal 20, creating a seal between the hearing device 10 and the ear canal wall 23. By sealing the ear canal 20, the hearing device creates a sealed region 20A of the ear canal 20 between the hearing device 10 and the ear drum 26 and an ambient region 20B of the of the ear canal 20 between the hearing device and the opening of the ear (not shown).

In some embodiments, the hearing device 10 comprises a receiver 14. The receiver 14 may comprise a speaker, electrical device or the like configured to produce sound. In some embodiments, the receiver 14 is at least partially inserted into the ear canal and directs sound onto the ear drum 26. The receiver 14 may include acoustic drivers, microphones and other electronic devices. In some embodiments, the receiver 14 may be enclosed in a receiver housing 14B. In some embodiments, the hearing device may comprise input circuitry and the receiver 14 may be electrically connected to the input circuitry 16. The input circuitry 16 may comprise circuitry configured to receive an input signal that may be processed and/or electrically communicated to the receiver 14. The input signal may be a wireless communication, a Bluetooth communication, an electrical signal, a stream and/or the like. In some embodiments, the input circuitry 16 receives the input signal and communicates the input signal to the receiver 14, which converts the input signal into sound waves/an acoustic signal. In some embodiments, the receiver 14 may output the sound waves/acoustic signal using a membrane, a diaphragm and/or the like. In some embodiments, the input circuitry 16 is configured to be disposed outside of the ear canal 20 and may communicate with the receiver 14 by means of electrical wires or the like. In other embodiments, the input circuitry may be disposed at least partially in the ear canal 20. In some embodiments, the input circuitry 16 may comprise an antenna or the like for receiving the input signal. In such embodiments, the hearing device 10 may receive wireless input from devices external to the ear, such as mobile phones, wireless transmitters, wireless music players and/or the like. In some embodiments, the input circuitry 16 may be electronically attached to a device located outside of the ear. For example, in some embodiments, a microphone 17 may be disposed outside the ear and may receive sound signals and electronically communicate the sound signals to the input circuitry 16. In some embodiments, the input circuitry may comprise a processor or the like for processing the input signal and communicating the processed input signal to the receiver 14.

In some embodiments, the receiver 14 is in acoustic communication with a sound conduit 30. The sound conduit 30 comprises a housing defining a sound conduit chamber 30A, through which sound waves may be transmitted. The sound conduit 30 may comprise a first opening 30B through which sound waves generated by the receiver 14 can enter the sound conduit 30 and a second opening 30C through which the sound waves can pass out of the sound conduit 30 into the sealed region 20A. As such, the sound conduit 30 may provide for transmission of the sound waves from the receiver 14, through the sound conduit 30 to the ear drum 26. In some embodiments, the sound conduit 30 may extend from the first opening 30B to the second opening 30C. In some embodiments, the sound conduit 30 may comprise a first end-wall 33A and a second end wall 33B. In some instances, the first opening 30B may be formed in the first end-wall 33A. In some instances, the second opening 30C may be formed in the second end-wall 33B. In some embodiments, the sound conduit 30 may comprise a spout, a conduit and/or the like extending from the hearing device 10 and/or the receiver housing 14B. In some embodiments, the first opening 30B may be formed in a housing that projects into the sound conduit 30, such that the first opening 30B is disposed between the first end wall 33A and the second end wall 33B. In some embodiments, a wax filter 37 may cover the second opening 30C. The wax filter may prevent contaminants such as ear wax or the like from blocking the sound conduit 30. In some embodiments, the flexible member 12 may be coupled with the sound conduit 30. In some embodiments, the flexible member 12 may be coupled to a sealing mechanism 35. In some instances, the sealing mechanism may comprise a part of the hearing device 10. In some embodiments, the first end-wall 33A may be coupled with the receiver housing 14B. In some embodiments, the first end-wall 33A may be coupled with the receiver housing 14B, such that there is a gap between at least a section of the first end-wall 33A and the receiver housing 14B and/or at least a section of the first end-wall 33A extends beyond the receiver housing 14B such that the at least a section of the first end-wall 33A is in contact with the ear canal 20 volume, e.g. an atmosphere contained in the ear canal.

The sound conduit 30, in accordance with some embodiments of the present invention, includes a vent opening. As depicted in FIG. 1, the sound conduit 30 comprises two vent openings, a first vent opening 36A and a second vent opening 36B. The vent openings 36A and B, each comprise an opening in the sound conduit 30 and are configured to provide an acoustic pathway between the sealed region 20A and the ambient region 20B. This acoustic pathway may provide for venting of sound waves from the sealed region 20A to the ambient region 20B and/or the transmission of ambient sound waves from outside the ear from the ambient region 20B to the sealed region 20A. In some embodiments, the vent opening may be formed in the first end-wall 33A and/or the like. In some embodiments, an acoustic valve 39 is moveably coupled with the sound conduit 30. The acoustic valve 39 may comprise a substrate that is configured to close at least one of the vents 36A and 36B. The substrate may comprise a flap, a flexible material, a plug and/or the like. In some embodiments, the acoustic valve 30 may comprise a substrate that extends at least partially around the conduit housing 33 and/or the first end-wall 33A. In some instances, the acoustic valve 39 is moveably coupled with the sound conduit 30, such that the acoustic valve 39 and the sound conduit 30 may move relative to one another. In some embodiment, the moveable coupling provides for translational motion of the acoustic valve 39 with respect to the sound conduit 30 and/or translational motion of the sound conduit 30 with respect to the acoustic valve 39. This translational motion may in some instances comprise at least one of the acoustic valve and the sound conduit moving in a longitudinal direction with respect to the ear canal. In some embodiments, the moveable coupling provides for rotational motion of the acoustic valve 39 with respect to the sound conduit 30 and/or rotational motion of the sound conduit 30 with respect to the acoustic valve 39.

As depicted in FIG. 1, the acoustic valve 39 is completely closing the vent opening 36A and the vent opening 36B is not impinged by the acoustic valve 39 and is therefore completely open. In some embodiments, the acoustic valve 39 may comprise a substrate comprising a valve opening. In such embodiments, by moving the acoustic valve 39 relative to the sound conduit 30 and/or the sound conduit 30 relative to the acoustic valve 39, the vent opening can be positioned in various degrees of alignment with a one of the vent openings 36A and 36B. The degree of alignment may comprise: complete misalignment of the vent opening and the valve opening, whereby the vent opening is closed by the acoustic valve 39; partial alignment of the vent opening and the valve opening, whereby the vent opening is partially closed; and complete alignment between the vent opening and the valve opening, whereby the vent opening is completely open. In some embodiments, adjustment of the amount of venting provided by the vent opening and/or opening/closing of the vent opening is provided by removing the hearing device 10 from the user's ear and manually moving the acoustic valve 39 with respect to the sound conduit 30. In some embodiments, adjustment of the amount of venting provided by the vent opening and/or opening/closing of the vent opening is provided by the user rotating the sound conduit 30 in the user's ear, whereby the rotation of the sound conduit 30 adjusts alignment between the vent opening and the acoustic valve 39. In these embodiments, the sound conduit 30 may be rotated by the user rotating the receiver housing 14B or another part of the hearing device 10, which is coupled with the sound conduit 30. For example, the acoustic valve 39 may be configured to be held in position by friction with the ear canal while the hearing device 10 is rotated in the ear. In other examples, a stop or the like (not shown) may be activated to prevent movement of the acoustic valve 39 while the hearing device 10 is moved in the ear canal.

In some embodiments, adjustment of the amount of venting provided by the vent opening and/or opening/closing of the vent opening can be provided by a user pressing a switch 40 on the hearing device 10, while the hearing device 10 is at least partially disposed in the ear canal 20. For example, the switch 40 may be configured to translate an input force applied to the switch by the user to at least one of relative translational motion and relative rotational motion of the acoustic valve 39 and the sound conduit 30. In some embodiments, mechanical coupling of the switch 40 to the sound conduit 30 and/or the acoustic valve 39 may be made using gears, stops and/or the like. In some embodiments, the acoustic valve 39 may comprise a surface with frictional properties, such that frictional forces between the ear canal wall 23 and the acoustic valve 39 prevent/limit movement of the acoustic valve 39 when the sound conduit 30 undergoes motion in the ear canal 20. For example, the acoustic valve 39 valve may comprise a rough outer surface, grooves on the outer-surface and/or the like. In some embodiments, the sound conduit tube 30 may comprise a substantially tubular component comprising the first opening 30B the second opening 30C and one or more vent openings 36A and 36B.

When one or more of the vent openings 36A and 36B is at least partially opened, e.g. not blocked by the acoustic valve 39, sound waves generated by the receiver 14 may be separated into sound waves propagating to the eardrum 26 and sound waves leaking to the ambient region 20B though the at least partially vent opening. In such embodiments, the occlusion effect is mitigated and/or the user may be able to listen to ambient sounds passing from the ambient region 320B through the at least partially open vent opening and to the eardrum 26. When each of the vent openings 36A and 36B is completely closed, e.g. blocked by the acoustic valve 39, sound waves generated by the receiver 14 may propagating to the eardrum 26, but no sound waves can leak to the ambient region 20B and no sound waves can pass from the ambient region 20B to the eardrum 26. In such embodiments, the occlusion effect is not mitigated and/or the user is not able to listen to and/or is isolated from ambient sounds.

In some embodiments, the hearing device 10 may comprise an actuator 45 for moving the sound conduit 30 and/or the acoustic valve 39 relative to one another. The transducer may comprise a wireless receiver for receiving an input, a wired connection for receiving an input, an electric motor, an electric actuator, a hydraulic actuator, a micro-electro-mechanical system actuator, an electro-dynamic actuator having a coil assembly and a magnetic system and/or the like.

In accordance with some embodiments of the present disclosure, the venting system of the hearing device, comprising the sound conduit chamber 30A and the vent opening 36A and/or 36B providing the vent pathway through the hearing device, provides a low acoustic impedance. This low impedance may be provided by, among other things, using the sound conduit 30 as part of the venting pathway between the sealed region and ambient region of the ear canal. Use of the sound conduit 30 as part of the vent pathway, in accordance with some embodiments of the present invention, utilizes a conduit having a large internal volume and/or low acoustic impedance. In practice, hearing devices are small devices, in order to fit into the ear canal, and it may not be possible to include a separate/independent venting conduit with the low acoustic impedance provided by the sound conduit 30. However, in some embodiments, an independent vent conduit may be used that at least partially surrounds the sound conduit 30 or that has the same dimensions as the sound conduit 30 to provide a conduit with low acoustic impedance. In some embodiments of the present invention, the low impedance may be provided by, among other things, proximity of the vent opening 36A and/or 36B to the second opening 30C of the sound tube. This proximity reduces acoustic impedance for sound waves being vented through the hearing device 10. For example, in some embodiments, a distance between the may be of the order of less than 2 or 3 centimetres. In some embodiments, the distance between the vent opening 36A and/or 36B to the second opening 30C may be of the order of less than 1.5 centimetres, less than 1 centimetre, and less than 0.5 centimetres.

Figure 2:
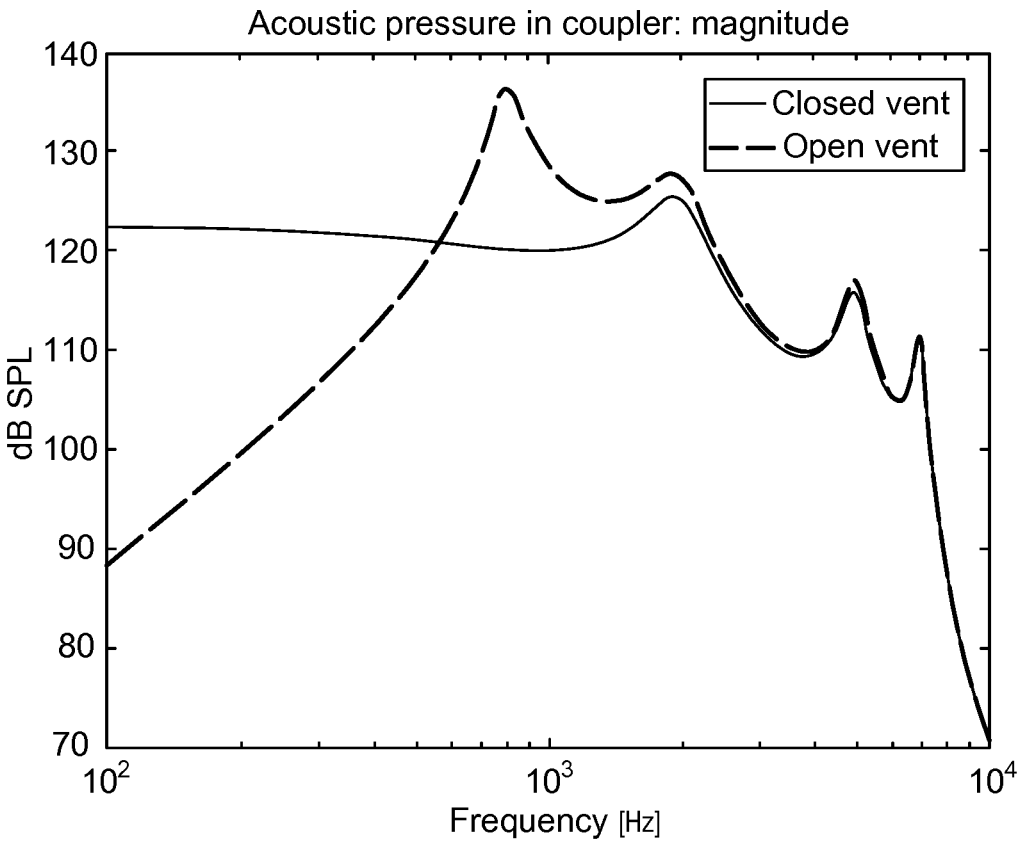
FIG. 2 illustrates a frequency response of a hearing device comprising an adjustable vent opening, in accordance with some embodiments of the present disclosure.

FIGS. 2A and 2B illustrates a frequency response of a hearing device comprising an adjustable vent opening, in accordance with some embodiments of the present disclosure. FIGS. 2A and 2B illustrate a frequency response of an hearing device comprising an adjustable vent opening, in accordance with some embodiments of the present disclosure, with closed and opened vent openings. The frequency response was measured using an ear simulator. FIG. 2A illustrates the magnitude of the frequencies with closed and open vent openings. FIG. 2B illustrates phase angle curves for the frequencies with closed and open vent openings. The measurements were made with an hearing device comprising an acoustic valve and a sound conduit each comprising 8 vent holes with a diameter of approximately 1 millimetres. The figures show that a 40 decibel (dB) vent loss at 100 Hz is reached by fully opening the vent openings. This large vent loss provided by the hearing device, in accordance with some embodiments of the present invention, provides that minimal and even no occlusion effect will be experienced a user. Such high vent loss and associated minimization of the occlusion effect is not possible with a high acoustic impedance vent pathway. The figures also establish, as shown by the flatness of the response curves at low frequencies, that there were no leaks in the hearing device and/or valve system, and that high low-frequent output can be generated by the hearing device.

Figure 3A:
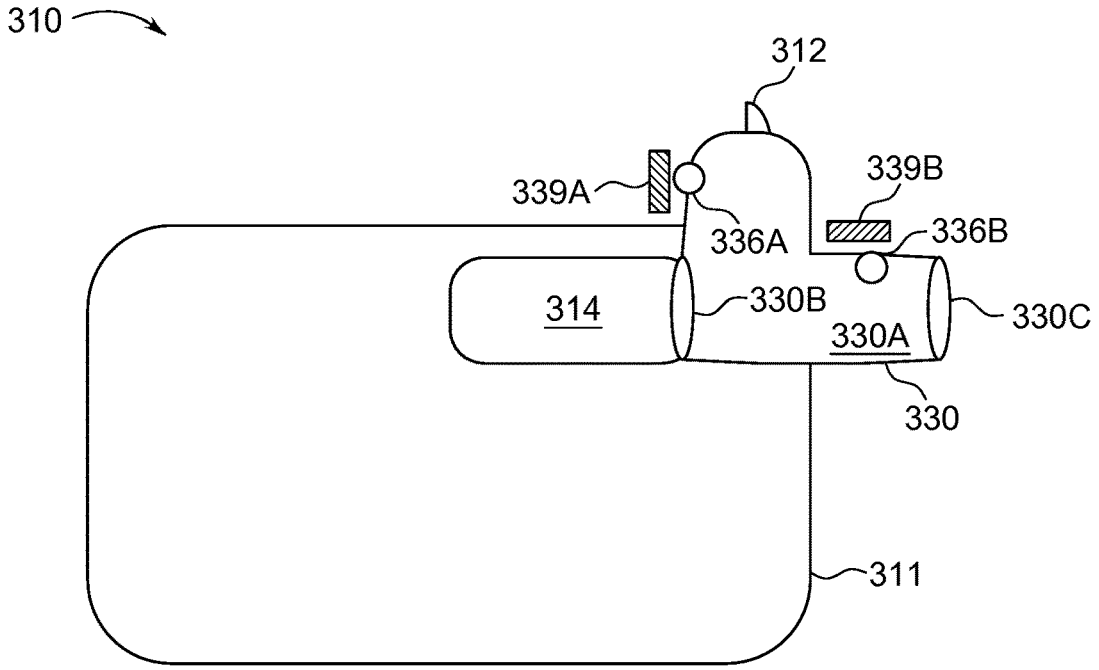
FIG. 3A illustrates a hearing device comprising a sound conduit with an adjustable vent opening, in accordance with some embodiments of the present disclosure.

FIG. 3A illustrates a hearing device comprising a sound conduit with an adjustable vent opening, in accordance with some embodiments of the present disclosure. In FIG. 3A, a sound conduit 330 is integrated with an hearing device housing 311 of an hearing device 310. The protrusion of the sound conduit 330 from the hearing device housing 311 may be referred to as a spout, a sound spout, a sound transmission tube and/or the like. The sound conduit 330 defines a sound conduit chamber 330A. The sound conduit 330 comprises a first end 330B and a second end 330C. A receiver 314 generates sound waves that pass through an acoustic pathway formed by the first end 330B, the sound conduit chamber 330A and the second end 330C. As such, the sound waves are communicated from the receiver 314 to an eardrum of a user of the hearing device. The hearing device housing 311 may be shaped to provide that the hearing device 310 blocks the user's ear canal when at least partially inserted the ear canal. In some embodiments, the hearing device 310 may comprise one or more flexible elements 312 to provide for sealing the hearing device to an ear canal wall. In some embodiments, the sound conduit 330 may comprise one or more vent openings 336A and 336B. In some embodiments, the vent opening may be formed in the hearing device housing 311. By positioning the vent openings 336A in a portion of the hearing device housing 311 that in use is essentially "facing away" from a user's ear drum, the hearing device housing 311 may provide protection to the vent opening 336A, among other things reducing contamination of the vent opening 336A. The vent openings 336A and B are associated with acoustic valves 339A and 339B, respectively, which are moveable coupled with the sound conduit 330.

Figure 3B:
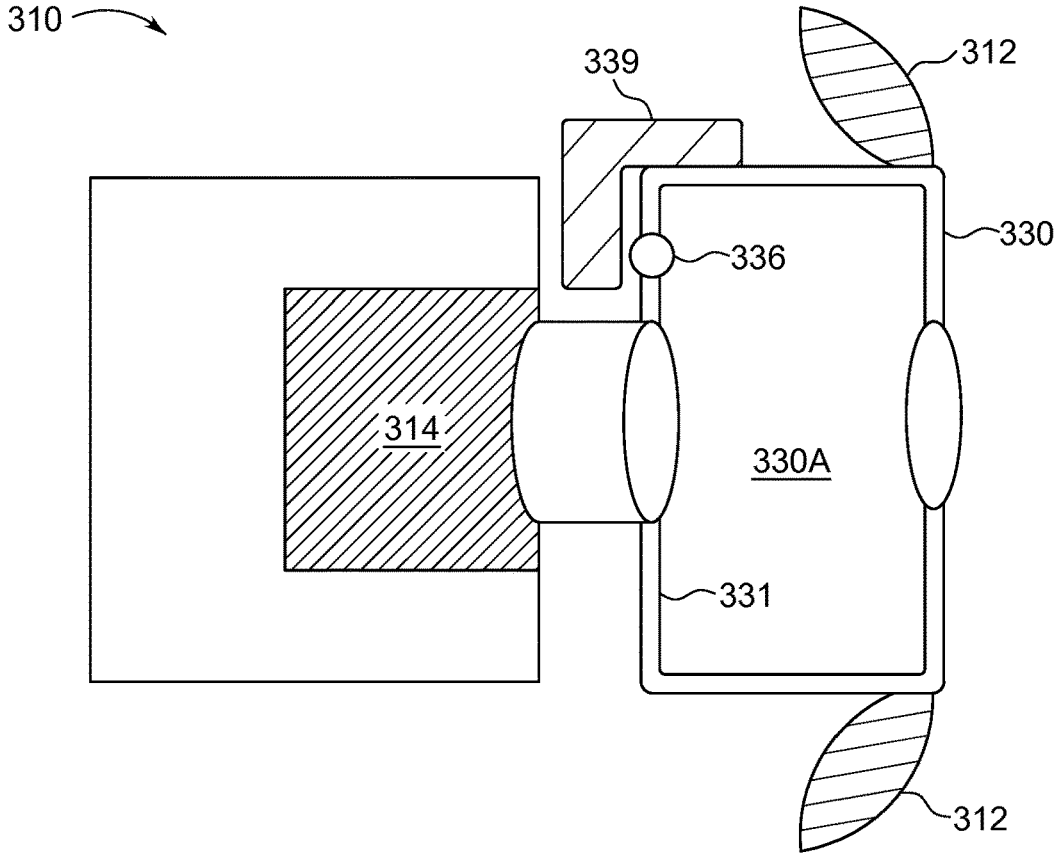
FIG. 3B illustrates a hearing device comprising an adjustable vent opening in an end-wall of a sound conduit, in accordance with some embodiments of the present disclosure.

FIG. 3B illustrates a hearing device comprising an adjustable vent opening in an end-wall of a sound conduit, in accordance with some embodiments of the present disclosure. In FIG. 3B, the hearing device 310 comprises the sound conduit 330. The sound conduit 330 comprises an end-wall 331. The first opening 330B is formed in the end-wall 331. The receiver 314 is configured to generate sound waves that pass through the first opening 330B into the sound conduit chamber 330A defined by the sound conduit 330. The sound waves travel through the sound conduit chamber 330A and out of the second opening 330C into a user's ear canal. In some embodiments, the hearing device 310 may block the ear canal to seal a region of the ear canal medial to the hearing device 310. In some embodiments, the flexible member(s) 312 may provide for sealing the hearing device 310 with the ear canal. In some embodiments, the vent opening 336 may provide for venting of sound waves thought the sound conduit from the sealed region to a region of the ear canal lateral to the hearing device 310. As depicted in FIG. 3B, the vent opening 336 may be formed in the end-wall 331. In other embodiments, the vent opening may be provided in other parts of the sound conduit 330. In some embodiments, the sound conduit 330 may comprise a plurality of vent openings. The acoustic valve 339 may provide for varying an opening of the vent opening 336. In some embodiments, the acoustic valve 339 may comprise a valve opening (not shown) and the alignment between the valve opening and the vent opening 336 may be adjusted to adjust the venting through the vent opening 336. The acoustic valve 339 may be moveably coupled with the sound conduit 330. In this way movement of the acoustic valve 339 on the sound conduit 330 may be used to adjust an amount of opening of the vent opening 336. The acoustic valve 339 may be capable of translational and/or rotational motion with respect to the sound conduit 330.

Figure 4A:
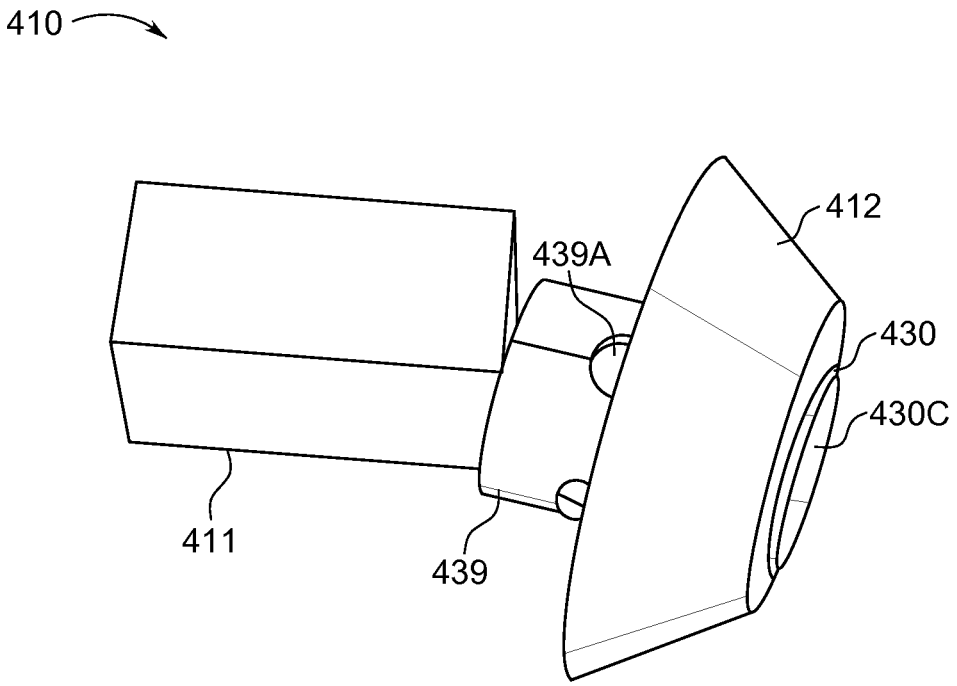
FIG. 4A illustrates a hearing device with variable venting, in accordance with some embodiments of the present disclosure.

FIG. 4A illustrates a hearing device with variable venting, in accordance with some embodiments of the present disclosure. In some embodiments, an hearing device 410 may comprise a receiver housing 411. The receiver housing 411 may comprise a receiver (not shown) and communication circuitry (not shown). The communication circuitry may comprise circuitry for receiving a wired and/or wireless input of electronic signals. In some embodiments, a receiver and a processor may convert the electronic signals into sound waves.

The sound waves may be communicated to an ear-drum of a user of the hearing device 410 though an acoustic pathway formed by a sound conduit 430. The sound conduit 430 may comprise an opening 430C through which sound waves may pass out of the sound conduit 430 into the user's ear canal and then to the user's ear-drum. The hearing device 410 may comprise an ear tip 412 for sealing the hearing device 410 with an ear canal wall. The ear tip 412 may comprise a part of a housing of the hearing device 410, a flexible member, a dome and/or the like. In some embodiments of the present disclosure, an acoustic vale 439 is moveably coupled with the sound conduit 430. The acoustic valve 439 may comprise one or more valve openings 439A. By aligning/misaligning, the acoustic valve openings 439A with one or more vent openings (not shown) in the sound conduit, the acoustic valve 439 may vary venting properties of the hearing device 410. For example, when the user wants to hear ambient noises, talk on a telephone and/or the like, the acoustic valve 439 may be moved with respect to the sound conduit 430 to align the valve opening 439A with a vent opening ion the sound conduit. And when the user wishes to isolate sound generated by the hearing device 410 from ambient sound, the acoustic valve 439 may be moved with respect to the sound conduit 430 such that the valve opening 439A is misaligned with the vent opening in the sound conduit 430. Movement of the acoustic valve 439 relative to the sound conduit 430, may be produced by an actuator, such as an electronic actuator, a switch, a button and/or the like. Movement of the acoustic valve 439 relative to the sound conduit 430, may be produced by moving the hearing device 310 in the ear canal, for example by rotating the hearing device 310 in the ear canal, such that the sound conduit 430 rotates with respect to the acoustic valve 439.

Figure 4B:
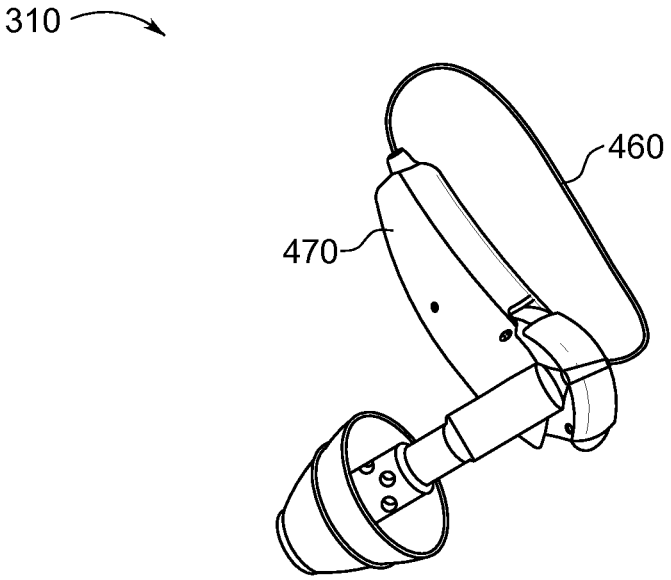
FIG. 4B illustrates a hearing device with variable venting comprising an external sound receiving system, in accordance with some embodiments of the present disclosure.

FIG. 4B illustrates a hearing device with variable venting comprising an external sound receiving system, in accordance with some embodiments of the present disclosure. In FIG. 4B, the hearing device with variable venting depicted in FIG. 4A further comprises a sound receiving system 470. The sound receiving system 470 may comprise a microphone or the like for receiving sound waves. The sound receiving system may be worn external to the ear canal to receive ambient sounds. For example, in a behind-the-ear hearing device, the sound receiving system 470 may be worn behind a user's ear. The sound receiving system 470 may comprise an antenna or the like to receive wireless/Bluetooth input from external devices, such as smart phones, smart speakers, computers, a tablet and/or the like. In some embodiments of the present disclosure, the sound receiving system 470 may communicate received sound information to the hearing device with variable venting via one or more electrical connectors 460. In some embodiments, the sound receiving system 470 may comprise processing circuitry that may control the variable venting of the hearing device. For example, the sound receiving system 470 may communicate signals to an in-ear part of the hearing device via the one or more electrical connectors 460 to an actuator that is configured to control an acoustic valve.

Figure 5A:
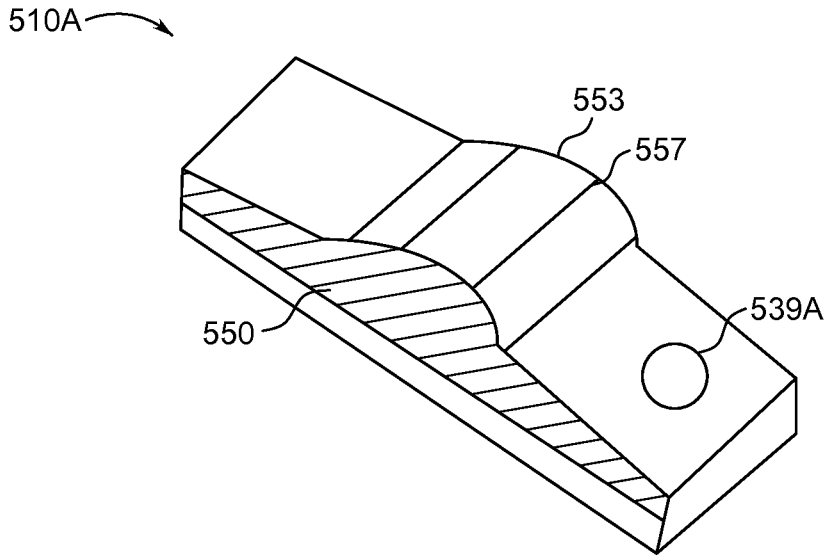
FIG. 5A illustrates an acoustic valve for a hearing device with variable venting, in accordance with some embodiments of the present disclosure.

FIG. 5A illustrates an acoustic valve for a hearing device with variable venting, in accordance with some embodiments of the present disclosure. In some embodiments, an acoustic valve 510A for a hearing device with variable venting, in accordance with some embodiments of the present disclosure may comprise a substrate 550. The substrate 550 may be moveably coupled with a sound conduit. For example, the substrate 550 may be coupled with the sound conduit such that is can be translated along the sound conduit. The substrate 550 may be used to adjustable close a vent opening in the sound conduit by covering/moving over the vent opening. In some embodiments, the substrate 550 may comprise a raised section 553. The raised section may be configured in use to contact a portion of a user's ear canal to hold the acoustic valve in a position while the hearing device with variable venting and/or the sound conduit is moving in the ear canal. The substrate 550 may in some embodiments include grooves and/or a roughened section 557 for locally increasing a frictional coefficient of the substrate 550. In some embodiments, the substrate 550 may comprise an acoustic valve opening 539A. The acoustic valve opening 539A may be used to adjust venting through a vent opening in the sound conduit. In some embodiments, the acoustic valve opening 539A may be aligned/misaligned with the vent opening by moving the acoustic vent 510A and/or the sound conduit with respect to one another and/or translating the acoustic valve 510A over the sound conduit.

Figure 5B:
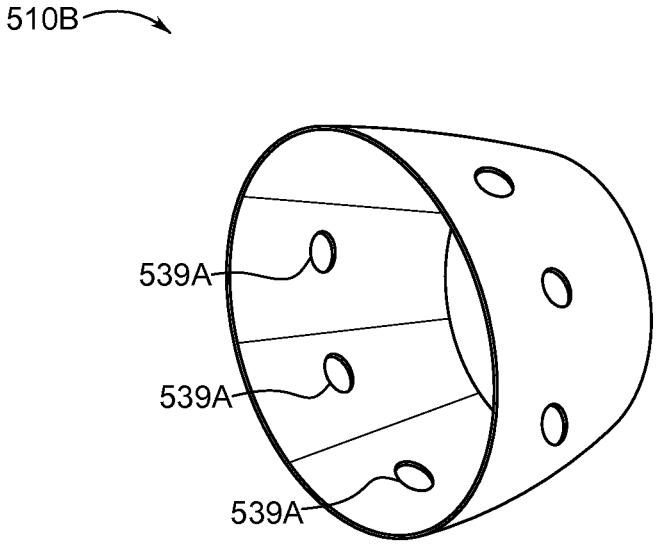
FIG. 5B illustrates an acoustic valve for a hearing device with variable venting, in accordance with some embodiments of the present disclosure.

FIG. 5B illustrates an acoustic valve for a hearing device with variable venting, in accordance with some embodiments of the present disclosure. In some embodiments, an acoustic valve 510B may be disposed around or at least partially around a sound conduit of the hearing device. The acoustic valve 510B may be moveably coupled with the sound conduit such that it is capable of rotation around the sound conduit and/or the sound conduit is capable of rotation with respect to the acoustic valve 510B. In some embodiments, the acoustic valve 510B may comprise one of more acoustic valve openings 539A. In some embodiments, the acoustic valve 510B may be used to adjust venting of the hearing device by aligning/misaligning the one or more acoustic valve openings 539A with one or more vet openings in the sound conduit.

FIGS. 6A, 6B, 6C, 6D, 6E, and 6F illustrate a hearing device 610 with an adjustable vent, in accordance with some embodiments of the present disclosure. Hearing device 610 comprises a sound source housing 613 enclosing a sound source 614. A sound output 615 of sound source 614 is in acoustic communication with a sound conduit 630. Sound conduit 630 comprises a sound conduit chamber 631 and a conduit housing 632. Sound source housing 613 and conduit housing 632 are integrated into a device housing 680 such that sound source housing 613 and conduit housing 632 are rigidly connected. A first opening 636 of sound conduit 636 is provided at a first end 638 of sound conduit 630. An end wall 633 of conduit housing 632 is arranged at first end 638 of sound conduit 630. End wall 633 adjoins sound source housing 613. End wall 633 separates an inner space of sound source housing 613 from sound conduit chamber 631. First opening 636 is provided at a through hole 634 in end wall 633. First opening 636 may be provided around a central axis 640 of sound conduit 630, in particular such that it is centered around central axis 640. Central axis 640 extends in a propagation direction of sound waves emitted from sound source 614 and travelling through sound conduit 630. Sound output 615 is provided in a proximity to a first opening 636 of sound conduit 630. In some instances, a sound wave generation means, such as a membrane, may be provided at first opening 636 or in a proximity to first opening 636. In some instances, an end of a sound tube of sound source 614 may be provided at first opening 636 through which sound waves generated by sound source 614 can propagate toward first opening 636.

Conduit housing 632 comprises a side wall 635 surrounding sound conduit chamber 631. Side wall 632 is an outer side wall separating an inner space of conduit housing 632 from the exterior. When conduit housing 632 is inserted in an ear canal, outer side wall 632 thus provides a separation of an inner space of conduit housing 632 from the exterior volume of the ear canal. Side wall 635 has an inner surface 641 and an outer surface 642. Inner surface 641 extends in parallel to central axis 640 of sound conduit 630 and delimits sound conduit chamber 631 in this direction, in particular such that a cylindrical shape of sound conduit chamber 631 is provided. In this way, a sound tube is formed by inner surface 641 of conduit housing 632. Inner surface 641 extends from first end 638 to a second end 669 of sound conduit 630. An outer end 648 of conduit housing 632 is thus provided at second end 669 of sound conduit 630. Outer end 648 of conduit housing 632 is open, such that a housing opening 637 is delimited by inner surface 641 at of conduit housing 632 at outer end 648. The housing opening provides a second opening 637 of sound conduit 630 at second end 669 of sound conduit 630. In this way, sound conduit 630 is configured to provide for transmission of sound waves from first opening 636 to second opening 637. In particular, sound conduit chamber 631 is configured to provide for travelling of sound waves through sound conduit chamber 631 from first opening 636 to second opening 637. Conduit housing 632 is provided between first opening 636 of sound conduit 630 and second opening 637 of sound conduit 630. Side wall 635 surrounding sound conduit chamber 631 is at least partially delimiting sound conduit chamber 631 in the direction of central axis 640. Thus, side wall 635 defines a conduit wall, the conduit wall 635 configured to provide for travelling of sound waves along central axis 640. At first end 638 of sound conduit 630, end wall 633 projects from inner surface 641 toward central axis 640. Outer surface 642 of conduit housing 632 extends in parallel to central axis 640 of sound conduit 630. Outer surface 642 extends from second end 669 beyond first end 638 of sound conduit 630. Side wall 635 has a tubular shape. In particular, side wall 635 is cylindrical. Side wall 635 is rotationally symmetric around central axis 640 of sound conduit 630.

Vent openings 651, 652, 653, 654, 655 are provided in conduit housing 632. Vent openings 651-655 are provided as holes formed in side wall 635. Vent openings 651, 652, 653, 654, 655 lead to inner surface 641. Vent openings 651-655 are facing central axis 640 of sound conduit 630, in particular such that they are oriented substantially perpendicular to central axis 640. Vent openings 651, 652, 653, 654, 655 lead to sound conduit chamber 631. Vent openings 651-655 are provided around a circumference of side wall 635. Vent openings 651-655 may be equidistantly spaced from one another. Vent openings 651-655 are equidistantly spaced from second end 669 of sound conduit 630, in particular such that vent openings 651-655 are provided at a position of a circular cross section of side wall 635. Vent openings 651-655 may have a substantially identical shape. For example, vent openings 651-655 are circular. Vent openings 651-655 are thus configured to provide for venting of sound waves from sound conduit 630 into an ambient environment outside of sound conduit 630.

Sound conduit 630 comprises an acoustic valve 639. Acoustic valve 639 comprises a valve member 670. A side wall 673 of valve member 670 surrounds side wall 635 of conduit housing 632. Side wall 673 extends in between a first axial opening and a second axial opening of valve member 670. Side wall 673 thus delimits a vent chamber in between the first axial opening and the second axial opening of valve member 670. Side wall 673 of valve member 670 is provided as a substrate on conduit housing 632. Side wall 673 has an inner surface 671 and an outer surface 672. Inner surface 671 of valve member side wall 673 extends in parallel to central axis 640 from second end 669 beyond first end 638 of sound conduit 630. Inner surface 671 of valve member side wall 673 borders on outer surface 642 of side wall 635 of conduit housing 632. In this way, a first coupling surface 643 is provided by outer surface 642 of side wall 635 of conduit housing 632 and a second coupling surface 644 is provided by inner surface 671 of side wall 673 of valve member 670. An inner diameter of side wall 673 of valve member 670 is defined as a distance between opposing points of inner surface 671 of valve member 670, the distance extending through central axis 640. An outer diameter of side wall 635 of conduit housing 632 is defined as a distance between opposing points of outer surface 642 of conduit housing 632, the distance extending through central axis 640. Side wall 673 of valve member 670 has a value of its inner diameter substantially matching a value of the outer diameter of side wall 635 of conduit housing 632. An outer end 649 of valve member 670 is provided at the same axial position with respect to central axis 640 as outer end 648 of conduit housing 632 provided at second end 669 of sound conduit 630.

Coupling surfaces 643, 644 allow a relative motion of conduit housing 632 with respect to valve member 670, such that a moveable coupling is provided. In some instances, the relative motion comprises a sliding movement of coupling surface 643 of conduit housing 632 along coupling surface 644 of valve member 670 and/or a sliding movement of coupling surface 644 of valve member 670 along coupling surface 643 of conduit housing 632. The sliding movement comprises a rotational motion around central axis 640 of sound conduit 630. An electrical actuator 645 is provided in conduit housing 632, in particular in sound conduit chamber 631. Electrical actuator 645 is configured to activate the relative motion of conduit housing 632 with respect to valve member 670. Interlocking surface structures 675 are provided on each of coupling surfaces 643, 644 in order to prevent a translational motion along coupling surfaces 643, 644 in the direction of central axis 640 and to restrict the relative motion to a rotation. Outer surface 672 of side wall 673 of valve member 670 extends in parallel to central axis 640 of sound conduit 630. Outer surface 672 extends from second end 669 beyond first end 638 of sound conduit 630. Side wall 673 of valve member 670 has a tubular shape. In particular, side wall 673 of valve member 670 is rotationally symmetric around central axis 640. For instance, valve member 670 is cylindrical.

Valve openings 661, 662, 663, 664, 665 are provided in side wall 673 of valve member 670. Valve openings 661-665 are provided as holes formed in side wall 673 of valve member 670. Valve openings 661-665 are facing central axis 640 of sound conduit 630, in particular such that they are oriented substantially perpendicular to central axis 640. Valve openings 661-665 are provided around a circumference of side wall 673 of valve member 670. Valve openings 661-665 may be equidistantly spaced from one another. The spacing of vent openings 651-655 and the spacing of valve openings 661-665 is provided such that vent openings 651-655 can be relatively positioned in the spacing between valve openings 661-665. In this configuration, vent openings 651-655 and valve openings 661-665 are closed at the adjoining coupling surfaces 643, 644. This configuration is referred to as a closed position, in which the vent opening and the valve opening are unaligned such that the vent opening is closed. The spacing of vent openings 651-655 and the spacing of valve openings 661-665 is provided such that vent openings 651-655 can be relatively positioned at the circumferential position of valve openings 661-665, such that vent openings 651-655 and valve openings 661-665 at least partially overlap. In this configuration, vent openings 651-655 and valve openings 661-665 may be fully or partially opened at the adjoining coupling surfaces 643, 644. This configuration is referred to as an alignment position, in which the vent opening and the valve opening are aligned such that the vent opening is at least partially open. A venting pathway in sound conduit 630 is defined by a passage way for sound waves from second opening 637 through sound conduit chamber 631 out of at least one of vent openings 651-655 and at least one of valve openings 661-665. An inlet in sound conduit 630 to the venting pathway is formed by second opening 637. The second opening thus provides a venting inlet 637. An outlet in sound conduit 630 from the venting pathway is formed by at least one of vent openings 651-655 and at least one of valve openings 661-665. At least one of vent openings 651-655 and at least one of valve openings 661-665 thus provide a venting outlet.

Valve openings 661-665 are equidistantly spaced from second end 669 of sound conduit 630, in particular such that valve openings 661-665 are provided at the same position of a circular cross section of side wall 635 as compared to vent openings 651-655. Valve openings 661-665 may have a substantially identical shape. In some instances, valve openings 661-665 have a substantially identical shape as compared to vent openings 651-655. In some instances, valve openings 661-665 are smaller as compared to vent openings 651-655. In some instances, valve openings 661-665 are larger as compared to vent openings 651-655. For instance, valve openings 661-665 are circular. In some instances, the same number of valve openings 661-665 is provided as vent openings 651-655. In some instances, more or less valve openings 661-665 are provided than vent openings 651-655.

Figure 6A:
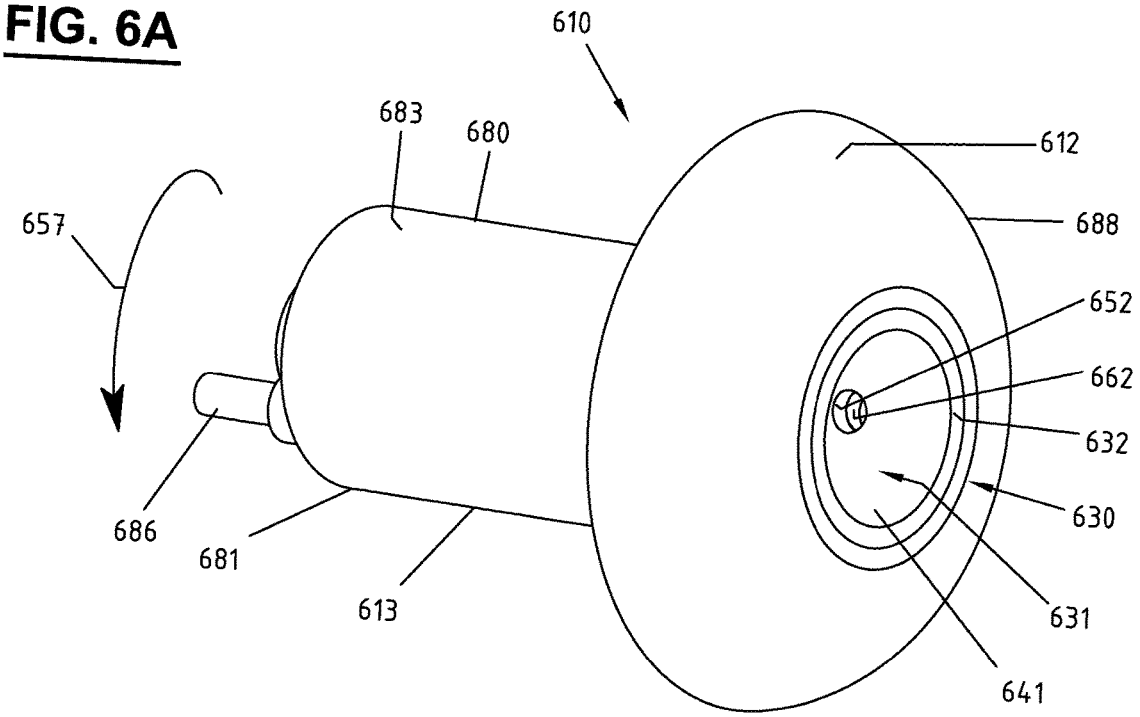
FIGS. 6A, B illustrate a perspective view of a hearing device with variable venting, in accordance with some embodiments of the present disclosure.
Figure 6B:
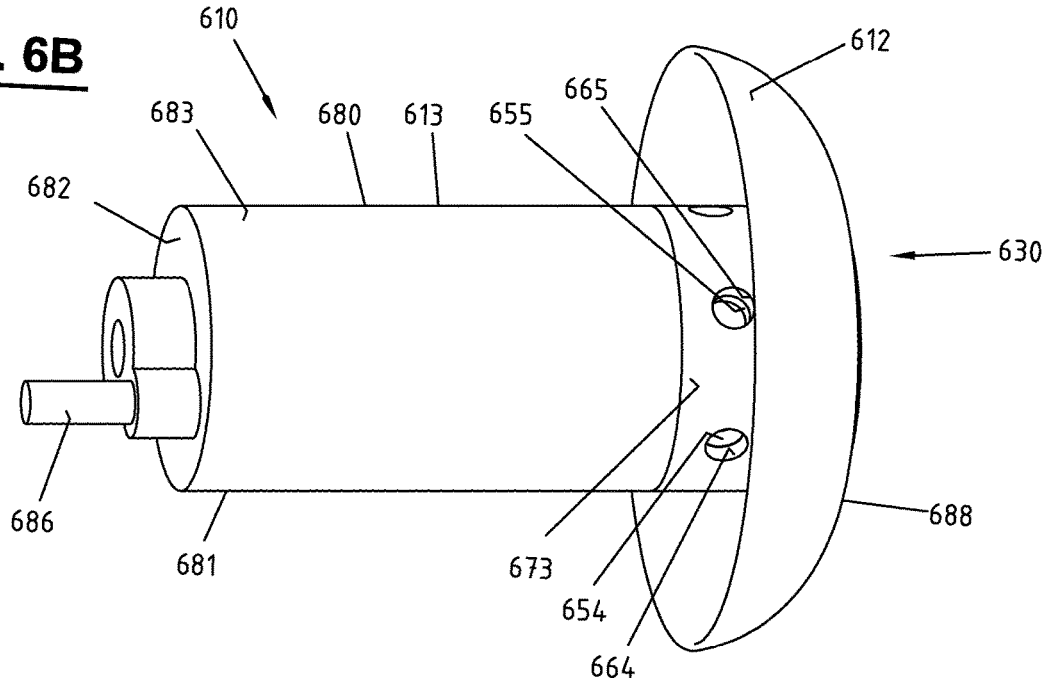
FIGS. 6C, D are lateral sectional views showing details of the hearing device illustrated in FIGS. 6A, 6B.
FIG. 6E is a detailed view showing details of the hearing device illustrated in FIG. 6D.
FIG. 6F is a perspective sectional view showing details of the hearing device as shown in FIG. 6A.
Figure 6C:
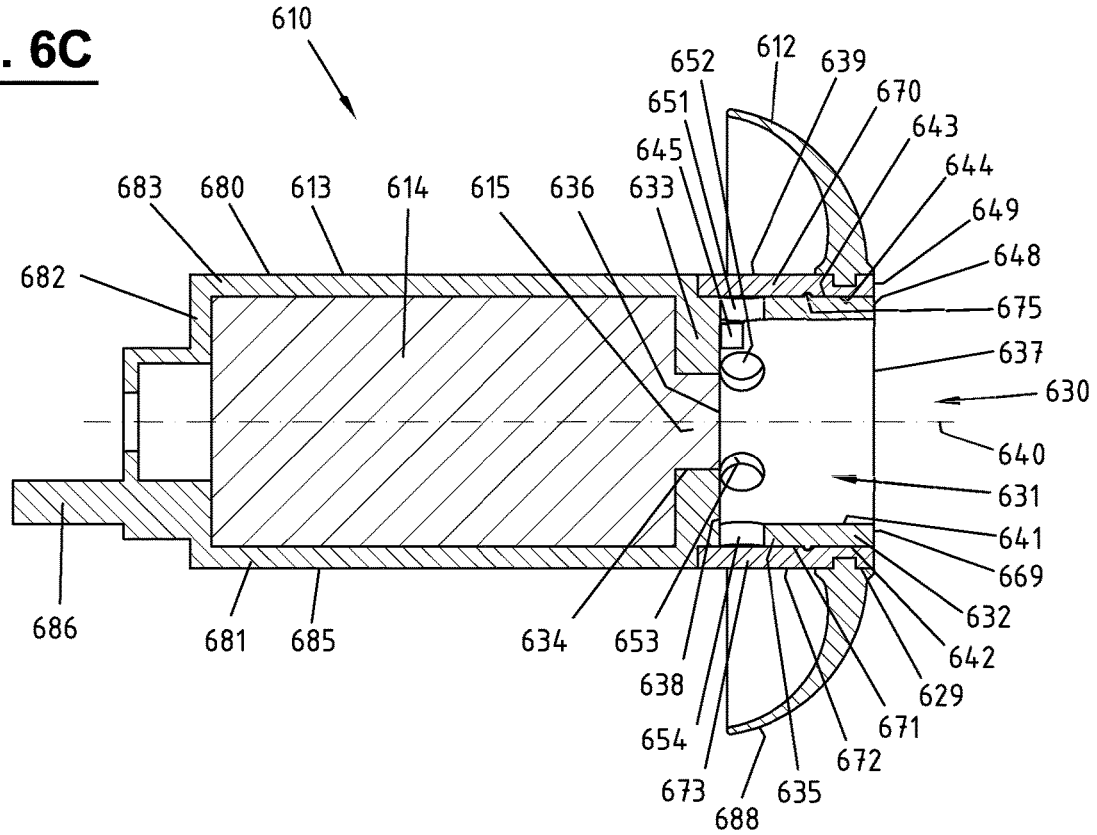
Figure 6D:
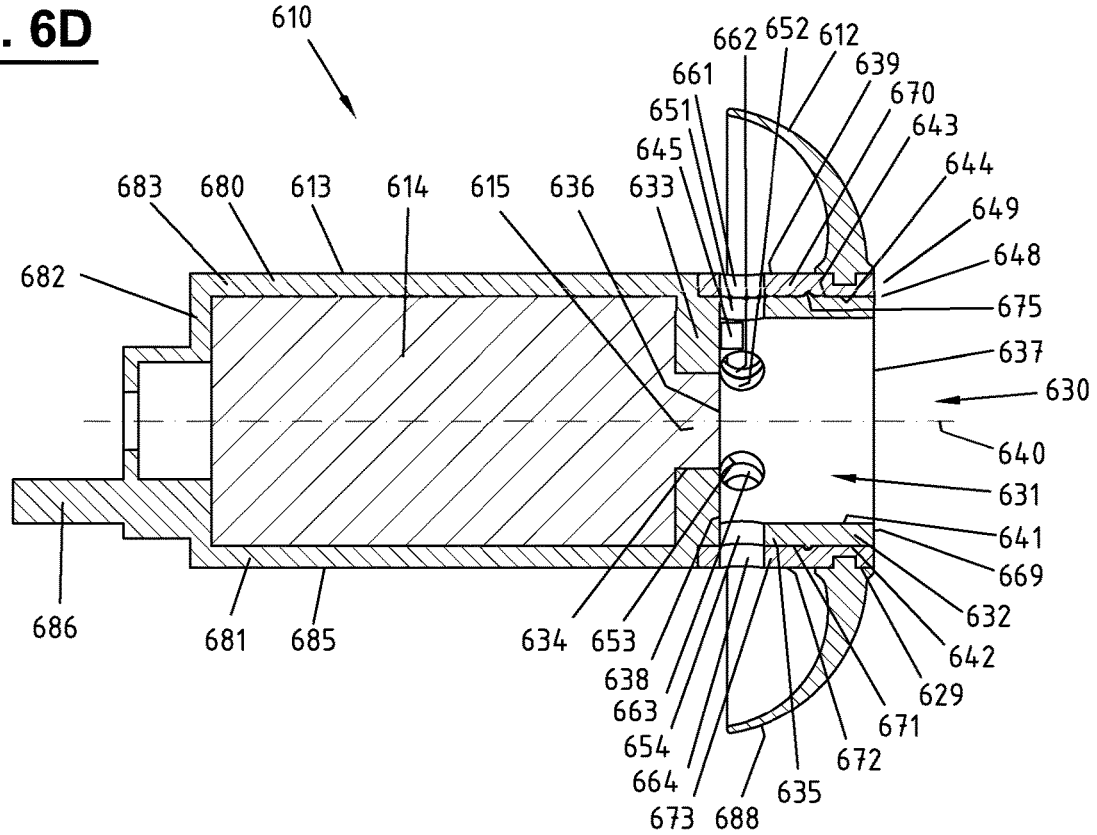

Vent openings 651-655 are thus configured to be opened, in particular in a relative position of vent openings 651-655 at which valve openings 661-665 are disposed at a same circumferential position than vent openings 651-655 such that at least one of a size of vent openings 651-655 and a size of valve openings 661-665 is fully uncovered, in particular corresponding to a full opening of vent openings 651-655 in which vent openings 651-655 are fully aligned with valve openings 661-665. Such an alignment position is illustrated in FIGS. 6A, 6B, 6D, 6E, and 6F. Vent openings 651-655 are further configured to be closed, in particular in a relative position of vent openings 651-655 at which valve openings 661-665 are disposed at a different circumferential position than vent openings 651-655 such that at least one of a size of vent openings 651-655 and a size of valve openings 661-665 is fully covered, in particular corresponding to a full closing of vent openings 651-655 in which vent openings 651-655 are not aligned with valve openings 661-665. The closed position is illustrated in FIG. 6C. Vent openings 651-655 are further configured to be adjusted, in particular by changing relative positions in which vent openings 651-655 and valve openings 661-665 are at least partially overlapping such that at least one of a size of vent openings 651-655 and a size of valve openings 661-665 is increasingly covered or uncovered, in particular corresponding to a change of an overlapping size of vent openings 651-655 and valve openings 661-665 in which vent openings 651-655 are partially aligned with valve openings 661-665 and thus are in an alignment position.

Sound conduit 630 comprises a sealing mechanism 629. Sealing mechanism 629 comprises a contact member 612 configured to contact an ear canal wall. The contact member is provided by a flexible element 612. Flexible element 612 is provided on valve member 670, in particular rigidly fixed on outer surface 672 of valve member side wall 673. Flexible element 612 is configured to acoustically seal a section of an ear canal when device 610 is inserted inside the ear canal. After insertion, flexible element 612 is configured to contact the ear canal wall 23, as depicted in FIG. 1. In this way, a sealed section is provided between flexible element 612 and ear drum 26 at an end of the ear canal. Flexible element 612 is rigidly attached to outer surface 672 of valve member 670 at a surface portion in between valve openings 661-665 and second end 669 of sound conduit 630. In particular, flexible element 612 is provided in proximity to second end 669. Thus, an acoustic passage way for sound waves from the sealed section through sound conduit chamber 631 and vent openings 651-655 toward an ambient environment outside an ear canal can be provided in the alignment position in which vent openings 651-655 and valve openings 661-665 are at least partially overlapping.

Sealing mechanism 629 is configured to provide a mechanical fixation of valve member 670 on ear canal wall 23 at an outer surface 688 of sealing mechanism 629 contacting ear canal wall 23 after insertion of device 610. The outer surface of sealing mechanism 629 thus provides a contact surface 688 for the ear canal. To this end, outer surface 688 is provided with frictional properties, such that frictional forces between the ear canal wall 23 and valve member 670 prevent/limit movement of valve member 670 when conduit housing 632 undergoes motion in the ear canal 20. For instance, flexible member 612 may be formed from a material having on the one hand elastic properties in order to conform to a shape of ear canal wall 23 when contacting ear canal wall 23 and on the other hand a sufficient rigidity contravening an easy displacement of the flexible member inside the ear canal. The mechanical fixation of flexible member 612 at ear canal wall 23 and the moveable coupling at coupling surfaces 643, 644 is provided such that a rotational force acting on conduit housing 632 substantially only rotates conduit housing 632, wherein valve member 670 remains in a fixed position with respect to ear canal wall 23. In this way, an opening, closing and adjustment of vent openings 651-655 with respect to valve openings 661-665 can be provided by a rotation of conduit housing 632 during usage of device 610 inside an ear canal, wherein valve member 670 substantially remains in its fixed position relative to ear canal wall 23.

Sealing mechanism 629 has an axial length corresponding to a total length of sealing mechanism 629 in which sealing mechanism 629 extends in parallel to central axis 640 of sound conduit 630. In particular, the axial length can be provided by a curvature of outer surface 688 of flexible element 612 in a direction from second end 669 toward first end 638 of sound conduit 630, by which curvature an insertion of flexible element 612 into an ear canal can be facilitated. For instance, a dome-like shape of sealing mechanism 629 may thus be provided. Sealing mechanism 629 may be configured to be deformed inside an ear canal, such that its total length in parallel to central axis 640 may vary when inserted in differently sized ear canals. The axial length of sealing mechanism 629 is then defined as a total length in which sealing mechanism 629 extends in parallel to central axis 640 of sound conduit 630, when the sealing mechanism is in an un-deformed state, in particular when sealing mechanism 629 is not inserted in an ear canal and no other forces are applied on sealing mechanism 629.

Device housing 680 has a length in the direction of central axis 640 of sound conduit 630. In some instances, the length may be provided such that an end portion 681 of device housing 680 is manually accessible during usage of device 610 inside an ear canal. In some instances, end portion 681 comprises an end wall 682 at an end of device housing 680 opposing second end 669 of sound conduit 630. In some instances, end portion 681 comprises a portion of a side wall 683 leading to an end of device housing 680 opposing second end 669 of sound conduit 630. In some instances, end portion 681 comprises a manipulation member provided at end wall 682 or side wall portion 683. In this way, a tangible portion can be provided by end portion 681. Tangible portion 681 may be comprise switch 40 similar to hearing device 10 shown in FIG. 1, in particular at end wall 682 of the device housing. Switch 40 can be coupled to the conduit housing and/or the acoustic valve by actuator 645 in order to actuate the relative motion. Switch 40 may thus be accessible for manipulation from an external region of the ear canal during usage of device 610 inside the ear canal, in particular such that an in use movement of device housing 680 can be actuated by switch 40 at tangible portion 681. In this way, an opening, closing, or adjusting of a size of vent openings 651-655 may be provided during usage of device 610 inside an ear canal.

An activation of rotational motion 657 in device 610 may be provided by any suitable activation methods and/or activation means, in particular those described in the present disclosure. Actuator 645 may be activated by switch 40 and/or an external controller and/or a controller operationally connected to a sensor. In some instances, tangible portion 681 may not be provided at the device housing. For instance, the length of the device may be selected such that the device is located fully inside the ear canal during usage of the device, in particular in such a way that the device housing cannot be manually accessed from the user of the device during usage of the device inside the ear canal. Actuator 645 may then be coupled to an external controller separate from the device housing and/or a sensor located inside or outside the device housing configured to control actuator 46. In some instances, switch 40 is provided at tangible portion 681. Actuator 645 may thus be controlled by switch 40, in particular by a manual impact on switch 40 by which an electrical signal is transmitted to actuator 645.

In some embodiments, a connector 686 is provided at end portion 681. Connector 686 comprises a cable connecting sound source 614 to input circuitry 16 and/or microphone 17, as illustrated in FIG. 1, configured to be provided outside an ear canal. In some embodiments, sound source 614 is configured for wireless communication with an external input circuitry 16 and/or microphone 17. In some embodiments, hearing device 610 is a receiver-in-the-canal (RIC) hearing aid, wherein sound source 614 is provided as a receiver. In some embodiments, input circuitry 16 and/or microphone 17 are provided inside device housing 680, in particular inside sound source housing 613 or inside an additional housing integrated with device housing 680. In some embodiments, sound source 614 is configured to be provided outside an ear canal. For instance, an external sound source 614 may comprise a sound tube in order to provide an acoustic communication with sound conduit 630 worn inside an ear canal.

Figure 6E:
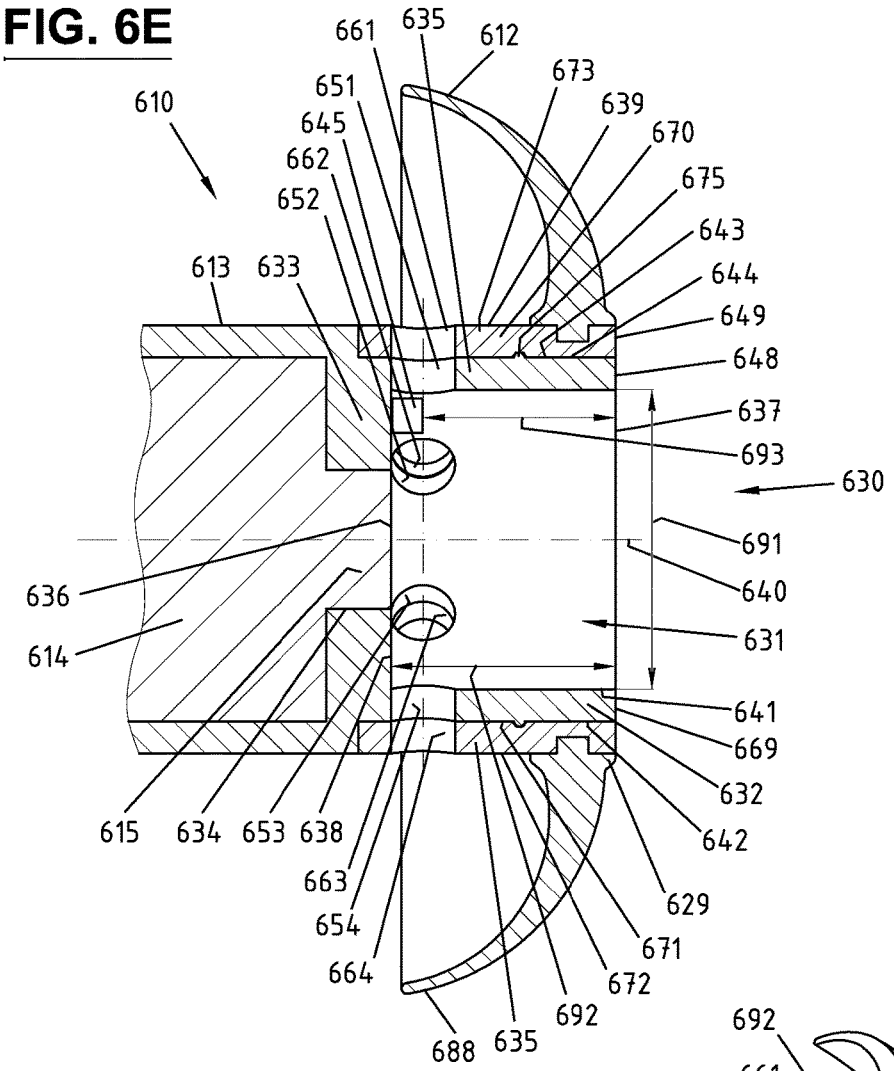
Figure 6F:
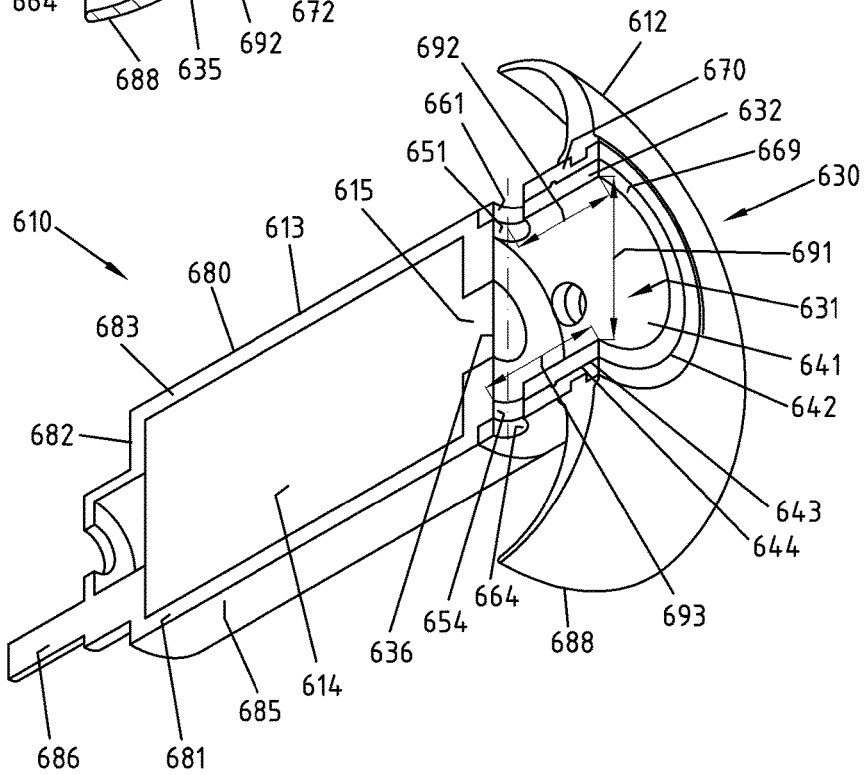

An output diameter 691 of sound conduit 630 is defined as a diameter of second opening 637. In some embodiments, as shown in FIGS. 6E and 6F, output diameter 691 corresponds to a diameter of inner surface 641 of side wall 635 of conduit housing 632. A venting distance 692 of the sound conduit is defined as a distance in the sound conduit in between the venting inlet and the venting outlet, in particular in parallel to central axis 640. In particular, the venting distance 692 of sound conduit 630 is defined as a distance in sound conduit 630 in parallel to central axis 640 of sound conduit 630 in between second opening 637 and a centre of an end of an opening through which sound waves can leave sound conduit 630 into an ambient environment outside of the sealed section provided by sealing mechanism 629. Venting distance 692 is thus a measure of a length of an acoustic pathway for a venting of sound waves through sound conduit 630. In some embodiments, as shown in FIGS. 6E and 6F, venting distance 692 corresponds to a distance in between second opening 637 and a centre of valve openings 661-665. A length 693 of sound conduit 630 is defined as a distance in sound conduit 630 in parallel to central axis 640 in between first opening 636 and second opening 637. Sound conduit length 693 is thus a measure for a distance which the sound waves generated by sound source 614 travel inside sound conduit 630. A ratio in between sound conduit length 693 and output diameter 691 may be regarded as an indicator for an acoustic mass inside sound conduit 630. A low value of this ratio indicates a small acoustic mass in sound conduit 630 and thus a small acoustic impedance provided by sound conduit 630.

The venting system of the device 610, comprising sound conduit chamber 631 and vent openings 651-655 in a venting pathway, provides a low acoustic impedance. Sound conduit chamber 631 as part of the venting pathway comprises a comparatively large internal volume. The large internal volume is provided by a low value of the ratio in between sound conduit length 693 and output diameter 691 substantially corresponding to an average diameter of sound conduit chamber 631. For instance, a value of this ratio may be at most 10, at most 5, or at most 3. In this way, a small acoustic mass and a low acoustic impedance in sound conduit chamber 631 for the sound waves travelling in sound conduit chamber 631 along the acoustic pathway from first opening 636 to second opening 637 is provided. The venting pathway provided in sound conduit 630 advantageously utilizes the low acoustic impedance of sound conduit chamber 631, since a major part of the venting pathway is provided by sound conduit chamber 631. In this way, a good efficiency of the venting can be provided. Beyond that, the low acoustic impedance of the venting pathway is improved by a proximity of vent openings 651-655 to second opening 630 of the sound tube formed by side wall 635. This proximity further reduces the acoustic impedance for sound waves being vented through device 610. For example, venting distance 692 in device 610 is at most 10 millimetres, at most 5 millimetres, or at most 3 millimetres. For example, venting distance 692 in device 610 corresponds to not more than fifteen times, in particular ten times, of diameter 691 of second opening 637 and/or diameter 691 of inner surface 641 of side wall 635 of conduit housing 632.

Figure 7A:
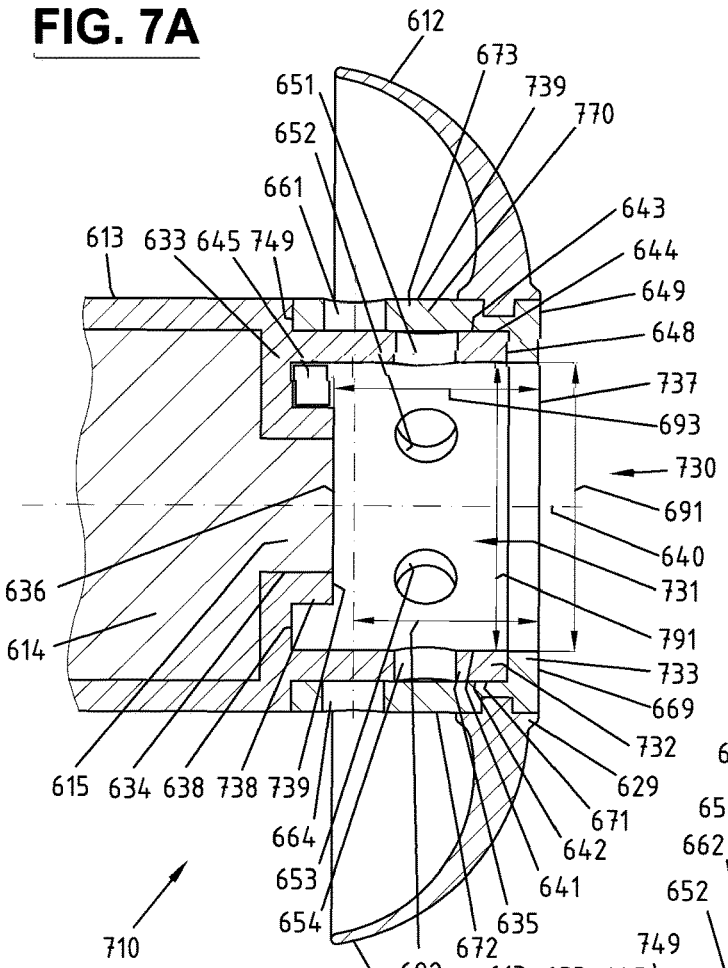
FIGS. 7A, B are lateral sectional views showing details of a hearing device with variable venting, in accordance with some embodiments of the present disclosure.
Figure 7B:
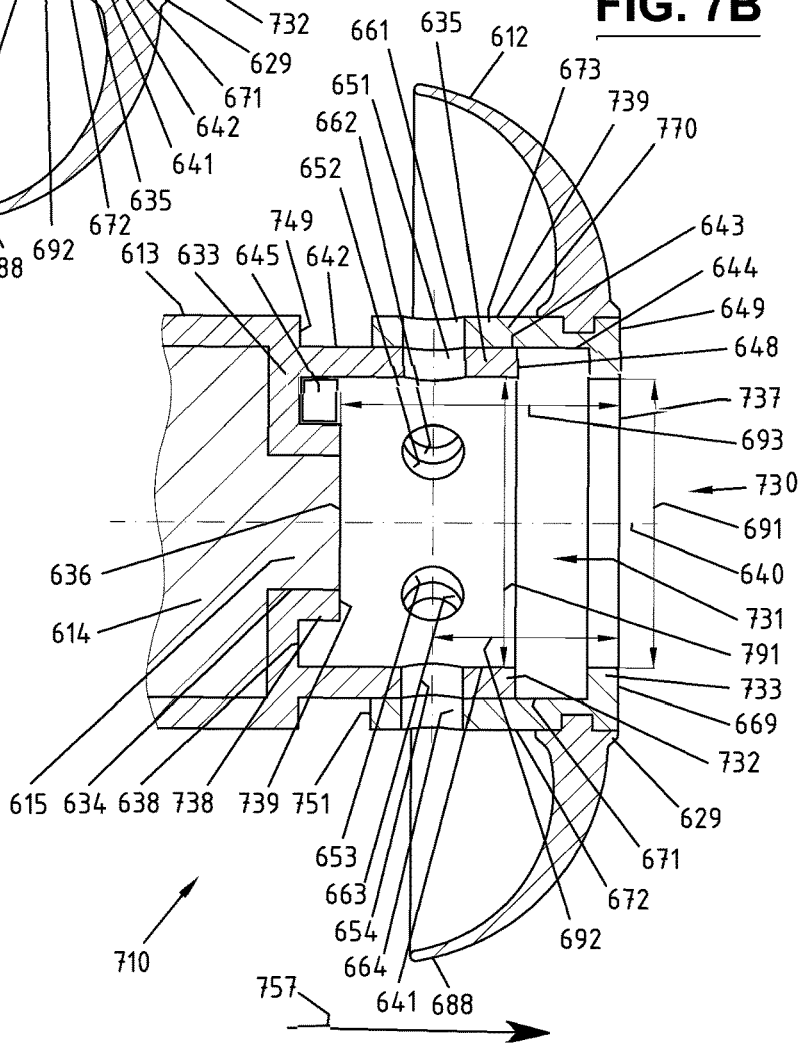

FIGS. 7A and 7B illustrate a hearing device 710 with an adjustable vent, in accordance with some embodiments of the present disclosure. Corresponding features with respect to embodiments of hearing device 610 illustrated in FIGS. 6A-6F are illustrated by the same reference numerals. Hearing device 710 comprises a sound conduit 730 with a conduit housing 732 and an acoustic valve 739 including a valve member 770. An inner side wall 738 of conduit housing 732 extends into a sound conduit chamber 731. Inner side wall 738 is appended to end wall 633 at the position of through hole 634 formed in end wall 633. Inner side wall 738 surrounds through hole 634 such that the through hole is prolonged from first end 638 of sound conduit 730 into sound conduit chamber 731. First opening 636 of sound conduit 730 is provided at a free end 739 of inner side wall 738. Free end 739 of inner side wall 738 is opposed to an end of inner side wall 738 that adjoins end wall 633. Inner side wall extends in parallel to central axis 640. Inner side wall 738 has a tubular shape. In some instances, inner side wall 738 provides a sound tube through which sound waves generated by sound source 614 can be transmitted into sound conduit chamber 731. In some instances, inner side wall 738 provides a sound tube through which sound waves generated by sound source 614 can be transmitted into sound conduit chamber 731 through first opening 636. In some instances, a sound wave generation means of sound source 614, such as a membrane, may be provided at first opening 636 or in a proximity to first opening 636.

Side wall 673 of valve member 770 surrounds side wall 635 of conduit housing 732 such that first coupling surface 643 is provided by outer surface 642 of side wall 635 of conduit housing 732 and second coupling surface 644 is provided by inner surface 671 of side wall 673 of valve member 770. Side wall 673 of valve member 770 is provided as a substrate on conduit housing 732. Side wall 673 of valve member 770 projects from side wall 635 of conduit housing 732 at outer end 648 of conduit housing 732 in the direction of central axis 640 such that second end 669 of sound conduit 730 is provided at outer end 649 of valve member 770. Outer end 649 of valve member 770 is open, such that a valve opening 737 is delimited at outer end 649 of valve member 770. The valve opening provides a second opening 737 of sound conduit 730 at its second end 669. Conduit housing 732 is provided between first opening 636 of sound conduit 730 and second opening 737 of sound conduit 730. Housing opening 637 at outer end 648 of conduit housing 732 provides an intermediate opening for a transition of sound waves in between conduit housing 732 and the axially projecting portion of valve member 770. Sound conduit chamber 731 comprises an inner space enclosed by inner surface 641 of conduit housing side wall 635 and an inner space enclosed by the axially projecting portion of valve member 770. Sound conduit chamber 731 is configured to provide for travelling of sound waves through sound conduit chamber 731 from first opening 636 to second opening 737. Side wall 635 and side wall 673 surrounding sound conduit chamber 731 are at least partially delimiting sound conduit chamber 731 in the direction of central axis 640. Thus, side walls 635, 673 each define a conduit wall, the conduit walls 635, 673 configured to provide for travelling of sound waves along central axis 640.

A venting pathway in sound conduit 730 is defined by a passage way for sound waves from second opening 737 through sound conduit chamber 631 out of at least one of vent openings 651-655 and at least one of valve openings 661-665. A venting inlet in sound conduit 730 to the venting pathway is formed by second opening 737. A venting outlet in sound conduit 730 from the venting pathway is formed by at least one of vent openings 651-655 and at least one of valve openings 661-665. Valve member 770 is provided with an end wall 733 radially projecting from side wall 673 of valve member 770 toward central axis 640 at outer end 649 of valve member 770. Radially projecting end wall 733 ends at a radial distance from central axis 640 corresponding to a radial distance of inner surface 641 of conduit housing side wall 635 from central axis 640. Thus, second opening 737 of sound conduit 730 has the same diameter 691 as a diameter 791 of housing opening 637 at outer end 648 of conduit housing 732.

Coupling surfaces 643, 644 are configured such that a translational motion of conduit housing 732 relative to valve member 770 along coupling surfaces 643, 644 can be provided. Such a translational motion is indicated by an arrow 757 in FIG. 7B. In some instances, the relative motion comprises a sliding movement of coupling surface 643 of conduit housing 732 along coupling surface 644 of valve member 770 and/or a sliding movement of coupling surface 644 of valve member 770 along coupling surface 643 of conduit housing 732. The sliding movement comprises a longitudinal motion, in particular in parallel to central axis 640 of sound conduit 730. Electrical actuator 645 is provided in conduit housing 732, in particular in sound conduit chamber 731. Actuator 645 is configured to activate the relative motion of conduit housing 732 with respect to valve member 770. A spatial restriction of the translational motion is provided by a circumferential edge 749 of conduit housing 732 provided at an axial position of first end 638 of sound conduit 730. Circumferential edge 749 faces an inner end 751 of valve member 770 and thus provides a stop for the translational motion when inner end 751 of valve member 770 abuts against circumferential edge 749. In some instances, circumferential edge 749 is coated with a damping material such that the stop comprises a damping material. In this way, a damping of an impact of valve member 770 can be provided at the stop at the end of said relative motion. The damping material comprises an elastomer. Length 693 of sound conduit 730 defined as an axial distance in between first opening 636 and second opening 737 changes during the course of the translational motion.

Vent openings 651-654 and valve openings 661-664 are provided such that during the course of translational motion 757 of conduit housing 732 relative to valve member 770, vent openings 651-654 and/or valve openings 661-664 can be provided at different axial positions with respect to central axis 640, in which vent openings 651-654 and valve openings 661-664 do not overlap as depicted in FIG. 7A, or at corresponding axial positions with respect to central axis 640, in which vent openings 651-654 and valve openings 661-664 at least partially overlap as depicted in FIG. 7B. In the configuration shown in FIG. 7A, vent openings 651-654 and valve openings 661-664 are closed at the adjoining coupling surfaces 643, 644. This configuration is referred to as a closed position, in which the vent opening and the valve opening are unaligned such that the vent opening is closed. In the configuration shown in FIG. 7B, vent openings 651-654 and valve openings 661-664 may be fully or partially opened at the adjoining coupling surfaces 643, 644. This configuration is referred to as an alignment position, in which the vent opening and the valve opening are aligned such that the vent opening is at least partially open. Vent openings 651-654 are thus configured to be opened, closed and adjusted, in particular by changing relative positions in which vent openings 651-654 and valve openings 661-664 are at least partially overlapping.

Figure 8A:
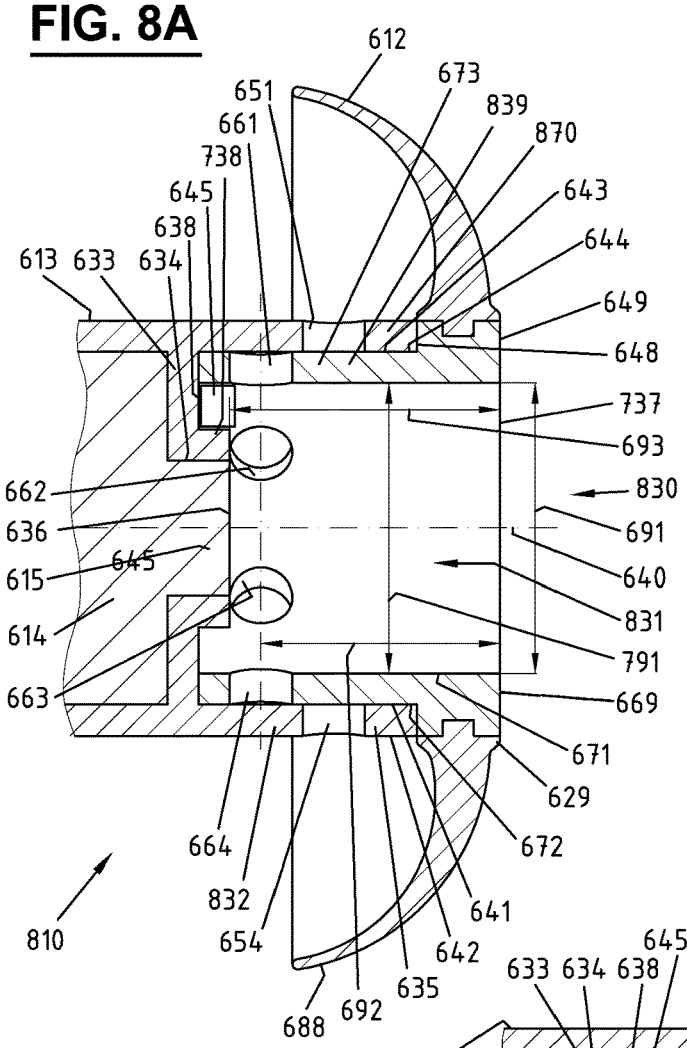
FIGS. 8A, B are lateral sectional views showing details of a hearing device with variable venting, in accordance with some embodiments of the present disclosure.
Figure 8B:
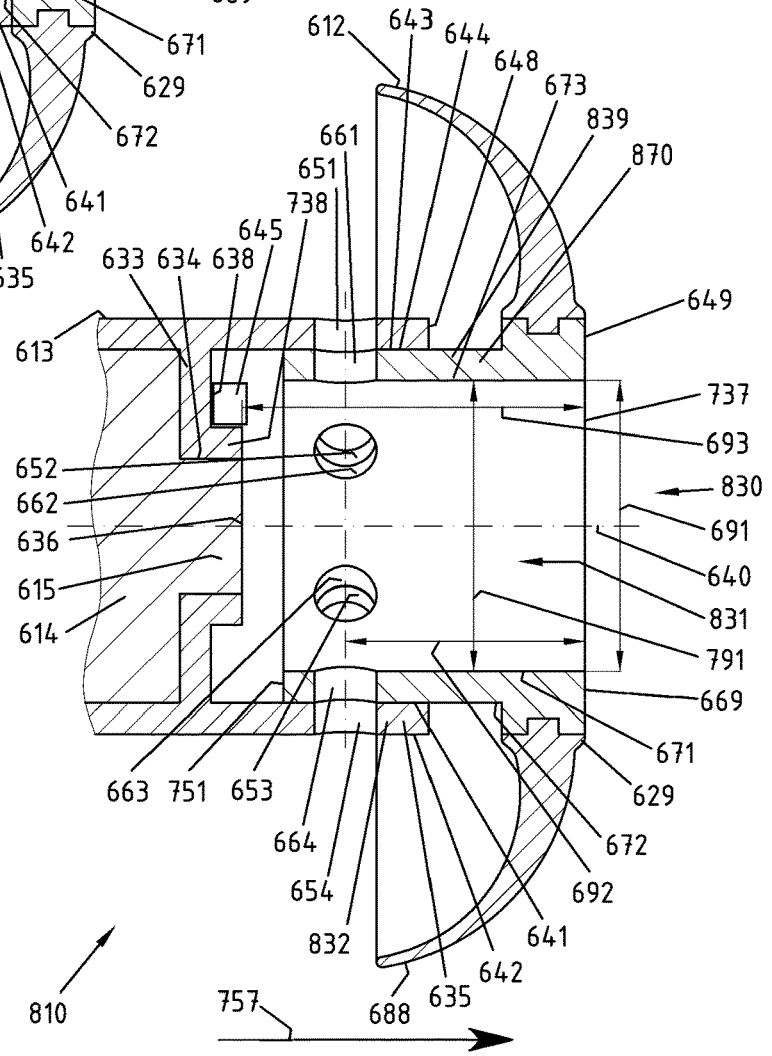

FIGS. 8A and 8B illustrate a hearing device 810 with an adjustable vent, in accordance with some embodiments of the present disclosure. Corresponding features with respect to embodiments of hearing device 610 illustrated in FIGS. 6A-6F and hearing device 710 illustrated in FIGS. 7A and 7B are illustrated by the same reference numerals. A sound conduit 830 of device 810 comprises a conduit housing 832 and an acoustic valve 839 with a valve member 870. Side wall 673 of valve member 870 comprises a length portion in the axial direction at which side wall 635 of conduit housing 832 surrounds side wall 673 of valve member 670. The length portion comprises inner end 751 of valve member 870. The length portion of side wall 673 of valve member 870 is provided as a substrate on conduit housing 832. Within the length portion, outer surface 672 of valve member side wall 673 borders on inner surface 641 of side wall 635 of conduit housing 832. Thus, first coupling surface 643 is provided by inner surface 641 of side wall 635 of conduit housing 832 and second coupling surface 644 is provided by outer surface 672 of side wall 673 of valve member 870. Inner surface 641 of side wall 673 of valve member 870 leads to open outer end 649 of valve member 870, such that valve opening 737 is delimited by inner surface 641 at outer end 649 of valve member 870. The valve opening provides second opening 737 of sound conduit 830 at its second end 669. Housing opening 637 at outer end 648 of conduit housing 832 provides an intermediate opening for a transition of sound waves in between conduit housing 732 and valve member 870.

An outer diameter of side wall 673 of valve member 870 is defined as a distance between opposing points of outer surface 672 of valve member 870, the distance extending through central axis 640. An inner diameter of side wall 635 of conduit housing 832 is defined as a distance between opposing points of inner surface 641 of conduit housing 832, the distance extending through central axis 640. Side wall 673 of valve member 870 has a value of its outer diameter substantially matching a value of the inner diameter of side wall 635 of conduit housing 832. Valve member 870 is inserted into housing opening 637 at the substantially matching diameters. Open diameter 791 of housing opening 637 is thus defined by inner surface 641 of side wall 673 of valve member 870 inserted into housing opening 637. Conduit housing 832 is provided between first opening 636 of sound conduit 830 and second opening 737 of sound conduit 830. Second opening 737 of sound conduit 830 has the same diameter 691 as open diameter 791 of housing opening 637 provided at outer end 648 of conduit housing 732. Sound conduit chamber 831 is configured to provide for travelling of sound waves through sound conduit chamber 831 from first opening 636 to second opening 737. Side wall 635 and side wall 673 surrounding sound conduit chamber 831 are at least partially delimiting conduit chamber 731 in the direction of central axis 640. Thus, side wall 635 and side wall 673 each define a conduit wall, the conduit walls 635, 673 configured to provide for travelling of sound waves along central axis 640. A venting pathway in sound conduit 830 is defined by a passage way for sound waves from second opening 737 through sound conduit chamber 631 out of at least one of vent openings 651-655 and at least one of valve openings 661-665. A venting inlet in sound conduit 830 to the venting pathway is formed by second opening 737. A venting outlet in sound conduit 830 from the venting pathway is formed by at least one of vent openings 651-655 and at least one of valve openings 661-665.

The moveable coupling at coupling surfaces 643, 644 is configured such that a translational motion of conduit housing 832 relative to valve member 870 along coupling surfaces 643, 644 in direction 757 can be provided, in particular by a sliding movement of coupling surface 643 of conduit housing 832 along coupling surface 644 of valve member 870 and/or a sliding movement of coupling surface 644 of valve member 870 along coupling surface 643 of conduit housing 832. Actuator 645 is provided in conduit housing 832, in particular in sound conduit chamber 831. Actuator 645 is configured to activate the relative motion of conduit housing 832 with respect to valve member 870. Length 693 of sound conduit 830 defined as an axial distance in between first opening 636 and second opening 737 changes during the course of the translational motion. A spatial restriction of the translational motion is provided by end wall 633 of conduit housing 832 provided at first end 638 of sound conduit 830 which faces inner end 751 of valve member 870 and thus provides a stop for the translational motion when inner end 751 of valve member 870 abuts against end wall 633. In some instances, end wall 633 is coated with a damping material at an outer surface facing valve member 870 such that the stop is provided with a damping material. In this way, a damping of an impact of valve member 770 can be provided at the stop at the end of said relative motion. The damping material comprises an elastomer.

Length 693 of sound conduit 830 defined as an axial distance in between first opening 636 and second opening 737 changes during the course of the translational motion. During the course of translational motion 757 of conduit housing 832 relative to valve member 870, vent openings 651-654 and/or valve openings 661-664 can be provided at different axial positions with respect to central axis 640, such that a closed position, as depicted in FIG. 8A, and an alignment position, as depicted in FIG. 8B, of vent openings 651-654 and valve openings 661-664 can be provided, in accordance with other embodiments described above. An activation of translational motion 757 in device 810 may be provided by any suitable activation methods and/or activation means, in particular those described above in the context of other embodiments.

Figure 9A:
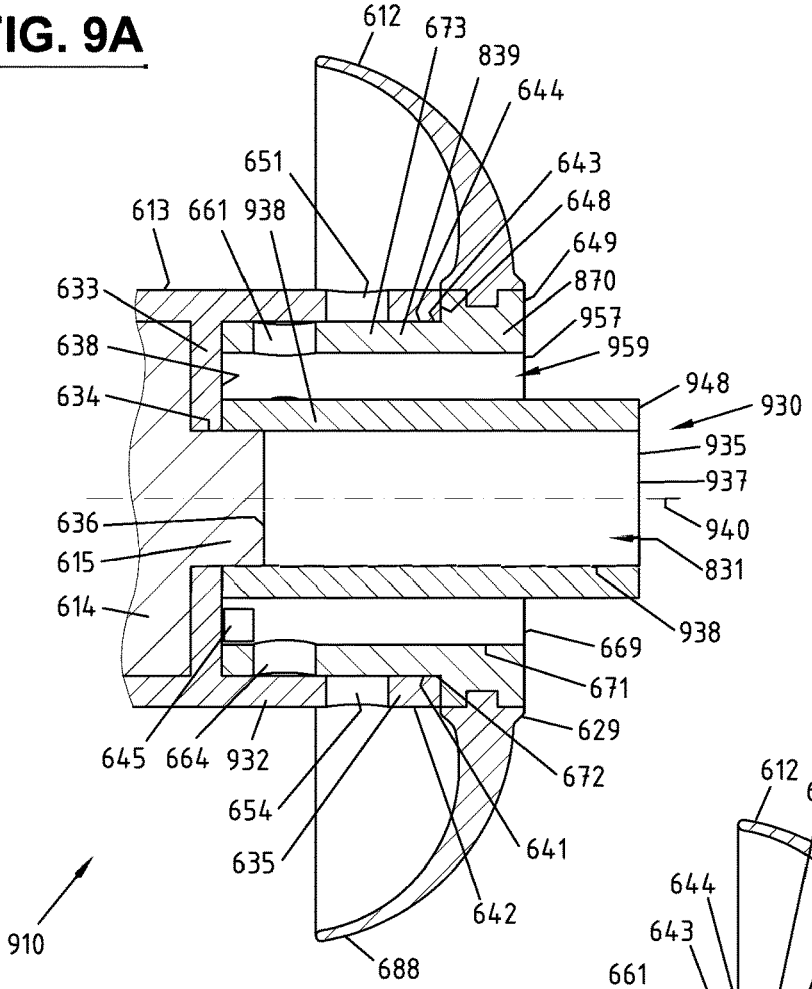
FIGS. 9A, B are lateral sectional views showing details of a hearing device with variable venting, in accordance with some embodiments of the present disclosure.
Figure 9B:
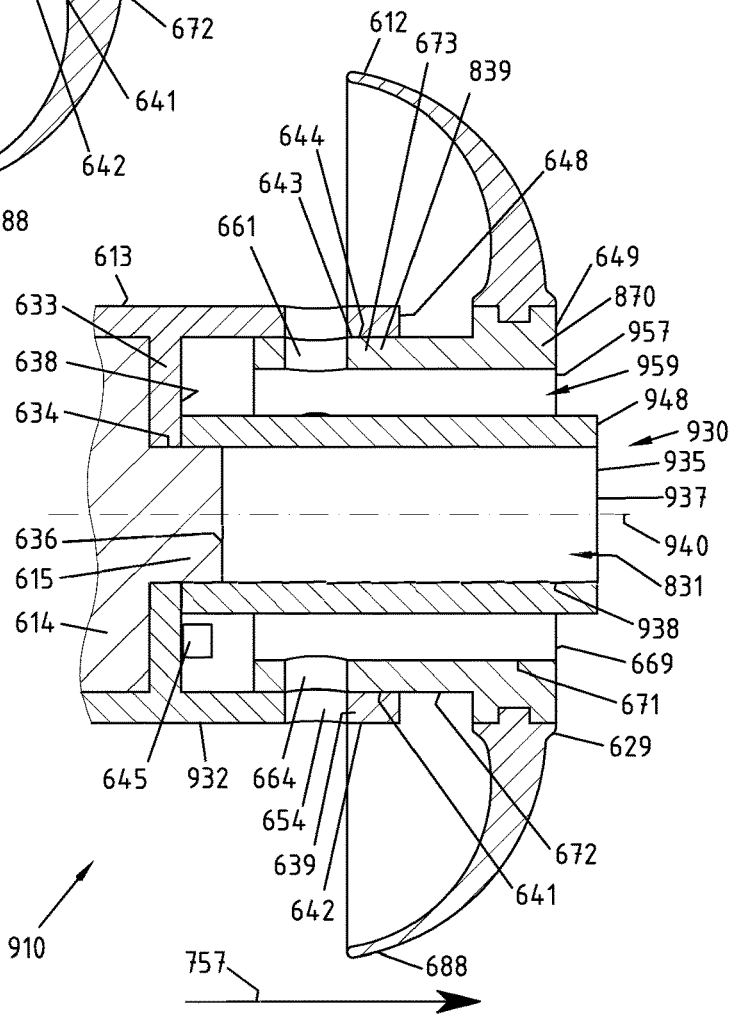

FIGS. 9A and 9B illustrate a hearing device 910 with an adjustable vent, in accordance with some embodiments of the present disclosure. Corresponding features with respect to previously described embodiments are illustrated by the same reference numerals. In particular, a sound conduit 930 of device 910 comprises features of embodiments of embodiments of sound conduit 830 illustrated by device 810 in FIGS. 8A and 8B with a difference that sound conduit 930 comprises a conduit housing 932 having an inner side wall 938 which is provided longer in the direction of central axis 640 as compared to inner side wall 738 of conduit housing 832 of sound conduit 830. Inner side wall 938 extends from end wall 633 of conduit housing 932 in the direction of central axis 640 to a free end 948. Inner side wall 938 extends beyond outer end 649 of valve member 870 in the direction of central axis 640 to free end 948, at least in one relative position of conduit housing 932 and valve member 870 during said relative motion.

Second end 669 of sound conduit 930 is provided by free end 948 of inner side wall 938 at a radially central portion of sound conduit 930 around central axis 640. At a radially outer portion of sound conduit 930, second end 669 of sound conduit 930 is provided by outer end 649 of valve member 870. Inner side wall 938 surrounds through hole 634 such that the through hole is prolonged from first end 638 of sound conduit 930 to free end 948. Free end 948 is open, such that a central opening 935 of sound conduit 930 is provided at free end 948. A second opening 937 of sound conduit 930 thus comprises central opening 935. First opening 636 of sound conduit 930 may be provided in a space delimited by inner side wall 938, in particular in proximity to end wall 633 of conduit housing 932. A sound conduit chamber 931 is thus delimited by inner side wall 938 in between first opening 636 and central opening 935. Conduit housing 832 is provided between first opening 636 of sound conduit 930 and second opening 937 of sound conduit 930. Inner side wall 938 defines a conduit wall, the conduit wall 938 configured to provide for travelling of sound waves along central axis 640. Inner side wall 938 has a tubular shape. In some instances, inner side wall 938 provides a sound tube through which sound waves generated by sound source 614 can be transmitted from first opening 636 to second opening 937, in particular central opening 935, of sound conduit 930. In particular, inner side wall 938 may be a spout.

A venting chamber 959 is provided in between inner side wall 938 of conduit housing 932 and valve member 770, more particularly in between an outer surface of inner side wall 938 and inner surface 671 of side wall 673 of valve member 770. Actuator 645 is provided in conduit housing 932, in particular in venting chamber 959. Actuator 645 is configured to activate relative motion 757 of conduit housing 932 with respect to valve member 870. An opening 957 of venting chamber 959 is formed by an radially outer opening of sound conduit 930 with respect to central axis 940. Venting chamber opening 957 is provided at outer end 649 of valve member 670, thus forming an axial opening of valve member 670. Second opening 937 of sound conduit 930 thus also comprises venting chamber opening 957. A venting pathway in sound conduit 930 is defined by a passage way for sound waves from venting chamber opening 957 through venting chamber 959 out of at least one of vent openings 651-655 and at least one of valve openings 661-665. A venting inlet in sound conduit 930 to the venting pathway is formed by second opening 937, in particular venting chamber opening 957. A venting outlet in sound conduit 930 from the venting pathway is formed by at least one of vent openings 651-655 and at least one of valve openings 661-665.

FIGS. 10A, 10B, 10C, and 10D illustrate a hearing device 1010 with an adjustable vent, in accordance with some embodiments of the present disclosure. Corresponding features with respect to previously described embodiments are illustrated by the same reference numerals. Hearing device 1010 comprises a sound conduit 1030 comprising a conduit housing 1032 and an acoustic valve 1039 including a valve member 1070. Inner surface 641 of a side wall 1035 of conduit housing 1032 delimits a sound conduit chamber 1031 in direction of central axis 640 of sound conduit 1030. Sound conduit chamber 1031 has a diameter corresponding to the diameter of first opening 636 of sound conduit 1030. A second opening 1037 is defined by side wall 1035 at second end 669 of sound conduit 1030. Side wall 1035 extends in parallel to central axis 640. Conduit housing 1032 is provided between first opening 636 of sound conduit 1030 and second opening 1037 of sound conduit 1030. Side wall 1035 defines a conduit wall, the conduit wall 1035 configured to provide for travelling of sound waves along central axis 640. A diameter 691 of second opening 1037 thus corresponds to an inner diameter of side wall 1035, in particular to the diameter of first opening 636 of sound conduit 1030. End wall 633 of conduit housing 632 is provided at first end 638 of sound conduit 1030. End wall 633 radially projects from outer surface 642 of side wall 1035 in a direction opposed to central axis 640.

An annular projection 1050 is provided at outer surface 642 of conduit housing 1032. Annular projection 1050 extends in parallel to end wall 633 in a radial direction perpendicular to central axis 640. A length of annular projection 1050 perpendicular to central axis 640 corresponds to a length of end wall 633 in this direction. Annular projection 1050 is spaced from end wall 633 in a parallel direction to central axis 640. Annular projection 1050 comprises a first end surface 1057 and a second end surface 1058. First end surface 1057 and second end surface 1058 are provided on opposed sides of annular projection 1050. First end surface 1057 is facing end wall 633. Second end surface 1058 points in the same direction as second opening 1037 of sound conduit 1030. First end surface 1057 and second end surface 1058 extend in parallel to second end 669 of sound conduit 1030. Annular projection 1050 is ring-shaped.

Vent openings 1051, 1052, 1053, 1054, 1055, 1056 are provided in annular projection 1050. Vent openings 1051-1056 extend through annular projection 1050 from second end surface 1058 to first end surface 1057. Vent openings 1051-1056 extend in parallel to central axis 640. Vent openings 1051-1056 are provided as holes formed in annular projection 1050. Vent openings 1051-1056 are equidistantly spaced from second end 669 of sound conduit 1030, in particular such that vent openings 1051-1056 are provided at a position of a circular cross section of annular projection 1050. Vent openings 1051-1056 are provided in a circular arrangement around second end surface 1058 and first end surface 1057 of annular projection 1050. Vent openings 1051-1056 may be equidistantly spaced from one another. Vent openings 1051-1056 may have a substantially identical shape. In particular, vent openings 1051-1056 can be circular. Vent openings 1051-1056 are thus configured to provide for venting of sound waves in parallel to central axis 640 of sound conduit 1030 into an ambient environment outside of sound conduit 1030. Vent openings 1051-1056 comprise a diameter 1094, in particular at first end surface 1057 of annular projection 1050, the diameter extending perpendicular to central axis 640 of sound conduit 1030. Vent openings 1051-1056 comprise a length 1095 extending in parallel to central axis 640 of sound conduit 1030.

Inner surface 671 of a side wall 1073 of valve member 1070 is provided on outer surface 642 of side wall 1035 of conduit housing 1032. Contact member 612 of sealing mechanism 629 is provided on valve member 1070, in particular rigidly fixed on outer surface 672 of valve member side wall 1073. Side wall 1073 comprises a first end surface 1067 and a second end surface 1068. First end surface 1067 and second end surface 1068 extend perpendicular to central axis 640. First end surface 1067 of side wall 1073 adjoins second end surface 1058 of annular projection 1050. Second end surface 1068 of side wall 1073 is provided at the same axial position with respect to central axis 640 as second opening 1037 of sound conduit 1030. Side wall 1073 of valve member 1070 is provided as an annular member surrounding side wall 1035 of conduit housing 1032. Side wall 1073 of valve member 1070 has a tubular shape. In particular, side wall 1073 of valve member 1070 is rotationally symmetric around central axis 640. For instance, side wall 1073 of valve member 1070 is cylindrical. Inner surface 671 of valve member side wall 1073 borders on outer surface 642 of side wall 1035 of conduit housing 1032. Side wall 1073 of valve member 1070 has a value of its inner diameter substantially matching a value of the outer diameter of side wall 1035 of conduit housing 1032. In this way, a first coupling surface 643 is provided by outer surface 642 of side wall 1035 of conduit housing 1032, and a second coupling surface 644 is provided by inner surface 671 of side wall 1073 of valve member 1070. Coupling surfaces 643, 644 allow a relative motion of conduit housing 1032 with respect to valve member 1070, such that a moveable coupling is provided. In some instances, the relative motion comprises a sliding movement of coupling surface 643 of conduit housing 1032 along coupling surface 644 of valve member 1070 and/or a sliding movement of coupling surface 644 of valve member 1070 along coupling surface 643 of conduit housing 1032. The sliding movement provides a rotational motion around central axis 640 of sound conduit 1030. Actuator 645 is provided outside conduit housing 1032, in particular in annular projection 1050. Actuator 645 is configured to activate the relative motion of conduit housing 1032 with respect to valve member 1070.

Valve openings 1061, 1062, 1063, 1064, 1065, 1066 are provided in side wall 1073 of valve member 1070. Valve openings 1061-1066 are provided as holes formed in side wall 1073 of valve member 1070. Valve openings 1061-1066 comprise a diameter 1096, in particular at second end surface 1068 of side wall 1073, the diameter extending perpendicular to central axis 640 of sound conduit 1030. Valve openings 1061-1066 extend in parallel to central axis 640 of sound conduit 1030. Valve openings 1061-1066 are provided around a circumference of side wall 1073 of valve member 1070. Valve openings 1061-1066 may be equidistantly spaced from one another. The spacing of vent openings 1051-1056 and the spacing of valve openings 1061-1066 is provided such that vent openings 1051-1056 can be relatively positioned in the spacing between valve openings 1061-1066. In this configuration, vent openings 1051-1056 and valve openings 1061-1066 are closed at second end surface 1058 of annular projection 1050 and first end surface 1067 of side wall 1073 adjoining each other in a direction perpendicular to coupling surfaces 643, 644. This configuration is referred to as a closed position, in which the vent opening and the valve opening are unaligned such that the vent opening is closed. The spacing of vent openings 1051-1056 and the spacing of valve openings 1061-1066 is provided such that vent openings 1051-1056 can be relatively positioned at the circumferential position of valve openings 1061-1066, in which position vent openings 1051-1056 and valve openings 1061-1066 at least partially overlap. In this configuration, vent openings 1051-1056 and valve openings 1061-1066 may be fully or partially opened at the adjoining surfaces 1058, 1067. This configuration is referred to as an alignment position, in which the vent opening and the valve opening are aligned such that the vent opening is at least partially open. A venting pathway is defined by a passage way for sound waves through at least one of vent openings 1051-1056 and at least one of valve openings 1061-1066. The venting pathway is provided outside of sound conduit chamber 1031. The venting pathway extends in parallel to central axis 640. A venting inlet to the venting pathway is formed by at least one of valve openings 1061-1066 at second end surface 1068 of side wall 1073. A venting outlet from the venting pathway is formed by at least one of vent openings 651-655 at first end surface 1057 of annular projection 1050.

Valve openings 1061-1066 are equidistantly spaced from central axis 640 of sound conduit 1030, in particular such that valve openings 1061-1066 are provided at the same radial distance from central axis 640 as vent openings 1051-1056. Valve openings 1061-1066 may have a substantially identical shape. In some instances, valve openings 1061-1066 have a substantially identical shape as compared to vent openings 1051-1056. In some instances, valve openings 1061-1066 are smaller as compared to vent openings 1051-1056. In some instances, valve openings 1061-1066 are larger as compared to vent openings 1051-1056. For instance, valve openings 1061-1066 are circular. In some instances, the same number of valve openings 1061-1066 is provided as vent openings 1051-1056. In some instances, more or less valve openings 1061-1066 are provided than vent openings 1051-1056.

Figure 10A:
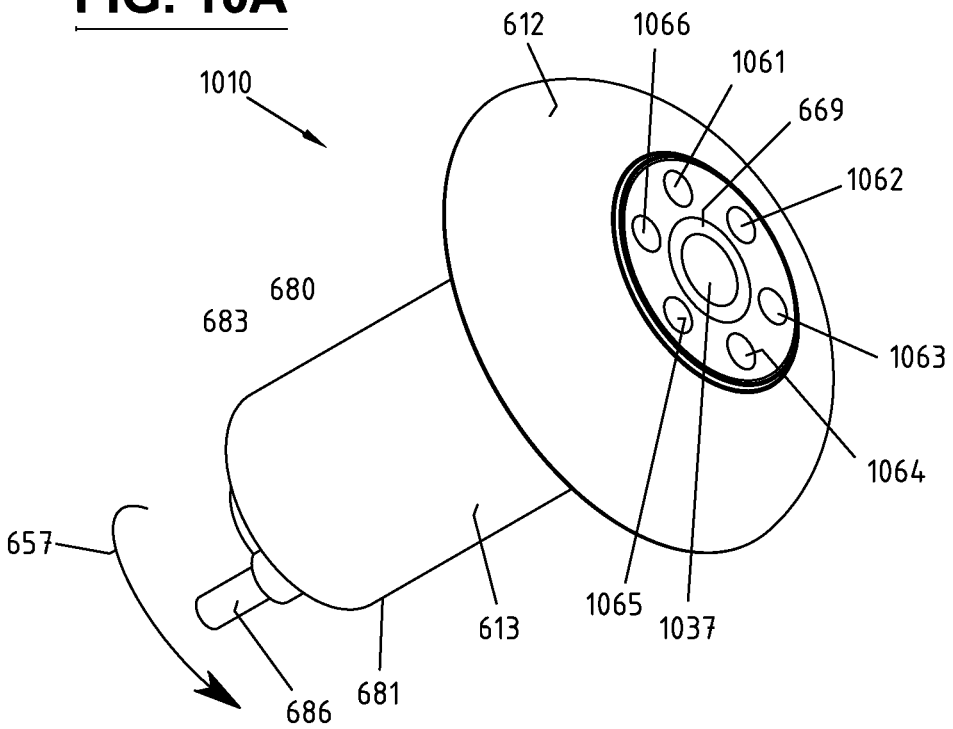
FIG. 10A is a perspective view showing details of a hearing device with variable venting, in accordance with some embodiments of the present disclosure.
Figure 10B:
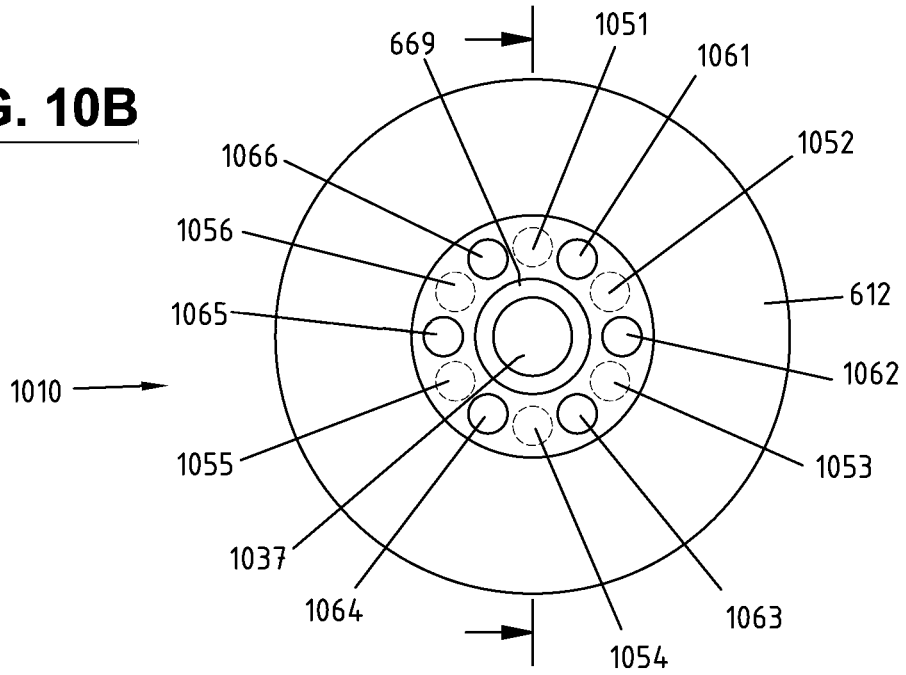
FIG. 10B is a frontal view showing details of the hearing device shown in FIG. 10A.
Figure 10C:
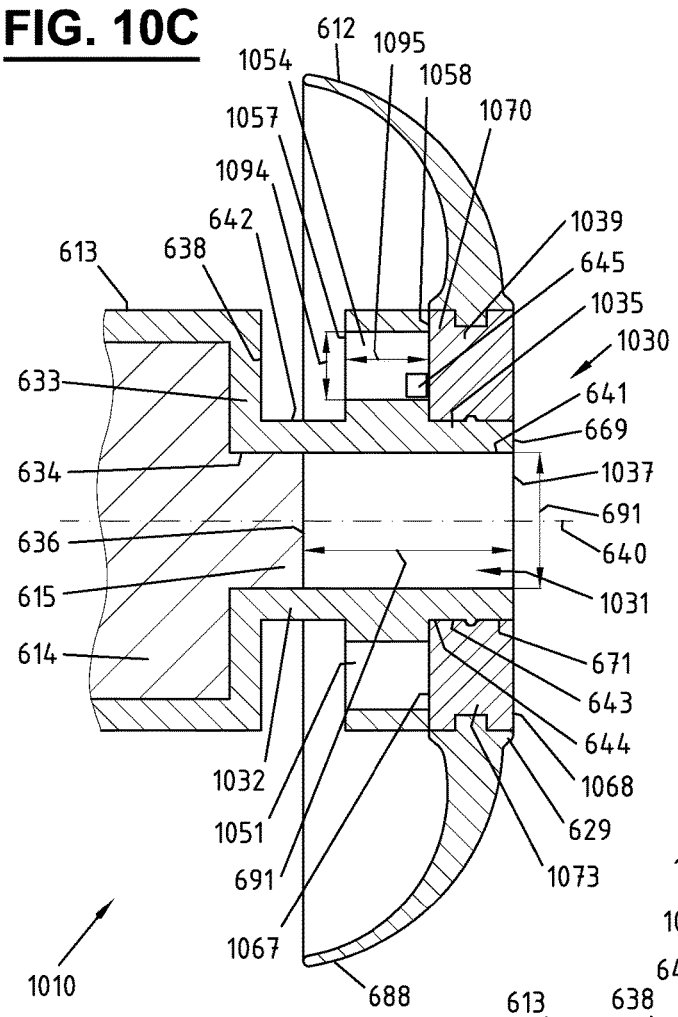
FIGS. 10C, D are lateral sectional views showing details of the hearing device shown in FIGS. 10A and 10B.
Figure 10D:
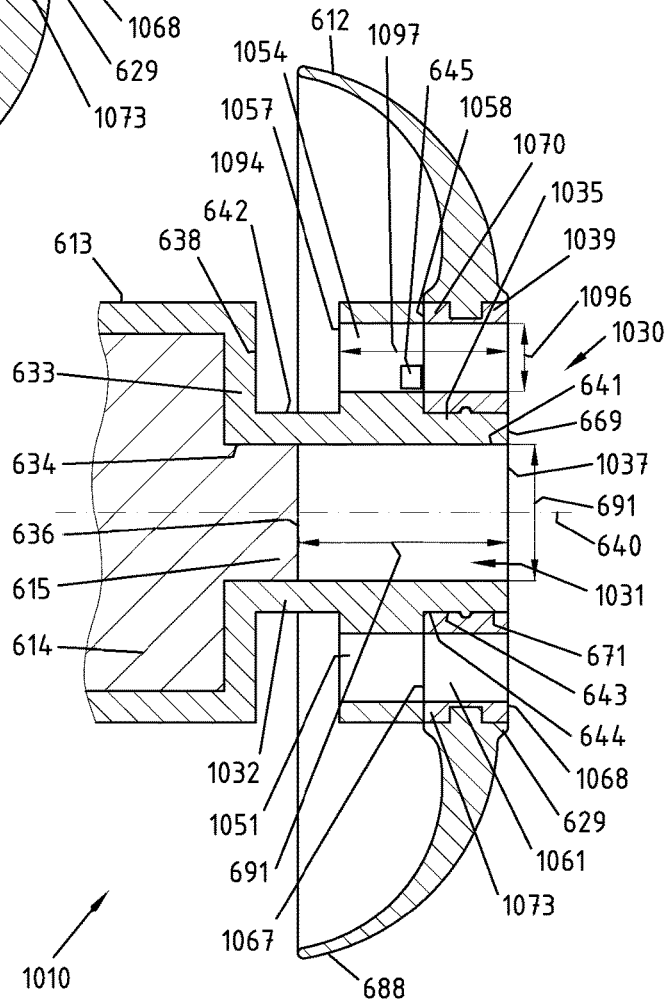

Vent openings 1051-1056 are thus configured to be opened, in particular in a relative position of vent openings 1051-1056 at which valve openings 1061-1066 are disposed at a same circumferential position than vent openings 1051-1056 such that at least one of a size of vent openings 1051-1056 and a size of valve openings 1061-1066 is fully uncovered, in particular corresponding to a full opening of vent openings 1051-1056 in which vent openings 1051-1056 are fully aligned with valve openings 1061-1066. Such an alignment position is illustrated in FIG. 10D. Vent openings 1051-1056 are further configured to be closed, in particular in a relative position of vent openings 1051-1056 at which valve openings 1061-1066 are disposed at a different circumferential position than vent openings 1051-1056 such that at least one of a size of vent openings 1051-1056 and a size of valve openings 1061-1066 is fully covered, in particular corresponding to a full closing of vent openings 1051-1056 in which vent openings 1051-1056 are not aligned with valve openings 1061-1066. The closed position is illustrated in FIGS. 10A-C. Vent openings 1051-1056 are further configured to be adjusted, in particular by changing relative positions in which vent openings 1051-1056 and valve openings 1061-1066 are at least partially overlapping such that at least one of a size of vent openings 1051-1056 and a size of valve openings 1061-1066 is increasingly covered or uncovered, in particular corresponding to a change of an overlapping size of vent openings 1051-1056 and valve openings 1061-1066 in which vent openings 1051-1056 are partially aligned with valve openings 1061-1066 and thus are in an alignment position.

An external venting distance 1097 of the sound conduit is defined as a distance in the sound conduit in between the venting inlet and the venting outlet, in particular in parallel to central axis 640. In particular, the external venting distance 1097 is defined as the distance in between at least one of the valve openings 1061-1066 at second end surface 1068 and at least one of the vent openings 1061-1056 at first end surface 1057. External venting distance 1097 is thus a measure of a length of an acoustic pathway for a venting of sound waves independent of the acoustic pathway provided through sound conduit 1030. An advantageous value for a low acoustic impedance in the external venting pathway can be provided by a comparatively small value of external venting distance 1097 with respect to diameter 1096 of valve openings 1061-1066 and/or diameter 1094 of vent openings 1051-1056. For example, external venting distance 1097 in device 1010 corresponds to not more than three times, twice, or once of diameter 1096 of valve openings 1061-1066 and/or diameter 1094 of vent openings 1051-1056.

Figure 11A:
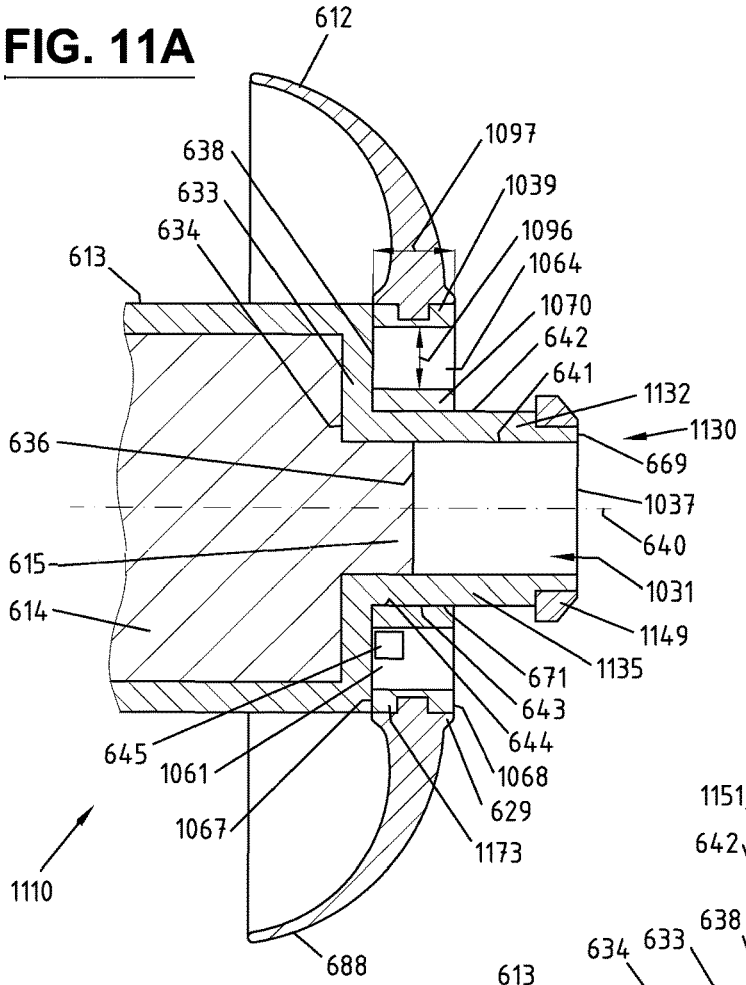
FIGS. 11A, B are lateral sectional views showing details of a hearing device with variable venting, in accordance with some embodiments of the present disclosure.
Figure 11B:
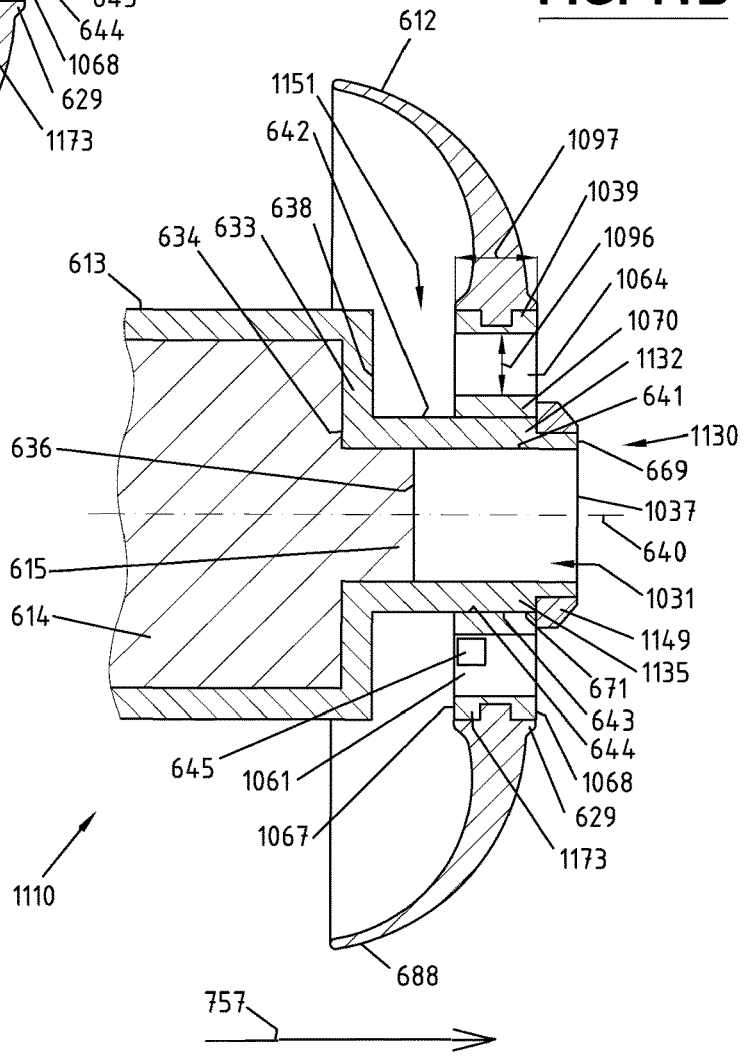

FIGS. 11A and 11B illustrate a hearing device 1110 with an adjustable vent, in accordance with some embodiments of the present disclosure. Corresponding features with respect to previously described embodiments are illustrated by the same reference numerals. In particular, a sound conduit 1130 of device 1110 comprises features of embodiments of sound conduit 1030 illustrated by device 1010 in FIGS. 10A-10D with a difference that sound conduit 1130 comprises a conduit housing 1132 having a side wall 1135 at which annular projection 1050 is not provided. No vent openings 1051-1056 in annular projection 1050 are thus provided. Instead, a vent opening 1151 can be provided by an open space in the direction of central axis 640 in between end wall 633 of conduit housing 1132 and first end surface 1067 of side wall 1073 of valve member 1070, as depicted in FIG. 11B. Outer surface 642 of side wall 1135 of conduit housing 1132 substantially extends in parallel to central axis 640. Side wall 1135 defines a conduit wall, the conduit wall 1135 configured to provide for travelling of sound waves along central axis 640. Sound conduit chamber 1031 is delimited by conduit wall 1135.

Another difference of sound conduit 1130 with respect to embodiments of sound conduit 1030 is that inner surface 671 of a side wall 1073 of valve member 1070 is provided on outer surface 642 of side wall 1135 of conduit housing 1132 in such a way, that the moveable coupling in between coupling surfaces 643, 644 is configured for a translational relative motion of conduit housing 1132 and valve member 1070. Such a translational motion is indicated by an arrow 757 in FIG. 11B. In some instances, the relative motion comprises a sliding movement of coupling surface 643 of conduit housing 1132 along coupling surface 644 of valve member 1070 and/or a sliding movement of coupling surface 644 of valve member 1070 along coupling surface 643 of conduit housing 1132. The sliding movement comprises a longitudinal motion, in particular in parallel to central axis 640 of sound conduit 1130. Actuator 645 is provided outside conduit housing 1132, in particular at valve member 1070. Actuator 645 is configured to activate the relative motion of conduit housing 1132 with respect to valve member 1070.

A spatial restriction of the translational motion is provided by end wall 633 of conduit housing 1132 provided at an axial position of first end 638 of sound conduit 1130. Another spatial restriction of the translational motion is provided by an outer edge 1149 of conduit housing 1132 provided at an axial position of second end 669 of sound conduit 1130.

Outer edge 1149 extends around a circumference of conduit housing 1132 and thus provides a circumferential edge. End wall 633 of conduit housing 1132 faces first end surface 1067 of side wall 1073 of valve member 1070 and thus provides a stop for the translational motion when first end surface 1067 abuts against end wall 633. Outer edge 1149 of conduit housing 1132 faces second end surface 1068 of side wall 1073 of valve member 1070 and thus provides a stop for the translational motion when second end surface 1068 abuts against outer edge 1149. In some instances, end wall 633 and outer edge 1149 of conduit housing 1132 are coated with a damping material at an outer surface facing valve member 870 such that the stops are provided with a damping material at both end positions of said relative motion. In this way, a damping of an impact of valve member 770 can be provided at the stops at the end of said relative motion at both end positions of said relative motion. The damping material comprises an elastomer.

Valve openings 1061-1066 are provided such that during the course of translational motion 757 of conduit housing 1132 relative to valve member 1070, valve openings 1061-1066 can be provided at different axial positions with respect to central axis 640. In an axial position at which valve member 1070 arrives at a first end position of the translational motion, in particular by abutting against end wall 633 of conduit housing 1132 as depicted in FIG. 11A, vent opening 1151 is fully closed, in particular by a substantially non-existent space in between end wall 633 of conduit housing 1132 and first end surface 1067 of valve member side wall 1073 in the direction of central axis 640. This configuration is referred to as a closed position of vent opening 1151. In an axial position at which valve member 1070 arrives at a second end position of the translational motion, in particular by abutting against outer edge 1149 of conduit housing 1132 as depicted in FIG. 11B, vent opening 1151 is open by a maximal spacing in between end wall 633 of conduit housing 1132 and first end surface 1067 of valve member side wall 1073 in the direction of central axis 640. The term maximal spacing may relate to a greatest possible spacing during said relative motion. This configuration is referred to as a fully opened position of vent opening 1151. Vent opening 1151 may be partially open by varying the spacing in between end wall 633 of conduit housing 1132 and first end surface 1067 of valve member side wall 1073 in between the fully opened position and the closed position. This configuration is referred to as an partially opened position of vent opening 1151.

A venting pathway in sound conduit 1130 is defined by a passage way for sound waves through at least one of valve openings 1061-1066. A venting inlet to the venting pathway is formed by at least one of valve openings 1061-1066 at second end surface 1068 of side wall 1073. A venting outlet from the venting pathway is formed by at least one of valve openings 1061-1066 at first end surface 1067 of side wall 1073. External venting distance 1097 of the sound conduit is defined as a distance in the sound conduit in between the venting inlet and the venting outlet, in particular in parallel to central axis 640. In particular, the external venting distance 1097 is defined as the distance in between second end surface 1068 and first end surface 1067 of valve openings 1061-1066, corresponding to a length 1095 of valve openings 1061-1066 extending in parallel to central axis 640 of sound conduit 1130. An advantageous value for a low acoustic impedance in the external venting pathway may be provided by a value of external venting distance 1097 in device 1110 corresponding to not more than fifteen times, in particular ten times or five times, of diameter 1096 of valve openings 1061-1066.

Figure 12A:
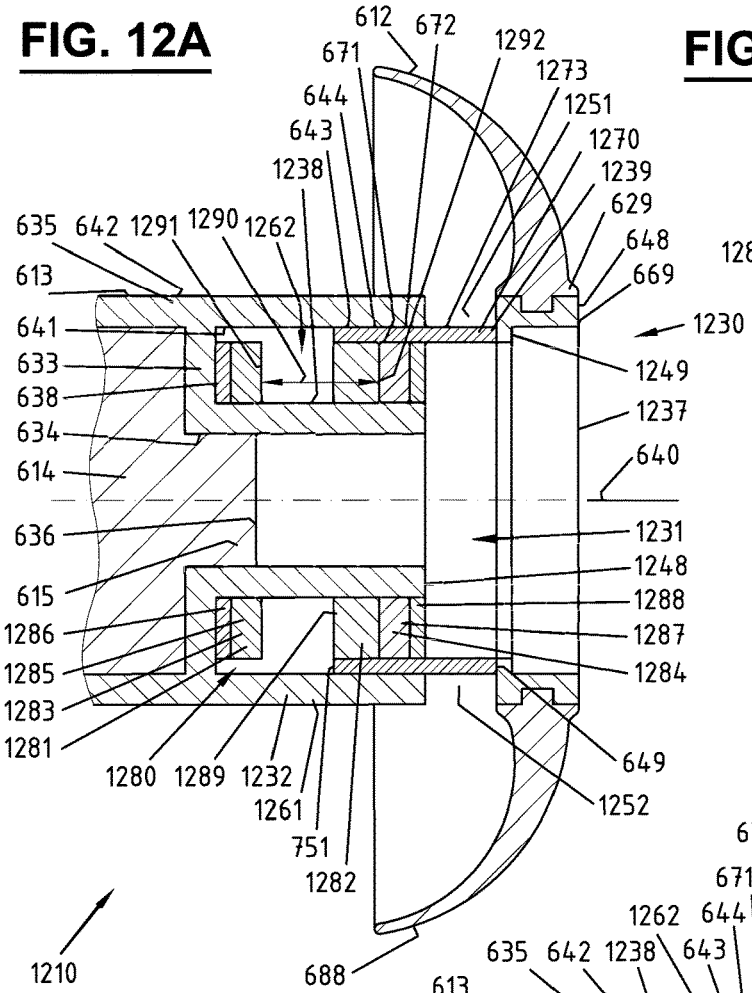
FIGS. 12A, B are lateral sectional views showing details of a hearing device with variable venting, in accordance with some embodiments of the present disclosure.
Figure 12C:
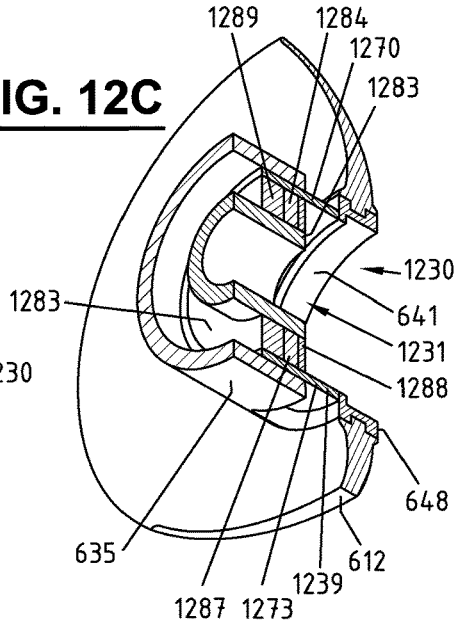
FIG. 12C is a perspective view of a lateral section of the hearing device illustrated in FIGS. 12A and 12B.
Figure 12B:
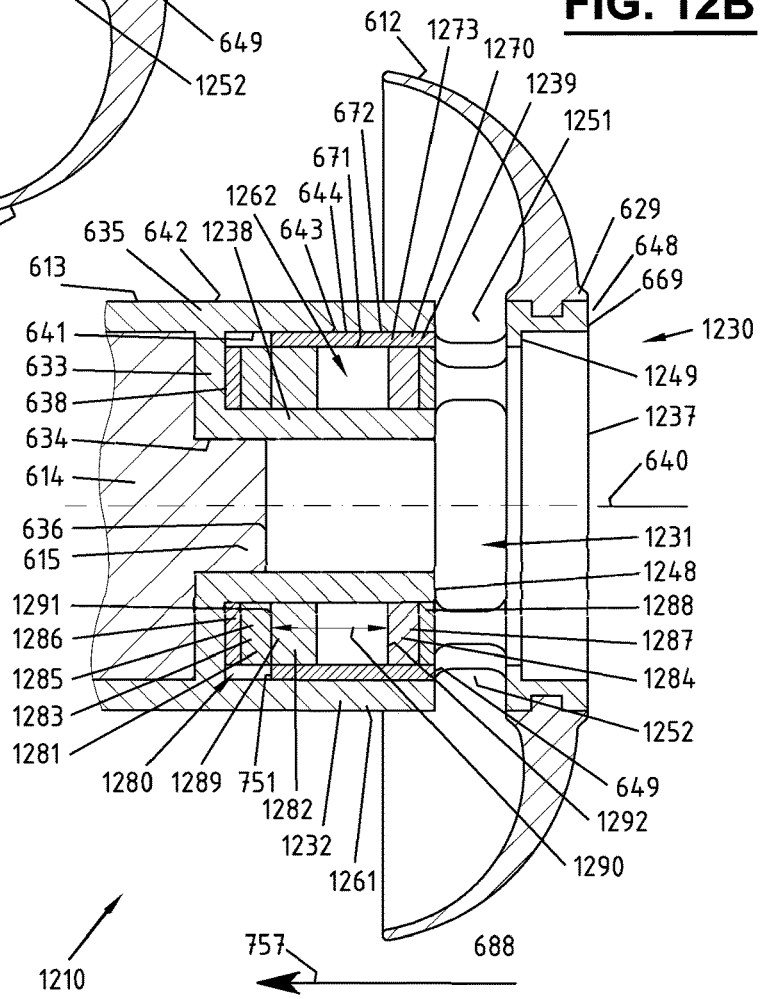

FIGS. 12A, 12B, and 12C illustrate a hearing device 1210 with an adjustable vent, in accordance with some embodiments of the present disclosure. Corresponding features with respect to previously described embodiments are illustrated by the same reference numerals. In particular, a sound conduit 1230 of device 1210 comprises features of embodiments of sound conduit 730 illustrated by device 710 in FIGS. 7A and 7B and/or of embodiments of sound conduit 830 illustrated by device 810 in FIGS. 8A and 8B, wherein some differences to these embodiments are subsequently described. Sound conduit 1230 comprises a conduit housing 1232 and an acoustic valve 1239 including a valve member 1270. Side wall 635 of conduit housing 1232 extends from first end 638 to second end 669 of sound conduit 1230, in particular in parallel to central axis 640, such that outer end 648 of conduit housing 1232 is provided at second end 669 of sound conduit 1230. Outer end 648 of conduit housing 1232 is open, such that a housing opening 1237 is delimited by inner surface 641 of side wall 635 of conduit housing 1232 at outer end 648. The housing opening provides a second opening 1237 of sound conduit 1230 at second end 669 of sound conduit 1230. Second opening 1237 is configured to provide for output of sound waves from a sound conduit chamber 1231 provided inside conduit housing 1232. Conduit housing 1232 is provided between first opening 636 of sound conduit 1230 and second opening 1237 of sound conduit 1230. Contact member 612 of sealing mechanism 629 is provided on conduit housing 1232, in particular on outer surface 642 of side wall 635, in proximity to second end 669. Vent openings 1251, 1252 are formed in side wall 635 of conduit housing 1232. Vent openings 1251, 1252 are provided at an axial position between second end 669 and first end 638 of sound conduit 1230, more particularly between a position of contact member 612 on conduit housing side wall 635 and first end 638 of sound conduit 1230. Vent openings 1251, 1252 are oriented toward central axis 640. In particular, vent openings 1251, 1252 are facing central axis 640. Vent openings 1251, 1252 are provided as through holes in side wall 635 of conduit housing 1232. For example, vent openings 1251, 1252 have a substantially rectangular shape comprising rounded corners, wherein many other shapes are conceivable.

An inner side wall 1238 of conduit housing 1232 is provided at end wall 633 of conduit housing 1232, in particular at the position of through hole 634 formed in end wall 633. Inner side wall 1238 is provided at a closer radial distance to central axis 640 than side wall 635. Side wall 635 thus provides an outer side wall of conduit housing 1232. Inner side wall 1238 extends from through hole 634 provided at first end 638 of sound conduit 1230 in parallel to central axis 640. First opening 636 of sound conduit 730 is provided at through hole 634 and/or at an inner surface of inner side wall 1238. Inner side wall 1238 extends between first end 638 of sound conduit 1230 and an axial position inside conduit housing 1232, at which axial position vent openings 1251, 1252 are provided. In particular, inner side wall 1238 does not reach into the axial position of vent openings 1251, 1252 with respect to central axis 640. In particular, an open end 1248 of inner side wall 1238 is provided in front of the axial position of vent openings 1251, 1252 with respect to central axis 640 and in a direction at which sound waves from sound source 614 propagate in sound conduit chamber 1231. Side wall 635 extends from first end 638 of sound conduit 1230 beyond the axial position of open end 1248 of inner side wall 1238 to second end 669 of sound conduit 1230. In this way, sound conduit chamber 1231 is partially delimited by inner side wall 1238 and, in particular starting from an axial position at which vent openings 1251, 1252 are provided in conduit housing 1232 toward second end 669 of sound conduit 1230, partially delimited by side wall 635. Side walls 635, 1238 each define a conduit wall, the conduit walls 635, 1238 configured to provide for travelling of sound waves along central axis 640. A venting pathway in sound conduit 1230 is defined by a passage way for sound waves from second opening 1237 through sound conduit chamber 1231 out of at least one of vent openings 1251, 1252. A venting inlet in sound conduit 1230 to the venting pathway is formed by second opening 1237. A venting outlet in sound conduit 1230 from the venting pathway is formed by at least one of vent openings 1251, 1252.

Valve member 1270 is provided by a side wall 1273. Side wall 1273 is continuously solid along its surfaces 671, 672, in particular not comprising any openings such as valve openings on 671, 672. A valve opening corresponding to previously described embodiments may be defined by an empty space surrounding side wall 1273, by which empty space valve member 1270 is not closing or only partially closing vent openings 1251, 1252, at least in some relative positions of said relative motion, as further explained below. Valve member 1270 is provided as a bushing, in particular a cylindrical bushing. Side wall 1273 thus forms a substrate provided at side wall 635 of conduit housing 1232. In particular, outer surface 672 of side wall 1273 of valve member 1270 is provided on inner surface 641 of side wall 635 of conduit housing 1232, such that coupling surfaces 643, 644 for said relative motion are provided.

Coupling surfaces 643, 644 are configured such that a translational motion, in particular a sliding movement, of conduit housing 1232 relative to valve member 1270 along coupling surfaces 643, 644 can be provided. The sliding movement comprises a longitudinal motion, in particular in parallel to central axis 640 of sound conduit 1230. A spatial restriction of the translational motion is provided by a protruding edge 1249 provided at inner surface 641 of side wall 635 of conduit housing 1232. Protruding edge 1249 provides a stop for the translational motion when outer end 649 of valve member 770 abuts against protruding edge 1249. In some instances, protruding edge 1249 is coated with a damping material at an inner surface facing valve member 1270 such that the stop comprises a damping material. In this way, a damping of an impact of valve member 770 can be provided at the stop at the end of said relative motion. The damping material comprises an elastomer. During the course of translational motion 757 of valve member 1270, valve member 1270 can be provided at different axial positions with respect to central axis 640, in particular at varying axial positions with respect to vent openings 1251, 1252. In this way, a closed position as depicted in FIGS. 12A and 12C, and an alignment position, in particular an opened position, as depicted in FIG. 12B, of vent openings 1251, 1252 can be provided, in accordance with other embodiments described above. The alignment position is defined as a position, in which valve member 1270 does not fully close vent openings 1251, 1252 such that an empty space surrounding valve member 1270 is at least partially aligned with vent openings 1251, 1252. The empty space surrounding valve member 1270 may thus provide a valve opening in accordance with previously described embodiments.

A space provided in between inner side wall 1238 and outer side wall 635 of conduit housing 1232 is configured as a chamber in which an actuator for said relative motion can be provided. Inner side wall 1238 and outer side wall 635 thus define an actuator housing 1261 by which an actuator chamber 1262 is delimited. An actuator 1280 is provided in actuator chamber 1262 inside actuator housing 1261. A first end of actuator housing 1280 is closed by end wall 633 at first end 638 of sound conduit 1230. A second end of actuator housing 1280 is open at the axial position of open end 1248 of inner side wall 1238. The first end of actuator housing 1261 and the second end of actuator housing 1261 are spaced apart in a direction parallel to central axis 640. Actuator 1280 is configured to activate said relative motion of valve member 1270 and conduit housing 1232. Actuator 1280 is configured to move valve member 1270. Actuator 1280 is arranged at an axial position in between first end 638 of sound conduit 1230 and vent openings 1251, 1252. Actuator 1280 is an electrical actuator. Actuator 1280 is thus configured to activate said relative motion in dependence of an electrical signal provided to the actuator. The electrical signal may be provided by input circuitry 16. Actuator 1280 is configured to provide a magnetic field, by which magnetic field a driving force for said relative motion is provided.

Actuator 1280 comprises a first driving part 1281 connected to conduit housing 1232. Actuator 1280 comprises a second driving part 1282 connected to valve member 1270. First driving part 1281 and second driving part 1282 are configured to interact via a magnetic field. First driving part 1281 comprises two magnetic members 1283, 1284. Magnetic members 1283, 1284 are spaced from one another at a spacing distance 1290 and configured to provide for the magnetic interaction along spacing distance 1290. Magnetic members 1283, 1284 each comprise a pole surface 1291, 1292 of a magnetic pole. Pole surfaces 1291, 1292 are configured such that flux lines of a magnetic field can emanate on pole surfaces 1291, 1292. Pole surfaces 1291, 1292 are facing each other on both ends of spacing distance 1290. Magnetic members 1283, 1284 are thus configured to provide a magnetic field comprising flux lines permeating the spacing space provided in between pole surfaces 1291, 1292 of magnetic members 1283, 1284. The magnetic field extends through spacing distance 1290. Spacing distance 1290 extends in the direction in which said relative translational motion is provided. In particular, spacing distance 1290 extends in parallel to side wall 635, more particularly in parallel to inner surface 641. In particular, spacing distance 1290 extends in parallel to central axis 640. A first end of spacing distance 1290 is arranged closer to first end 638 of sound conduit 1230 than a second end of spacing distance 1290. The second end of spacing distance 1290 is arranged closer to second end 669 of sound conduit 1230 than the first end of the spacing distance 1290.

Magnetic members 1283, 1284 are attached to conduit housing 1232. First magnetic member 1283 is arranged at the first end of actuator housing 1261, in particular at first end 638 of sound conduit 1230. First magnetic member 1283 is provided at end wall 633 of conduit housing 1232. Second magnetic member 1284 is arranged at the second end of actuator housing 1261, in particular at an axial position in between first end 638 of sound conduit 1230 and vent openings 1251, 1252. Second magnetic member 1284 is provided at an axial position in proximity to open end 1248 of inner side wall 1238. Each of first magnetic member 1283 and second magnetic member 1284 comprises a magnet 1285, 1287 configured to generate a magnetic field. Each of first magnetic member 1283 and second magnetic member 1284 further comprises a magnetizable element 1286, 1288 formed from a magnetizable material. In particular, magnetizable element 1286, 1288 may be provided by a ferromagnetic element. Magnetizable element 1286, 1288 is positioned in proximity to magnet 1285, 1287 in each magnetic member 1283, 1284 such that magnetizable elements 1286, 1288 are configured to be magnetized by corresponding magnet. Magnetizable elements 1286, 1288 are arranged such that they are facing the first end and the second end of actuator housing 1261. Magnets 1285, 1287 are arranged such that they are facing each other at spacing distance 1290 of magnetic members 1283, 1284. In some other embodiments, magnets 1285, 1287 are facing the first end and the second end of actuator housing 1261 and magnetizable elements 1286, 1288 are facing each other at spacing distance 1290 of magnetic members 1283, 1284.

Second driving part 1282 comprises a magnetic member 1289. Magnetic member 1289 is arranged within spacing distance 1290 of magnetic members 1283, 1284 of first driving part 1281. Magnetic member 1289 of second driving part 1282 is thus configured to magnetically interact with magnetic members 1283, 1284 of first driving part 1281 along spacing distance 1290 of magnetic members 1283, 1284 such that a magnetic force can be transmitted from each of magnetic members 1283, 1284 of first driving part 1281 to magnetic member 1289 of second driving part 1282. Magnetic member 1289 of second driving part 1282 is attached to valve member 1270. Magnetic member 1289 comprises different magnetic poles.

Magnetic member 1289 is provided on valve member 1270 such that one of the magnetic poles is facing first magnetic member 1283 of first driving part 1281 and the other of the that magnetic poles is facing second magnetic member 1284 of first driving part 1281. Magnetic member 1289 is arranged at inner surface 671 of valve member side wall 1273. Magnetic member 1289 is provided at inner end 751 of valve member 1270. Valve member 1270 protrudes from magnetic member 1289 in parallel to central axis 640 toward second end 669 of sound conduit 1230. Valve member 1270 is configured to close vent openings 1251, 1252 in an axial position of magnetic member 1289 at which magnetic member 1289 is positioned at the second end of spacing distance 1290 of magnetic members 1283, 1284 of first driving part 1281, in particular in which axial position magnetic member 1289 abuts against one of magnetic members 1283, 1284 of first driving part 1281. This configuration is illustrated in FIGS. 12A and 12C. Valve member 1270 is configured to open vent openings 1251, 1252 in an axial position of magnetic member 1289 at which magnetic member 1289 is positioned at the first end of the spacing distance 1290 of magnetic members 1283, 1284 of first driving part 1281, in particular in which axial position magnetic member 1289 abuts against the other of magnetic members 1283, 1284 of first driving part 1281. This configuration is illustrated in FIG. 12B. Magnetic member 1289 of second driving part 1282 comprises a magnet. In particular, the magnet may be provided as a permanent magnet.

Magnets 1285, 1287 of first driving part 1281 comprise a conductor configured to be supplied with a current, by which current a magnetic field within spacing distance 1290 can be provided and/or changed. The current may be controlled by input circuitry 16. In particular, the conductor of magnets 1285, 1287 can be provided by a coil, more particularly solenoids. By selectively controlling the magnetic field of magnets 1285, 1287, in particular by controlling the current flowing through the conductor of magnets 1285, 1287, a predominant magnetic force from one of magnets 1285, 1287 of first driving part 1281 can be transmitted to magnetic member 1289 of second driving part 1282. In this way, magnetic member 1289 of second driving part 1282 can be moved in between magnetic members 1283, 1284 of first driving part 1281 within spacing distance 1290, depending on which of magnetic members 1283, 1284 may provide the predominant magnetic force within spacing distance 1290. In this way, actuator 1280 can be configured to selectively activate a direction of said relative translational motion by at least one of: providing or increasing a current flowing through one of magnetic members 1283, 1284 of first driving part 1281; disabling or reducing a current flowing through one of magnetic members 1283, 1284 of first driving part 1281; and changing a direction of the current flowing through at least one of magnetic members 1283, 1284 of first driving part 1281.

Each magnetizable element 1286, 1288 is positioned in a range of respective magnet 1285, 1287 of first driving part 1281. Thus, providing and/or changing a magnetic field of at least one of magnets 1285, 1287 will provide and/or change a magnetic field in the magnetizable element 1286, 1288 associated with magnets 1285, 1287 by magnetic induction. In this way, at least a part of the magnetic field provided and/or changed in magnets 1285, 1287 can be stored in the associated magnetizable element 1286, 1288, in particular after turning off the magnetic field provided in magnet 1285, 1287. For instance, magnets 1285, 1287 may be provided as coils and a current flowing through the coils may be turned off, such that a corresponding magnetic field in the coils is also turned off. The magnetic field, however, can be further provided after turn off of the coils by the associated magnetizable element 1286, 1288 which has been magnetized by magnetic induction from the coils before they were turned off. In this way, a reliable and energy-saving activation of said relative motion can be provided. Beyond that, a retention force for a retention of the valve member and the conduit housing in a relative position before and/or after said relative motion can thus be provided by the magnetic field from the associated magnetizable element 1286, 1288. Moreover, by providing magnetic member 1289 of second driving part 1282 as a permanent magnet, no energy consumption is required from second driving part 1282. In this way, the reliability and efficiency can be further increased.

The conductor of at least one of magnetic members 1283, 1284 at the end positions of spacing distance 1290 may substantially only be supplied with a current during an activation time period in order to actuate said relative motion in between the end positions of spacing distance 1290. Thus, at least part of the magnetic field providing the driving force for said relative motion is provided by the conductor of magnetic member 1283, 1284 at the respective end position of spacing distance 1290, which corresponds to an end position of said relative motion of valve member 1270 and conduit housing 1232. After the activation time period, turning off the current supply of the conductor of magnetic member 1283, 1284 leads to a predominant part of the magnetic field provided by magnetizable element 1286, 1288. In this way, an energy consumption may be only required for an activation of said relative motion during the activation time period. The magnetic field provided by magnetizable element 1286, 1288 provides a retention force after said relative motion, in particular when an end position of said relative motion is reached, in which magnetic member 1289 of second driving part 1282 has reached an end position of spacing distance 1290 in which one of magnetic members 1283, 1284 of first driving part 1281 is positioned. The retention force can be employed such that valve member 1270 and conduit housing 1232 are retained in a stable position at the respective end position of said relative motion. In this way, a stability of valve member 1270 and conduit housing 1232 at such an end position of said relative motion can be provided.

The end positions of said relative motion comprise at least one relative position of valve member 1270 and conduit housing 1232 in which vent openings 1251, 1252 are at least partially open, in particular in an alignment position. In this end position, magnetic member 1289 of second driving part 1282 has reached a first end position of spacing distance 1290 at which one of magnetic members 1283, 1284 of first driving part 1281 is positioned. The end positions of said relative motion comprise at least one relative position of valve member 1270 and the conduit housing 1232 in which vent openings 1251, 1252 are at least partially closed. In this end position, magnetic member 1289 of second driving part 1282 has reached a second end position of spacing distance 1290 at which the other of magnetic members 1283, 1284 of first driving part 1281 is positioned. In each of these end positions, a stable position of first driving part 1281 and second driving part 1282 is provided by the retention force of the magnetic field provided by magnetizable element 1286, 1288 at a respective end position of spacing distance 1290, corresponding to a stable end position of said relative motion of valve member 1270 and conduit housing 1232 connected to first driving part 1281 and second driving part 1282. Thus, a bi-stability in between the end positions of said relative motion, in particular in between an alignment position of vent openings 1251, 1252 and a closed position of vent openings 1251, 1252, can be provided. The term "bi-stability" may refer to at least two stable end positions provided for said relative motion.

In some other embodiments, magnets 1285, 1287 of first driving part 1281 are provided as permanent magnets. In some of these embodiments, magnetic member 1289 of second driving part 1282 comprises a conductor configured to be supplied with a current, such that a magnetic field within spacing distance 1290 can be provided and/or changed. By selectively controlling the magnetic field of magnetic member 1289, in particular by controlling a current flowing through the conductor of magnetic member 1289, a predominant magnetic force with respect to one of magnets 1285, 1287 of first driving part 1281 can be produced in magnetic member 1289 of second driving part 1282. In this way, magnetic member 1289 of second driving part 1282 can be moved in between magnetic members 1283, 1284 of first driving part 1281 within spacing distance 1290. For instance, magnets 1285, 1287 of first driving part 1281 may be provided as permanent magnets, wherein different magnetic poles of magnets 1285, 1287 are pointing toward magnetic member 1289 of second driving part 1282. A predominant magnetic force with respect to one of magnets 1285, 1287 can then be produced in second driving part 1282 by selecting a direction of a current flowing through the conductor of magnetic member 1289. A predominant magnetic force with respect to the other of magnets 1285, 1287 of first driving part 1281 can be produced in second driving part 1282 by changing the direction of the current flowing through the conductor of magnetic member 1289. In some embodiments, magnetic member 1289 of second driving part 1282 comprises a magnetizable element. The magnetizable element is positioned in a range of a magnet of second driving part 1282 such that at least a part of the magnetic field provided and/or changed in magnetic member 1289 can be stored in the magnetizable element, in particular after turning off the magnetic field provided in magnetic member 1289.

Figure 13A:
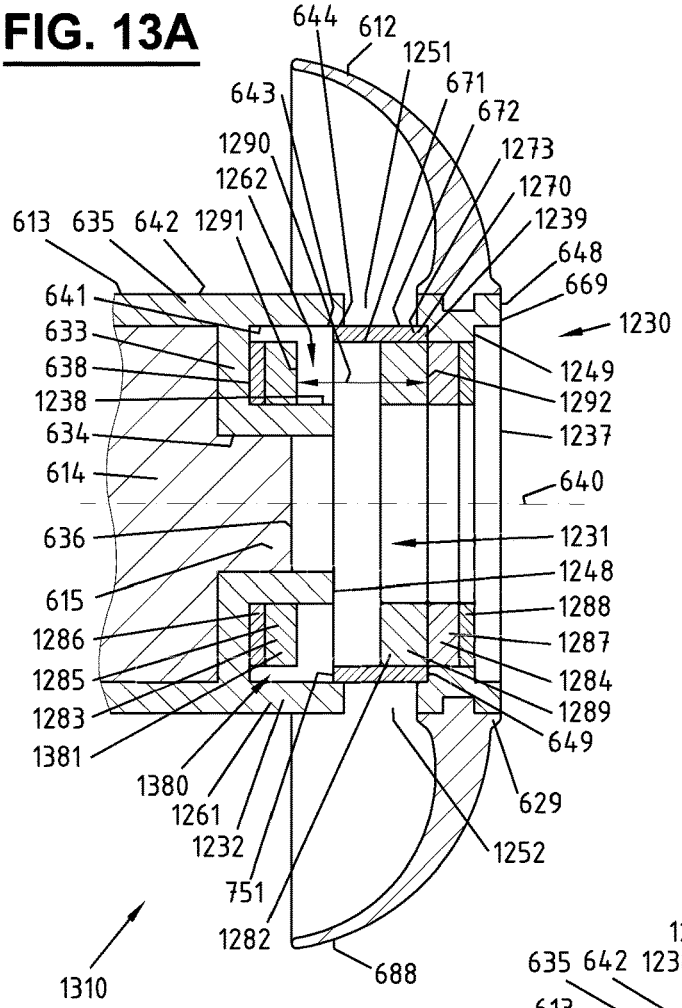
FIGS. 13A, B are lateral sectional views showing details of a hearing device with variable venting, in accordance with some embodiments of the present disclosure.
Figure 13B:
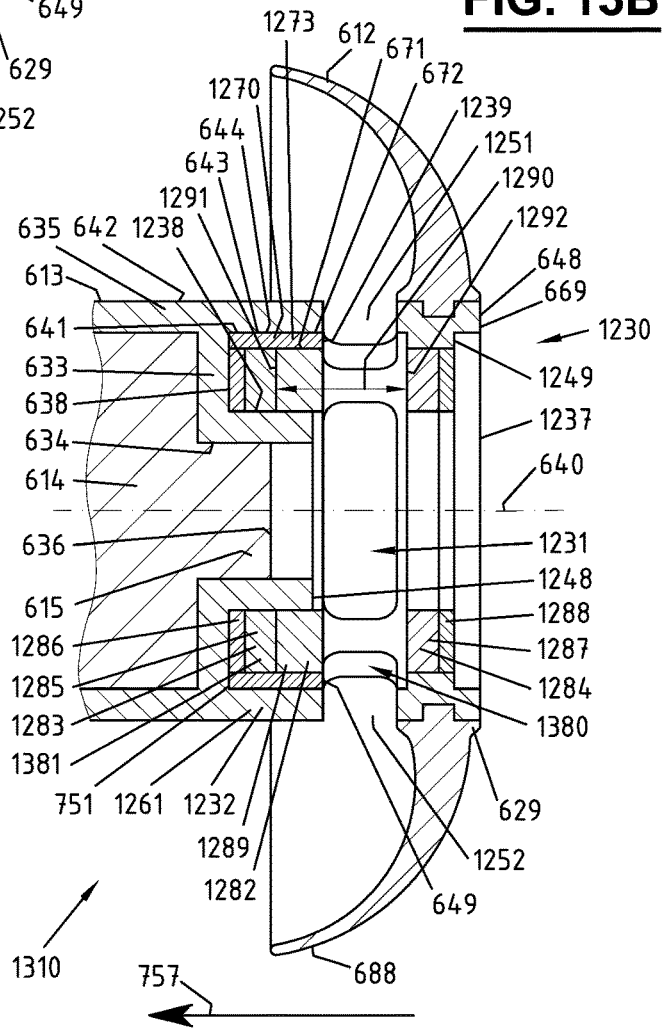

FIGS. 13A and 13B illustrate a hearing device 1310 with an adjustable vent, in accordance with some embodiments of the present disclosure. Corresponding features with respect to previously described embodiments are illustrated by the same reference numerals. In particular, an actuator 1380 of hearing device 1310 comprises features of embodiments of actuator 1280 illustrated by device 1210 in FIGS. 12A, 12B and 12C, wherein some differences to these embodiments are subsequently described. A first driving part 1381 of actuator 1380 connected to conduit housing 1232 is provided at an axial position in between first end 638 and second end 699 of sound conduit 1230 such that spacing distance 1290 of magnetic members 1283, 1284 extends over the axial position at which vent openings 1251, 1252 are provided. In particular, first magnetic member 1283 is arranged at an axial position in between first end 638 of sound conduit 1230 and vent openings 1251, 1252. Second magnetic member 1284 is arranged at an axial position in between vent openings 1251, 1252 and second end 699 of sound conduit 1230 and vent openings. Thus, second magnetic member 1284 is arranged outside the second end of actuator housing 1261. Magnetic member 1289 is provided at outer end 649 of valve member 1270, in particular at inner surface 671 of valve member side wall 1273. Valve member 1270 protrudes from magnetic member 1289 in parallel to central axis 640 toward first end 638 of sound conduit 1230. Magnetic member 1289 of second driving part 1282 is thus configured to magnetically interact with magnetic members 1283, 1284 of first driving part 1381 along spacing distance 1290 of magnetic members 1283, 1284 such that a magnetic force can be transmitted from each of magnetic members 1283, 1284 of first driving part 1381 to magnetic member 1289 of second driving part 1282. Valve member 1270 is configured to close vent openings 1251, 1252 in an axial position of magnetic member 1289 at which magnetic member 1289 is positioned at the second end of spacing distance 1290 of magnetic members 1283, 1284 of first driving part 1381, as illustrated in FIG. 13A. Valve member 1270 is configured to open vent openings 1251, 1252 in an axial position of magnetic member 1289 at which magnetic member 1289 is positioned at the first end of spacing distance 1290 of magnetic members 1283, 1284 of first driving part 1381, as illustrated in FIG. 13B.

Figure 14A:
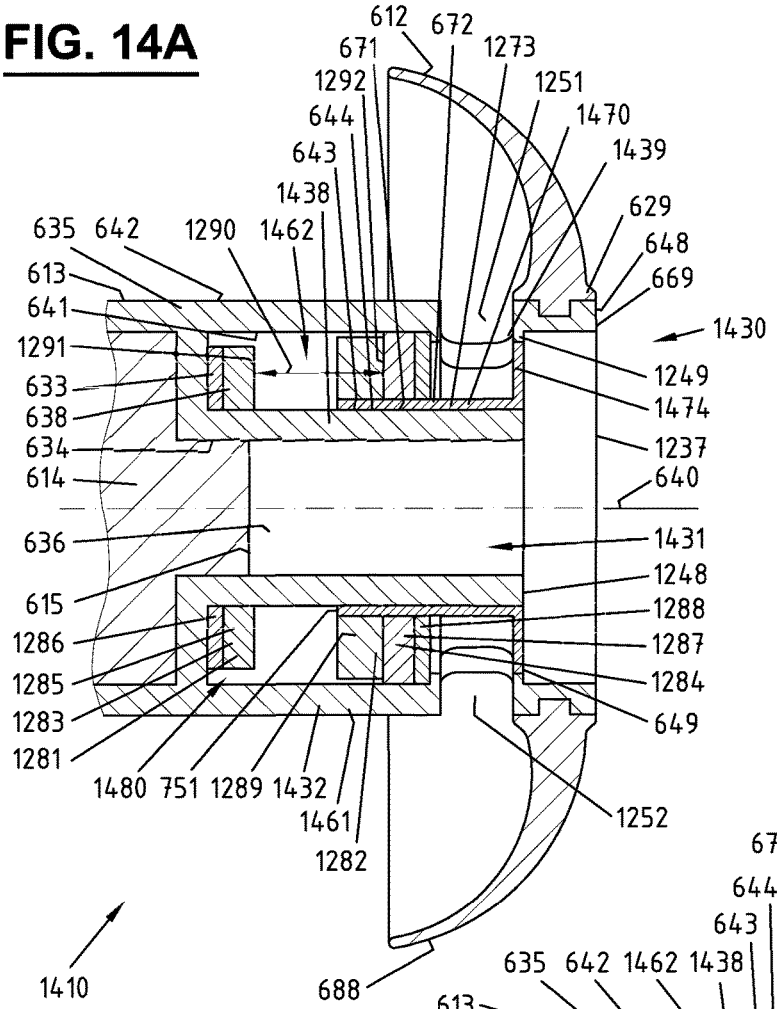
FIGS. 14A, B are lateral sectional views showing details of a hearing device with variable venting, in accordance with some embodiments of the present disclosure.
Figure 14B:
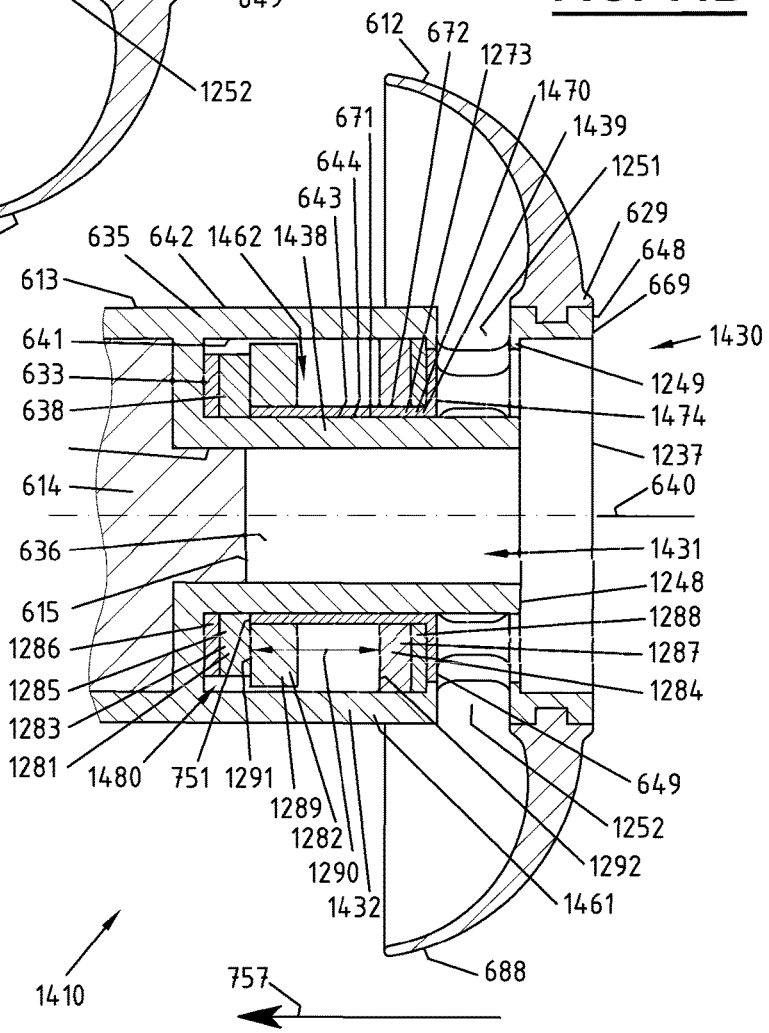

FIGS. 14A and 14B illustrate a hearing device 1410 with an adjustable vent, in accordance with some embodiments of the present disclosure. Corresponding features with respect to previously described embodiments are illustrated by the same reference numerals. In particular, a sound conduit 1430 and an actuator 1480 of hearing device 1410 comprises features of embodiments of sound conduit 1230 and actuator 1280 illustrated by device 1210 in FIGS. 12A, 12B and 12C, wherein some differences to these embodiments are subsequently described. Sound conduit 1430 comprises a conduit housing 1432 with an inner side wall 1438 extending from through hole 634 provided at first end 638 of sound conduit 1230 in parallel to central axis 640. First opening 636 of sound conduit 1430 is provided at through hole 634 and/or at an inner surface of inner side wall 1438. Inner side wall 1438 extends between first end 638 of sound conduit 1430 and an axial position inside conduit housing 1432. Inner side wall 1438 extends beyond an axial position, at which vent openings 1251, 1252 are provided. Inner side wall 1438 does not reach into housing opening 1237. Thus, open end 1248 of inner side wall 1438 has an axial distance to second end 648 of conduit housing side wall 635 delimiting housing opening 1237. Second opening of sound conduit 1430 is thus provided by housing opening 1237. Conduit housing 1432 is provided between first opening 636 of sound conduit 1430 and second opening 1237 of sound conduit 1430. Side walls 635, 1438 each define a conduit wall, the conduit walls 635, 1438 configured to provide for travelling of sound waves along central axis 640. Conduit walls 635, 1238 delimit a sound conduit chamber 1431. A venting pathway in sound conduit 1430 is defined as a passage way for sound waves from second opening 1237 through sound conduit chamber 1431, including a first passage part through a chamber portion in front of open end 1248 of inner side wall 1438 and a second passage part through a chamber formed in between inner side wall 1438 and outer side wall 635, out of at least one of vent openings 1251, 1252. A venting inlet in sound conduit 1430 to the venting pathway is formed by second opening 1237. A venting outlet in sound conduit 1430 from the venting pathway is formed by at least one of vent openings 1251, 1252.

An acoustic valve 1439 comprises a valve member 1470 provided at inner side wall 1438 of conduit housing 1432. Valve member 1470 comprises side wall 1273 extending in parallel to central axis 640. Inner surface 671 of side wall 1273 of valve member 1470 is provided on an outer surface of inner side wall 1438 of conduit housing 1232, such that coupling surfaces 643, 644 for said relative motion are provided. Coupling surfaces 643, 644 are configured such that a translational relative motion, in particular a sliding movement, of valve member 1270 relative to conduit housing 1232 along coupling surfaces 643, 644 can be provided. The sliding movement comprises a longitudinal motion, in particular in parallel to central axis 640 of sound conduit 1430. Valve member 1470 comprises an end wall 1474 provided on outer surface 672 of side wall 1273 of valve member 1470 at outer end 649 of valve member 1470. End wall 1474 radially projects from outer surface 672 of side wall 1273 of valve member 1470 in an opposed direction with respect to a centre formed by central axis 640. End wall 1474 extends from outer surface 672 of side wall 1273 of valve member 1470 to inner surface 641 of side wall 635 of conduit housing 1432. End wall 1474 delimits a space provided in between outer surface 672 of side wall 1273 of valve member 1470 and inner surface 641 of side wall 635 of conduit housing 1432 toward second end 669 of sound conduit 1430. End wall 1474 is thus configured to close the space provided in between inner side wall 1438 and outer side wall 635 toward second end 669 of sound conduit 1430. End wall 1474 is an annular member. In particular, end wall 1474 is ring-shaped. End wall 1474 is configured to be positioned in a first axial position in between first end 638 of sound conduit 1430 and vent openings 1251, 1252, as illustrated in FIG. 14B. End wall 1474 is configured to be positioned in a second axial position in between vent openings 1251, 1252 and second end 638 of sound conduit 1430, as illustrated in FIG. 14A. In the second axial position, vent openings 1251, 1252 are closed. In particular, the venting pathway is obstructed by end wall 1747. In the first axial position, vent openings 1251, 1252 are open. In particular, the venting pathway is unblocked by end wall 1747. End wall 1474 is configured to be moved in between the first axial position and the second axial position during said relative motion of valve member 1470.

An actuator chamber 1462 is provided by a space provided in between inner side wall 1438 and outer side wall 635 of conduit housing 1432. Actuator 1480 is provided in actuator chamber 1462 inside an actuator housing 1461. Actuator housing 1461 comprises inner side wall 1438 and a portion of outer side wall 635 of conduit housing 1432. Actuator housing 1461 extends from first end 638 of sound conduit 1430 beyond an axial position, at which vent openings 1251, 1252 are provided. Actuator chamber 1462 thus provides a part of the venting pathway, as described above. Spacing distance 1290 in between magnetic members 1283, 1284 of first driving part 1281 is provided in between first end 638 of sound conduit 1430 and the axial position, at which vent openings 1251, 1252 are provided. First magnetic member 1283 is provided at end wall 633 of conduit housing 1432. Second magnetic member 1284 is provided at an axial position in proximity to vent openings 1251, 1252. Magnetic member 1289 of second driving part 1282 is arranged within spacing distance 1290 of magnetic members 1283, 1284 of first driving part 1281. Magnetic member 1289 of second driving part 1282 is attached to valve member 1270 at outer surface 672 of valve member side wall 1273. Valve member 1270 is thus configured to open and/or close vent openings 1251, 1252 depending at which axial position magnetic member 1289 of second driving part 1282 is positioned within spacing distance 1290 of magnetic members 1283, 1284 of first driving part 1281.

Figure 15A:
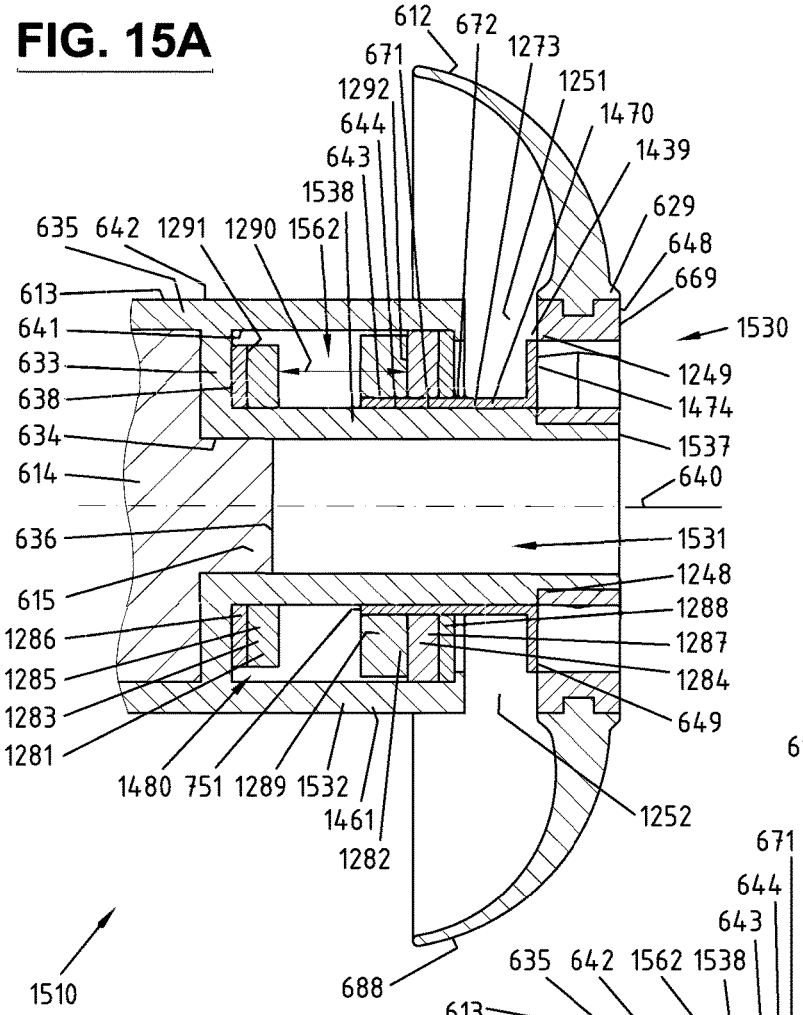
FIGS. 15A, B are lateral sectional views showing details of a hearing device with variable venting, in accordance with some embodiments of the present disclosure.
Figure 15B:
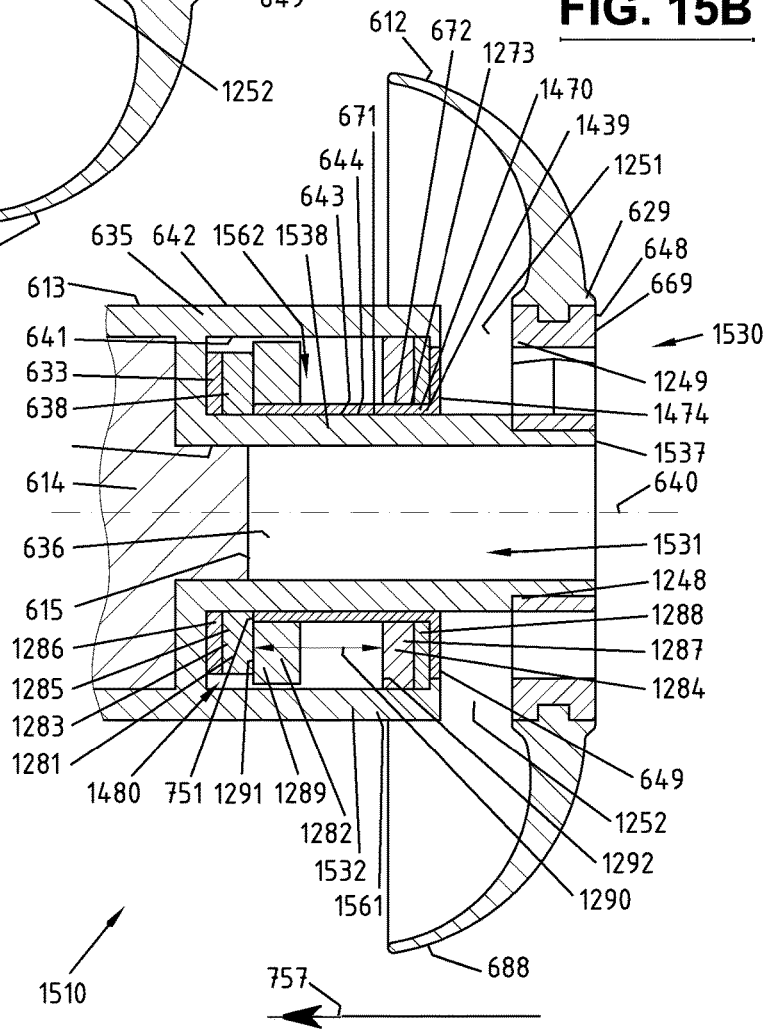

FIGS. 15A and 15B illustrate a hearing device 1510 with an adjustable vent, in accordance with some embodiments of the present disclosure. Corresponding features with respect to previously described embodiments are illustrated by the same reference numerals. In particular, a sound conduit 1530 of hearing device 1510 comprises features of embodiments of sound conduit 1430 illustrated by device 1410 in FIGS. 14A and 14B, wherein some differences to these embodiments are subsequently described. Sound conduit 1530 of device 1510 comprises a conduit housing 1532 having an inner side wall 1538 extending from first end 638 to second end 669 of sound conduit 1530. Inner side wall 1538 adjoins end wall 633 at the position of through hole 634 formed in end wall 633, wherein first opening 636 of sound conduit 1530 is provided inside inner side wall 1538. A sound conduit chamber 1531 is delimited by inner side wall 1538 in the direction of central axis 640. Open end 1248 of inner side wall 1538 delimits a central front opening 1537 surrounding central axis 640 at second end 699 of sound conduit 1530. Central front opening 1537 provides a second opening of sound conduit 1530 provided for output of soundwaves from sound conduit chamber 1531. Conduit housing 1532 is provided between first opening 636 of sound conduit 1530 and second opening 1537 of sound conduit 1530.

Housing opening 1237 is provided at outer end 648 of conduit housing 1532 and delimited by inner surface 641 of outer side wall 635 of conduit housing 1532. Housing opening 1237 surrounds central front opening 1537 at a larger radial distance with respect to central axis 640. Thus, an outer front opening is provided in between outer side wall 635 and inner side wall 1538 at second end 669 of conduit housing 1532. Housing opening 1237 comprises the outer front opening at an outer radial portion with respect to central axis 640 and central front opening 1537 at an inner radial portion with respect to central axis 640. A venting pathway in sound conduit 1530 is defined as a passage way for sound waves from the outer front opening of housing opening 1237 through a chamber formed in between inner side wall 1538 and outer side wall 635 out of at least one of vent openings 1251, 1252. The venting pathway is provided outside of sound conduit chamber 1531. A venting inlet to the venting pathway is formed by the outer front opening of housing opening 1237. A venting outlet in sound conduit 1530 from the venting pathway is formed by at least one of vent openings 1251, 1252. An actuator chamber 1562 containing actuator 1480 is delimited by an actuator housing 1561. Actuator housing 1561 comprises inner side wall 1538 and a portion of outer side wall 635 of conduit housing 1532. Actuator housing 1561 extends from first end 638 to second end 669 of sound conduit 1530. Actuator chamber 1562 thus forms a part of the venting pathway, as described above.

Figure 16A:
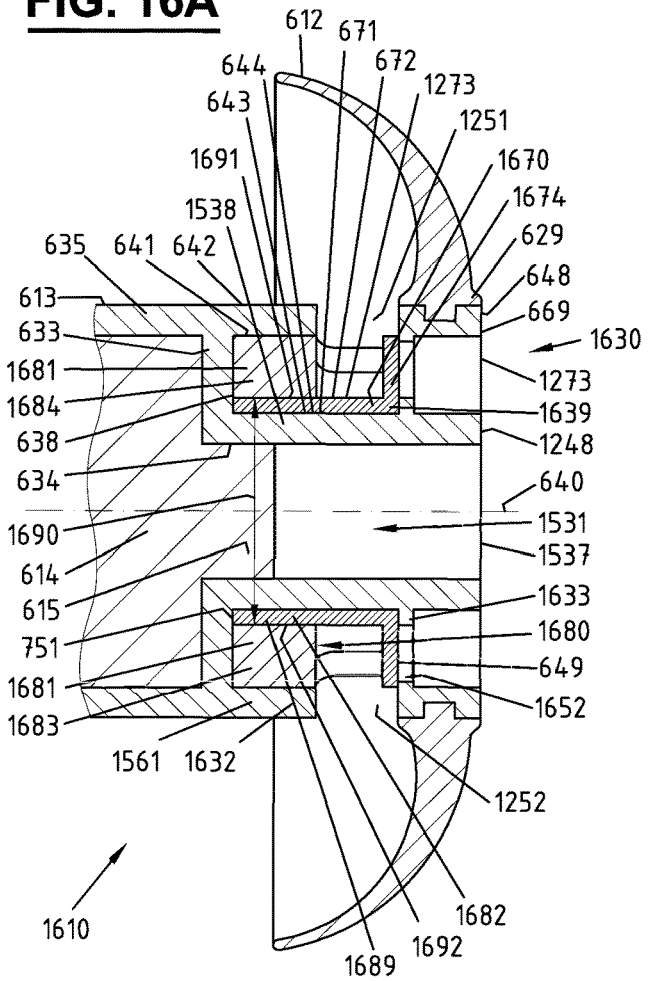
FIGS. 16A, B are lateral sectional views showing details of a hearing device with variable venting, in accordance with some embodiments of the present disclosure.
Figure 16C:
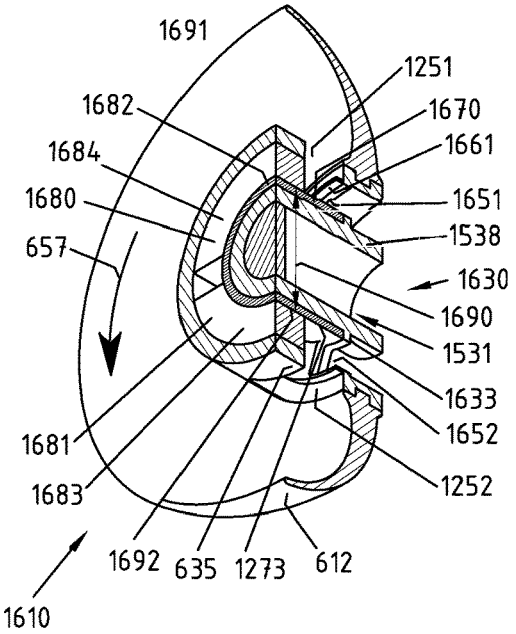
FIG. 16C is a perspective view of a lateral section of the hearing device illustrated in FIGS. 16A and 16B.
Figure 16B:
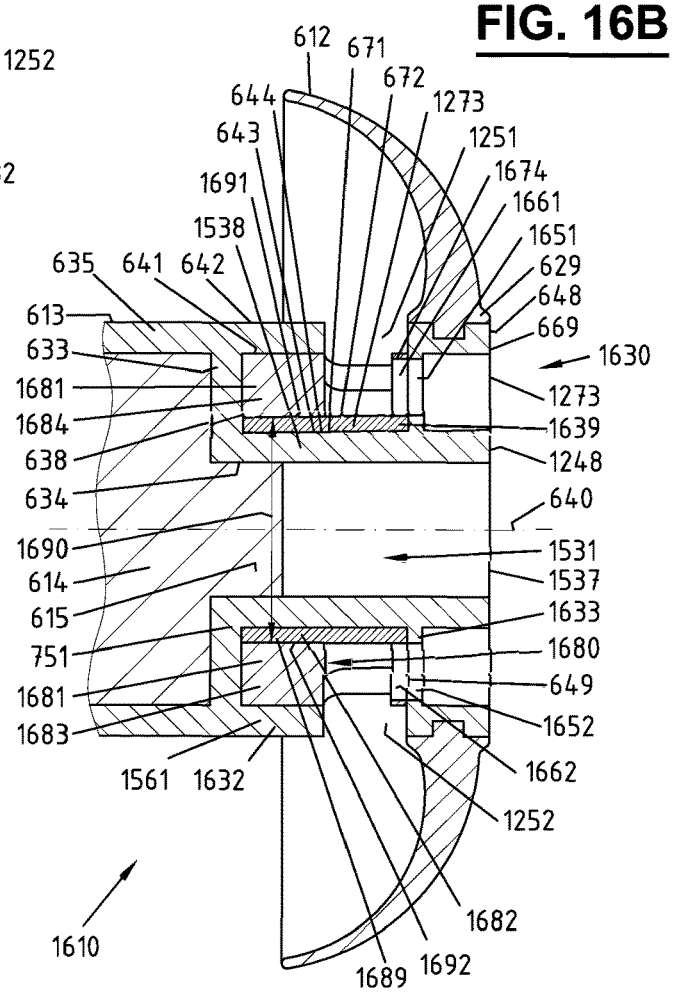

FIGS. 16A, 16B and 16C illustrate a hearing device 1610 with an adjustable vent, in accordance with some embodiments of the present disclosure. Corresponding features with respect to previously described embodiments are illustrated by the same reference numerals. In particular, a sound conduit 1630 and an actuator 1680 of hearing device 1610 comprises features of embodiments of sound conduit 1430 and actuator 1480 illustrated by device 1510 in FIGS. 15A and 15B, wherein some differences to these embodiments are subsequently described. Sound conduit 1630 comprises an acoustic valve 1639 including a valve member 1670. Side wall 1273 of valve member 1670 is provided at inner side wall 1538 of a conduit housing 1632, such that coupling surfaces 643, 644 for said relative motion are provided at inner surface 671 of valve member side wall 1273 and an outer surface of inner side wall 1538 of conduit housing 1632. Coupling surfaces 643, 644 are configured such that a relative motion, in particular a sliding movement, of valve member 1670 relative to conduit housing 1632 along coupling surfaces 643, 644 can be provided. The sliding movement comprises a rotational motion 657, in particular around central axis 640 of sound conduit 1630. Valve member 1670 comprises an end wall 1674 provided on outer surface 672 of side wall 1273. End wall 1674 is configured to close the space provided in between inner side wall 1538 and outer side wall 635 toward second end 669 of sound conduit 1630. End wall 1674 comprises valve openings 1661, 1662. Valve openings 1661, 1662 are provided as holes in end wall 1674. Valve openings 1661, 1662 are oriented toward housing opening 1273. Valve openings 1661, 1662 are oriented in the same direction as second opening 1537 of sound conduit 1630. Valve openings 1661, 1662 are spaced from one another in a circumferential direction with respect to central axis 640.

Conduit housing 1632 is provided between first opening 636 of sound conduit 1630 and second opening 1537 of sound conduit 1630. Conduit housing 1632 comprises an inlet wall 1633 provided in between inner side wall 1538 and outer side wall 635. Inlet wall 1633 thus separates a chamber formed in between inner side wall 1538 and outer side wall 635 of conduit housing 1632 from the outer opening of housing opening 1237. Inlet wall 1633 extends in parallel to end wall 633. Inlet wall 1633 is provided in front of end wall 1674 of valve member 1670 such that it is arranged in between housing opening 1237 and valve member end wall 1674. Inlet wall 1633 has an axially inner surface with respect to the axial direction defined by central axis 640 adjoining an axially outer surface of end wall 1674 of valve member 1670. End wall 1674 of valve member 1670 has a radial length with respect to central axis 640 substantially corresponding to a radial length of inlet wall 1633. Inlet wall 1633 has an annular form, in particular a ring-shape. Inlet openings 1651, 1652 are provided in inlet wall 1633. Inlet openings 1651, 1652 are formed as holes in inlet wall 1633. Inlet openings 1651, 1652 are oriented toward housing opening 1273. Inlet openings 1651, 1652 are oriented in the same direction as second opening 1537 of sound conduit 1630. Inlet openings 1651, 1652 are spaced from one another in a circumferential direction with respect to central axis 640.

The spacing in between inlet openings 1651, 1652 and the spacing in between valve openings 1661, 1662 is provided such that valve openings 1661, 1662 can be relatively positioned in the spacing between inlet openings 1651, 1652. In this configuration, inlet openings 1651, 1652 and valve openings 1661, 1662 are closed at their adjoining surfaces. This configuration is referred to as a closed position, in which the vent opening and the valve opening are unaligned such that the vent opening is closed. Such a configuration is illustrated in FIG. 16A. The spacing in between inlet openings 1651, 1652 and the spacing in between valve openings 1661, 1662 is provided such that valve openings 1661, 1662 can be relatively positioned at the circumferential position of inlet openings 1651, 1652, in which relative position valve openings 1661, 1662 and inlet openings 1651, 1652 at least partially overlap. In this configuration, inlet openings 1651, 1652 and valve openings 1661, 1662 may be fully or partially opened at the adjoining surfaces. This configuration is referred to as an alignment position, in which the inlet openings 1651, 1652 and the valve openings 1661, 1662 are aligned such that the inlet openings 1651, 1652 are at least partially open. Such a configuration is illustrated in FIGS. 16B and 16C. During the course of rotational motion 657 of valve member 1670 relative to conduit housing 1632, valve openings 1661, 1662 can be provided at different circumferential positions with respect to inlet openings 1651, 1652, such that a closed position, as depicted in FIG. 8A, and an alignment position, as depicted in FIG. 8B, of inlet openings 1651, 1652 and valve openings 1661, 1662 can be provided, in accordance with other embodiments described above. A venting pathway is defined by a passage way for sound waves from the outer front opening of housing opening 1237 through a chamber formed in between inner side wall 1538 and outer side wall 635, in particular through at least one of inlet openings 1651, 1652 and at least one of valve openings 1661, 1662, out of at least one of vent openings 1251, 1252. A venting inlet to the venting pathway is formed by the outer front opening of housing opening 1237. A venting outlet from the venting pathway is formed by at least one of vent openings 1251, 1252.

An actuator 1680 is provided inside actuator housing 1561. Actuator 1680 comprises a first driving part 1681 connected to conduit housing 1632. Actuator 1680 comprises a second driving part 1682 connected to valve member 1670. First driving part 1681 and second driving part 1682 are configured to interact via a magnetic field. First driving part 1681 extends around central axis 640. An interior space is delimited by first driving part 1681, the interior space extending around central axis 640. Second driving part 1682 is arranged in the interior space. Thus, first driving part 1681 at least partially surrounds second driving part 1682. First driving part 1681 extends around inner surface 641 of side wall 635 of conduit housing 1632. First driving part 1681 is provided at an axial position in between first end 638 of sound conduit 1630, in particular first end of actuator housing 1561, and the axial position of vent openings 1251, 1252. First driving part 1681 substantially has an annular form, in particular a ring-shape.

First driving part 1681 comprises a plurality of magnetic members 1683, 1684. Magnetic members 1683, 1684 are successively arranged in a circumferential direction of first driving part 1681. Each of magnetic members 1683, 1684 thus forms an annular portion of first driving part 1681.

Magnetic members 1683, 1684 each comprise an inner pole surface 1691, 1692 at which a respective magnetic pole is provided. Inner pole surfaces 1691, 1692 are curved. The curvature of inner pole surfaces 1691, 1692 extends around central axis 640. Inner pole surfaces 1691, 1692 point toward central axis 640. Magnetic members 1683, 1684 are opposing each other in a radial direction across central axis 640. Opposing magnetic members 1683, 1684 are spaced from one another in a radial direction across central axis 640, such that a spacing distance 1690 between magnetic members 1683, 1684 is provided. Spacing distance 1690 spans across the interior space delimited by first driving part 1681, in which second driving part 1682 is provided. Opposing magnetic members 1683, 1684 are provided with a different magnetic polarity, in particular at their inner pole surface 1691, 1692. Inner pole surfaces 1691, 1692 are thus configured such that flux lines of the magnetic field can emanate on pole surfaces 1691, 1692 across the interior space delimited by first driving part 1681 around central axis 640. In this way, a magnetic field in between radially opposing magnetic members 1683, 1684 can be provided such that flux lines of the magnetic field extend in between inner pole surfaces 1691, 1692 of magnetic members 1683, 1684. The magnetic field is provided in spacing distance 1690. Opposing magnetic members 1683, 1684 are thus configured such that their inner pole surfaces 1691, 1692 are facing second driving part 1682 provided within spacing distance 1690.

Second driving part 1682 comprises a magnetic member 1689. Magnetic member 1689 comprises a conductor configured to be supplied with a current. In this way, a Lorentz force can be generated in the conductor by the current, wherein the Lorentz force is caused by the magnetic field provided from surrounding magnetic members 1683, 1684 of first driving part 1681. A different magnetic polarity of radially opposing magnets 1683, 1684 can ensure that the Lorentz force points in a consistent direction required for an actuation of rotational motion 657 at different surface portion of valve member 1670. In this way, rotational motion 657 of valve member 1670 can be actuated. In particular, a corresponding technical principle applied in electromotors for a rotational motion may be employed for the actuation of rotational motion 657 of valve member 1670. Magnetic member 1689 may comprise at least one coil, by which the conductor is provided.

Figure 17A:
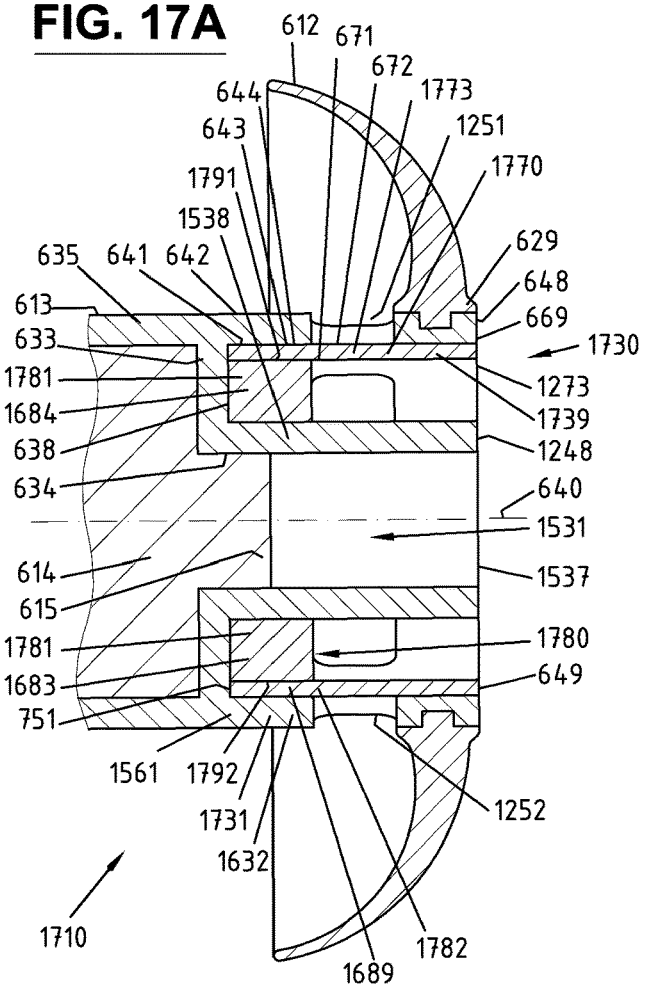
FIGS. 17A, B are lateral sectional views showing details of a hearing device with variable venting, in accordance with some embodiments of the present disclosure.
Figure 17C:
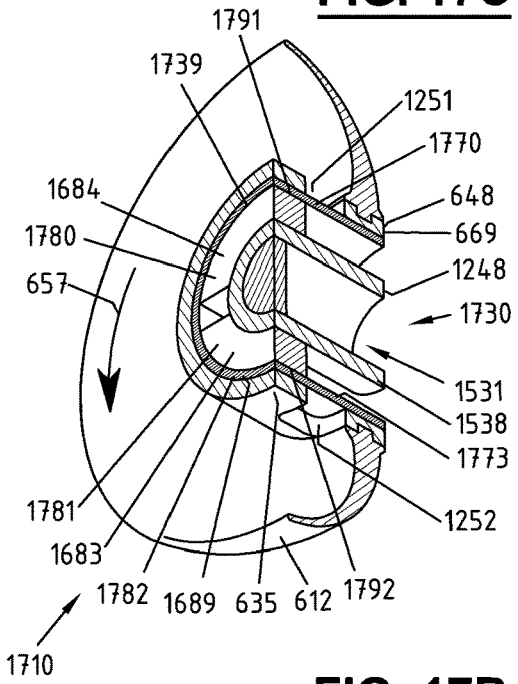
FIG. 17C is a perspective view of a lateral section of the hearing device illustrated in FIGS. 17A and 17B.
Figure 17B:
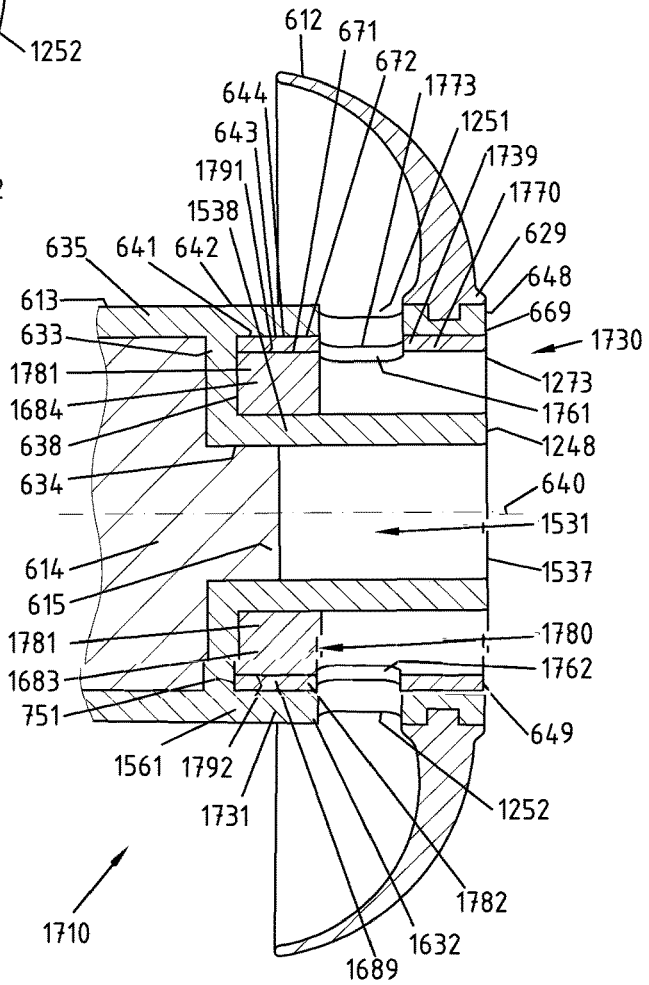

FIGS. 17A, 17B and 17C illustrate a hearing device 1710 with an adjustable vent, in accordance with some embodiments of the present disclosure. Corresponding features with respect to previously described embodiments are illustrated by the same reference numerals. In particular, a sound conduit 1730 of hearing device 1710 comprises features of embodiments of sound conduit 1630 illustrated by device 1610 in FIGS. 16A, 16B and 16C, wherein some differences to these embodiments are subsequently described. Sound conduit 1730 comprises an acoustic valve 1739 including a valve member 1770. Valve member 1770 is provided by a side wall 1773. An outer surface 672 of valve member side wall 1773 is arranged at inner surface 641 of side wall 635 of conduit housing 1632, such that coupling surfaces 643, 644 for said relative motion are provided. Coupling surfaces 643, 644 are configured such that a relative motion, in particular a sliding movement, of valve member 1770 relative to conduit housing 1632 along coupling surfaces 643, 644 can be provided. The sliding movement comprises rotational motion 657, in particular around central axis 640 of sound conduit 1730. Inner end 751 of valve member 1770 is provided at first end 638 of sound conduit 1730. Outer end 649 of valve member 1770 is provided at second end 669 of sound conduit 1730. Valve member 1770 thus extends through a total length of sound conduit 1730 in parallel to central axis 640.

Valve openings 1761, 1762 are provided in side wall 1773 of valve member 1770. Valve openings 1761, 1762 are provided as holes formed in side wall 1773 of valve member 1770. A diameter of valve openings 1761, 1762 extends in parallel to central axis 640 of sound conduit 1730, in particular such that valve openings 1761, 1762 are oriented toward central axis 640. Valve openings 1761, 1762 are provided around a circumference of side wall 1773 of valve member 1770. A spacing of valve openings 1761, 1762 around the circumference of valve member 1770 is provided such that valve openings 1761, 1762 can be relatively positioned in the spacing between vent openings 1251, 1252, corresponding to a closed position in accordance with previously described embodiments. The spacing of valve openings 1761, 1762 around the circumference of valve member 1770 is provided such that valve openings 1761, 1762 can be relatively positioned at the circumferential position of vent openings 1251, 1252, in which position vent openings 1251, 1252 and valve openings 1761, 1762 at least partially overlap, corresponding to an alignment position in accordance with previously described embodiments. A venting pathway is defined by a passage way for sound waves from the outer front opening of housing opening 1237 through a chamber formed in between inner side wall 1538 out of at least one of valve openings 1761, 1762 and at least one of vent openings 1251, 1252. A venting inlet to the venting pathway is formed by the outer front opening of housing opening 1237. A venting outlet from the venting pathway is formed by at least one of valve openings 1761, 1762 and at least one of vent openings 1251, 1252.

An actuator 1780 is provided inside actuator housing 1561. Actuator 1780 comprises a first driving part 1781 connected to conduit housing 1632 and a second driving part 1782 connected to valve member 1770. First driving part 1781 extends around central axis 640, in particular around an outer surface of inner side wall 1538 of conduit housing 1632. Second driving part 1782 is arranged at an outer circumference of first driving part 1781, in particular in between first driving part 1781 and inner surface 641 of side wall 635 of conduit housing 1632. Magnetic members 1683, 1684 of first driving part 1781 that are neighbouring each other in the circumferential direction of first driving part 1781 are provided with a different magnetic polarity, in particular at an outer pole surface 1791, 1792 of magnetic members 1683, 1684 at which a magnetic pole is provided. Outer pole surfaces 1791, 1792 are curved. The curvature of outer pole surfaces 1791, 1792 extends around central axis 640. Outer pole surfaces 1791, 1792 are pointing away from central axis 640. Outer pole surfaces 1791, 1792 are thus configured such that flux lines of the magnetic field can emanate on pole surfaces 1791, 1792 in an opposed direction with respect to central axis 640. The magnetic field may comprise flux lines permeating a space surrounding outer pole surfaces 1791, 1792. The magnetic field may be provided such that it extends between neighbouring magnetic members 1683, 1684, in particular in a space surrounding outer pole surfaces 1791, 1792.

Magnetic member 1689 of second driving part 1782 comprises a conductor configured to be supplied with a current. In this way, a Lorentz force can be generated in the conductor by the current, wherein the Lorentz force is caused by the magnetic field emanating from outer pole surfaces 1791, 1792 of magnetic members 1683, 1684 of first driving part 1781. In this way, rotational motion 657 of valve member 1770 can be actuated. In other embodiments, second driving part 1782 comprises a plurality of magnetic members, wherein first driving part 1781 comprises a conductor configured to be supplied with a current in order to provide rotational motion 657 of valve member 1770 relative to conduit housing 1632. Beyond that, various other possibilities are conceivable in which the magnetic interaction between first driving part 1781 and second driving part 1782 can be implemented to provide rotational motion 657 of valve member 1770.

Actuators 1280, 1380, 1480, 1680, 1780 are thus configured to provide a magnetic field, by which magnetic field a driving force for said relative motion is provided. In some instances, actuators 1280, 1380, 1480, 1680, 1780 represent specific embodiments of actuator 45, 645 schematically illustrated in other previously described embodiments. In some instances, at least one of actuators 1280, 1380, 1480, 1680, 1780 may be applied in those embodiments in the place of actuator 45, 645 in order to activate said relative motion, in particular at least one of actuators 1280, 1380, 1480 for a translational motion and/or at least one of actuators 1680, 1780 for a rotational motion.

The sound conduit and the vent may be configured to provide for low/minimal acoustic impedance to sounds being vented through the hearing device. This may be provided by using the sound conduit as part of the acoustic pathway for venting the sounds through the hearing device and/or proximity of the vent to an opening of the sound conduit through which sounds leave the sound conduit and enter the ear canal upstream of/medial to the hearing device. Low/minimal acoustic impedance, in accordance with some invention of the present disclosure, may be provided by using a vent conduit for at least part of the venting pathway, where the vent conduit surrounds the sound conduit and defines a vent chamber having a volume similar to a sound chamber defined by the sound conduit; and/or using a vent conduit for at least part of the venting pathway where, the vent conduit has similar dimensions to the sound conduit; and/or a large vent opening.

Subsequently, a method for adjusting venting through a hearing device, in accordance with some embodiments of the present disclosure, is described. A hearing device is provided comprising a sound conduit configured to provide an acoustic pathway between a receiver and a user's eardrum. In some instances, the hearing device may comprise a first part that is disposed external to a user's ear canal and an internal part that is disposed at least partially with the user's ear canal. For example, electronic circuitry such as a microphone, the receiver, a processor, an antenna and/or the like may be disposed in the first part of the hearing device outside of the ear canal. In the instance where the receiver is disposed outside of the ear canal, a sound tube, the sound conduit and/or the like may provide an acoustic pathway between the receiver and a portion of the user's ear canal upstream of/medial to the hearing device. In some instances, the first part of the hearing device and the second part of the hearing device may be in wired and/or wireless communication. The sound conduit may define an acoustic chamber through which sound waves can travel from the receiver to an upstream/medial section of the ear canal and to a user's eardrum. The sound conduit may include a vent opening providing an acoustic pathway between the sound chamber and an ambient region of the user's ear canal downstream of/lateral to the hearing device. Being downstream of the hearing device, the ambient region of the ear canal may be open to ambient sounds received by the ear. The hearing device can seals and/or block the ear canal. In some instances, the hearing device may comprise an ear tip, flexible element and/or the like configured to create a seal between the hearing device and an ear canal wall. In some instances, the hearing device may be configured such that when it is disposed in the ear canal it blocks the ear canal. Sealing and/or blocking the ear canal creates a sealed region of the ear canal upstream of/medial to the hearing device. In this way, the hearing device prevents ambient sounds entering the sealed region and interfering with sounds generated by the receiver.

An acoustic valve can be used to adjust the vent in the sound conduit. The acoustic valve may completely close the vent, may provide for the acoustic valve being completely open or may adjust the vent between these two states. In some embodiments of the present disclosure the acoustic valve is moveably coupled with the sound conduit. As such, in some embodiments, either the sound conduit or the acoustic valve may be moved to adjust the closing/opening of the vent by the acoustic. The acoustic valve may comprise a valve opening that may provide for adjusting the venting by aligning/misaligning the vent and the valve opening. In some embodiments, the venting through the vent may be adjusted while the hearing device is inserted into the ear canal. For example, in some instances the acoustic valve may be moveably coupled with the sound conduit such that the sound conduit and the acoustic valve are capable of translational/longitudinal motion with respect to one another. In such instance, a user may push on the hearing device and/or a button on the hearing device to provide for translational/longitudinal motion of the acoustic valve with respect to the sound conduit and/or the sound conduit with respect to the acoustic valve. The button may be mechanically/electronically coupled with the acoustic valve to provide for communication of the user input to the acoustic valve and motion of the acoustic valve with respect to the sound conduit. In some instances, the acoustic valve may be moveably coupled with the sound conduit such that the sound conduit and the acoustic valve are configured such that the acoustic valve and the sound conduit are capable of rotational motion with respect to one another. In such instance, a user may rotate the hearing device and/or push a button on the hearing device to provide for rotational motion of the acoustic valve with respect to the sound conduit. The button may be mechanically/electronically coupled with the acoustic valve to provide for communication of the user input to the acoustic valve and motion of the acoustic valve with respect to the sound conduit. In some embodiments, an actuator, such as an electrical actuator, a hydraulic actuator and/or the like may be used to move the acoustic valve and the sound tube with respect to one another and adjust the venting through the vent.

While the principles of the disclosure have been described above in connection with specific apparatuses and methods, it is to be clearly understood that this description is made only by way of example and not as limitation on the scope of the invention. The above described preferred embodiments are intended to illustrate the principles of the invention, but not to limit the scope of the invention. Various other embodiments and modifications to those preferred embodiments may be made by those skilled in the art without departing from the scope of the present invention that is solely defined by the claims.

The invention claimed is:

1. A communication device configured for use in a user's ear canal comprising:

a sealing mechanism configured to acoustically seal a section of the ear canal upstream of the communication device, said sealed section being located between the sealing mechanism and the user's ear drum;

a sound conduit in acoustic communication with a sound source and configured to provide for transmission of sound waves from the sound source through the sound conduit and into the sealed section of the ear canal, wherein the sound conduit includes:

a first opening configured to provide for entry of sound waves from the sound source into the sound conduit;

a second opening configured to provide for output of sound waves from the sound conduit into the ear canal;

a conduit housing at least partially provided between the first opening and the second opening; and a vent opening in the conduit housing, the vent opening configured to provide for venting of sound waves through the vent opening, an acoustic valve having a valve member moveably coupled with the conduit housing, which moveable coupling is configured to provide a relative motion of the valve member and the conduit housing, the relative motion including a translational motion of the valve member with respect to the conduit housing or a rotational motion of the valve member with respect to the conduit housing, such that by said relative motion the acoustic valve is configured to provide for opening or closing the vent opening;

the communication device further comprising an electrical actuator configured to activate said relative motion, wherein the actuator is configured to provide a magnetic field, by which magnetic field a driving force for said relative motion is provided, wherein the actuator includes a first driving part fixedly coupled to the conduit housing and a second driving part fixedly coupled to the valve member, wherein the first driving part and the second driving part are configured to interact via said magnetic field, wherein said first driving part or said second driving part includes two magnetic members spaced from one another at a spacing distance and configured to provide for magnetic interaction with the other of said first driving part and second driving part within the spacing distance, wherein the magnetic member of the other of said first driving part and second driving part is provided within the spacing distance, wherein each of the two of the magnetic members includes a magnetizable material, wherein at least one of the two of the magnetic members includes a conductor configured to be supplied with a current, such that the conductor is configured to generate at least part of said magnetic field, the at least part of the magnetic field generated by the conductor being deactivatable, the magnetizable material of the at least one of the two of the magnetic members being configured to store at least part of the magnetic field generated by the coil after deactivation of the magnetic field generated by the coil, wherein the other of the first driving part and the second driving part comprises a magnet, wherein the conduit housing includes an outer side wall and an inner side wall, the outer side wall having a larger distance from a central axis of the sound conduit than the inner side wall, wherein the magnetic member of the first driving part or the second driving part is provided in an actuator chamber between the outer side wall and the inner side wall, the valve member being at least partially disposed in the actuator chamber responsive to the vent being in the opening position or in the closing position, and wherein the communication device is dimensioned to be provided in the user's ear canal.

2. The communication device according to claim 1, wherein the actuator is configured to move the valve member.

3. The communication device according to claim 1, wherein the conduit housing includes a coupling surface at which said moveable coupling is provided such that said relative motion is directed along said coupling surface.

4. The communication device according to claim 3, wherein the coupling surface is provided at a surface of a side wall of the conduit, wherein the valve member is at least partially disposed at the coupling surface.

5. The communication device according to claim 1, wherein the magnetic member of the first driving part or the second driving part includes a magnetic pole having a pole surface configured such that flux lines of said magnetic field can emanate on the pole surface, wherein the magnetic member of the other of said first driving part and second driving part is provided in a space permeated by said flux lines of said magnetic field.

6. The communication device according to claim 5, wherein the pole surface includes a curvature around a central axis of the sound conduit.

7. The communication device according to claim 5, wherein the pole surface points in a direction at which the second opening of the sound conduit is provided.

8. The communication device according to claim 1, wherein the magnetic members are arranged such that said spacing distance extends in parallel to a side wall of the conduit housing.

9. The communication device according to claim 1, wherein the magnetic members spaced from one another at the spacing distance are configured such that a retention force is provided by said magnetic field at each end of the spacing distance, by which retention force the magnetic member provided within the spacing distance can be retained in a stable position at a respective end position of said relative motion of the valve member and the conduit housing.

10. The communication device according to claim 1, wherein the magnetic member includes a magnetizable element that is provided within a range of the conductor, the range being selected such that the magnetizable element is configured to be magnetized by the magnetic field provided by the conductor.

11. The communication device according to claim 10, wherein the magnetic member is configured such that a retention force is provided by said magnetic field, by which retention force the first driving part and the second driving part can be retained in a stable position at a respective end position of said relative motion of the valve member and the conduit housing, wherein said retention force is at least partially provided from the magnetizable element.

12. The communication device according to claim 10, wherein each of the magnetic members spaced from one another at the spacing distance includes a conductor configured to be supplied with a current and a magnetizable element within the range of the respective conductor, wherein said retention force is at least partially provided at each end of the spacing distance from the magnetizable element of the magnetic member provided at the respective end of the spacing distance.

13. The communication device according to claim 1, wherein the magnetic member of the first driving part or the second driving part is provided at a larger axial distance from the second opening than an axial distance of the vent opening from the second opening, the axial distance defined as a distance in the direction of a central axis of the sound conduit.

14. The communication device according to claim 1, wherein inner side wall of the conduit housing at least partially delimits a sound conduit chamber in a direction of a central axis of the sound conduit, the sound conduit chamber configured to provide for travelling of sound waves from the first opening to the second opening along said central axis, wherein the vent opening is formed in the inner side wall of the conduit housing and leads to the sound conduit chamber.

15. A communication device configured for use in a user's ear canal comprising:

a sealing mechanism configured to acoustically seal a section of the ear canal upstream of the communication device, said sealed section being located between the sealing mechanism and the user's ear drum;

a sound conduit in acoustic communication with a sound source and configured to provide for transmission of sound waves from the sound source through the sound conduit and into the sealed section of the ear canal, wherein the sound conduit includes:

a first opening configured to provide for entry of sound waves from the sound source into the sound conduit;

a second opening configured to provide for output of sound waves from the sound conduit into the ear canal;

a conduit housing at least partially provided between the first opening and the second opening; and a vent opening in the conduit housing, the vent opening configured to provide for venting of sound waves through the vent opening, an acoustic valve having a valve member moveably coupled with the conduit housing, which moveable coupling is configured to provide a relative motion of the valve member and the conduit housing, the relative motion including a translational motion of the valve member with respect to the conduit housing or a rotational motion of the valve member with respect to the conduit housing, such that by said relative motion the acoustic valve is configured to provide for opening or closing the vent opening;

the communication device further comprising an electrical actuator configured to activate said relative motion, wherein the actuator is configured to provide a magnetic field, by which magnetic field a driving force for said relative motion is provided, wherein the actuator includes a first driving part fixedly coupled to the conduit housing and a second driving part fixedly coupled to the valve member, wherein the first driving part and the second driving part are configured to interact via said magnetic field, wherein said first driving part or said second driving part includes two permanent magnets spaced from one another at a spacing distance and configured to provide for magnetic interaction with the other of said first driving part and second driving part within the spacing distance, wherein the other of the first driving part and the second driving part is provided within the spacing distance and comprises a magnetic member including a magnetizable material and also comprises a conductor configured to be supplied with a current, such that the conductor is configured to generate at least part of said magnetic field, the magnetic member being provided in a magnetic range of the conductor, wherein the conduit housing includes an outer side wall and an inner side wall, the outer side wall having a larger distance from a central axis of the sound conduit than the inner side wall, wherein the magnetic member of the first driving part or the second driving part is provided in an actuator chamber between the outer side wall and the inner side wall, the valve member being at least partially disposed in the actuator chamber, and wherein the communication device is dimensioned to be provided in the user's ear canal.

16. The communication device according to claim 15, wherein the conductor is a coil.

17. The communication device according to claim 15, wherein the at least part of the magnetic field generated by the conductor being deactivatable, the magnetizable material of the at least one of the two of the magnetic members being configured to store at least part of the magnetic field generated by the coil after deactivation of the magnetic field generated by the coil.

* * * * *